US010235966B2

(12) United States Patent
Nakanishi et al.

(10) Patent No.: US 10,235,966 B2
(45) Date of Patent: Mar. 19, 2019

(54) IMAGE DISPLAY DEVICE AND METHOD OF DISPLAYING IMAGE

(71) Applicant: Japan Display Inc., Tokyo (JP)

(72) Inventors: Takayuki Nakanishi, Tokyo (JP); Tatsuya Yata, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 15/709,877

(22) Filed: Sep. 20, 2017

(65) Prior Publication Data

US 2018/0018935 A1 Jan. 18, 2018

Related U.S. Application Data

(63) Continuation of application No. 15/498,946, filed on Apr. 27, 2017, now Pat. No. 9,852,710, which is a continuation of application No. 14/805,645, filed on Jul. 22, 2015, now abandoned.

(30) Foreign Application Priority Data

Jul. 22, 2014 (JP) ..... 2014-149242

(51) Int. Cl.
*G09G 5/02* (2006.01)
*G09G 3/20* (2006.01)

(52) U.S. Cl.
CPC ..... *G09G 5/02* (2013.01); *G09G 3/2003* (2013.01); *G09G 3/2074* (2013.01); (Continued)

(58) Field of Classification Search
CPC ..... G09G 5/02; G09G 2300/0439; G09G 2300/0452; G09G 3/2074; G09G 3/3225
See application file for complete search history.

(56) References Cited

U.S. PATENT DOCUMENTS 7,868,862 B2 * 1/2011 Lee ..... G09G 3/3607 345/204
8,743,152 B2 6/2014 Sakaigawa
(Continued)

FOREIGN PATENT DOCUMENTS

CN 100507651 C 7/2009
JP 2004-529396 A 9/2004
(Continued)

OTHER PUBLICATIONS

Chinese Office Action dated Sep. 1, 2017 for corresponding Chinese Patent Application No. 201510434875.7.
(Continued)

*Primary Examiner* — Antonio A Caschera
(74) *Attorney, Agent, or Firm* — Michael Best & Friedrich LLP

(57) ABSTRACT

An image display device includes an image display unit including first pixels each constituted of sub-pixels of three or more colors included in a first color gamut and second pixels each constituted of sub-pixels of three or more colors included in a second color gamut different from the first color gamut, the first pixels and the second pixels being arranged in a matrix and adjacent to each other; and a processing unit that determines an output of the sub-pixels included in each pixel of the image display unit corresponding to an input image signal. The processing unit determines an output of the sub-pixels included in the other one of the pixels based on part of components of an input image signal corresponding to one of the first pixel and the second pixel that are adjacent to each other.

6 Claims, 40 Drawing Sheets

(52) U.S. Cl.
CPC ..... *G09G 2300/0452* (2013.01); *G09G 2320/0666* (2013.01); *G09G 2340/0457* (2013.01); *G09G 2340/06* (2013.01)

(56) References Cited

U.S. PATENT DOCUMENTS

| | | | | |
|---|---|---|---|---|
| 2004/0174389 | A1 | 9/2004 | Ben-David et al. | |
| 2006/0038953 | A1 | 2/2006 | Moriya | |
| 2007/0126677 | A1 | 6/2007 | Lee et al. | |
| 2007/0268208 | A1 | 11/2007 | Okada et al. | |
| 2008/0024410 | A1 | 1/2008 | Ben-David et al. | |
| 2008/0049042 | A1 | 2/2008 | Yang et al. | |
| 2008/0174849 | A1 | 7/2008 | Asao | |
| 2009/0167779 | A1 | 7/2009 | Inuzuka | |
| 2009/0322662 | A1 | 12/2009 | Yoshida et al. | |
| 2010/0188437 | A1 | 7/2010 | Itoh et al. | |
| 2011/0285748 | A1* | 11/2011 | Slatter ..... | G09G 5/02 345/597 |

FOREIGN PATENT DOCUMENTS

| | | | |
|---|---|---|---|
| JP | 2005-062833 | A | 3/2005 |
| JP | 2006-058604 | A | 3/2006 |
| JP | 2007-286618 | A | 11/2007 |
| JP | 2008-152244 | A | 7/2008 |
| JP | 2009-157127 | A | 7/2009 |
| JP | 2010-020241 | A | 1/2010 |
| JP | 2010-097170 | A | 4/2010 |
| JP | 2012-063784 | A | 3/2012 |
| KR | 10-2005-0045357 | A | 4/2011 |
| WO | 02/101644 | A2 | 12/2002 |
| WO | WO-2006/018926 | A1 | 2/2006 |
| WO | 2007/116589 | A1 | 10/2007 |
| WO | WO-2008/090845 | A1 | 7/2008 |

OTHER PUBLICATIONS

Korean Office Action dated May 23, 2016 for corresponding Korean Application No. 10-2015-0103700.

Taiwanese Office Action dated Jul. 6, 2016 for corresponding Taiwanese Application No. 104123754.

Japanese Office Action dated May 9, 2017 for corresponding Japanese Patent Application No. 2014-149242.

Japanese Office Action corresponding to Japanese Patent Application No. 2017-237792 dated Nov. 6, 2018.

Japanese Appeal Decision corresponding to Japanese Patent Application No. 2014-149242 dated Dec. 11, 2018.

* cited by examiner

IMAGE DISPLAY DEVICE AND METHOD OF DISPLAYING IMAGE

CROSS-REFERENCE TO RELATED APPLICATIONS

The present application is a Continuation of application Ser. No. 15/498,946, filed Apr. 27, 2017, which is a Continuation of application Ser. No. 14/805,645, filed Jul. 22, 2015, which claims priority from Japanese Application No. 2014-149242, filed on Jul. 22, 2014, the contents of which are incorporated by reference herein in its entirety.

BACKGROUND OF THE INVENTION

1. Field of the Invention

The present invention relates to an image display device and a method of displaying an image.

2. Description of the Related Art

Known is an image display device including a plurality of pixels each of which includes sub-pixels of respective color components (red, blue, and green) constituting an input image signal to each pixel and a sub-pixel of a component (white) other than the color components (refer to Japanese Patent Application Laid-open Publication No. 2010-20241 (JP-A-2010-20241)).

In the configuration described in JP-A-2010-20241, when white is required to be extended, such as where the input where the input image signal is represented as (R,G,B=255, 255, 255), only a white sub-pixel is lit. Similarly, when a color directly corresponding to the color of the sub-pixel is required to be extended, only the sub-pixel of this color is lit. However, when a color that does not correspond to the color of the sub-pixel, such as cyan, magenta, and yellow corresponding to complementary colors of red, blue, and green, is required to be extended, a plurality of sub-pixels are lit. In this case, if there is a sub-pixel corresponding to the complementary color, only this sub-pixel may be lit. In this way, as the number of colors of sub-pixels increases, the number of pixels to be lit in color extension can be reduced.

However, as the number of sub-pixels included in one pixel increases, an area of the pixel used for color extension corresponding to the input image signal corresponding to one pixel increases. Due to this, when the area of the sub-pixel is not changed corresponding to an increase or a decrease in the number of sub-pixels included in one pixel, as the number of sub-pixels included in one pixel increases, apparent resolution is lowered in a display output by the image display device.

The present invention is made in view of such a situation, and provides an image display device and a method of displaying an image for causing the number of colors of sub-pixels to be compatible with high resolution.

SUMMARY OF THE INVENTION

It is an object of the present invention to at least partially solve the problems in the conventional technology.

According to an aspect of the invention, an image display device comprises an image display unit including first pixels each constituted of sub-pixels of three or more colors included in a first color gamut and second pixels each constituted of sub-pixels of three or more colors included in a second color gamut different from the first color gamut and at least one color of the three or more colors is different from the colors of the sub-pixels in each of the first pixels, the first pixels and the second pixels being arranged in a matrix, and the first pixels and the second pixels being adjacent to each other; and a processing unit that determines an output of the sub-pixels included in each pixel of the image display unit corresponding to an input image signal. The processing unit determines an output of the sub-pixels included in the other one of the pixels based on part of components of an input image signal corresponding to one of the first pixel and the second pixel that are adjacent to each other.

According to another aspect of the invention, a method of displaying an image to determine an output of sub-pixels included in each pixel of an image display unit, first pixels each constituted of sub-pixels of three or more colors included in a first color gamut and second pixels each constituted of sub-pixels of three or more colors included in a second color gamut different from the first color gamut, the first pixels and the second pixels being arranged in a matrix, and the first pixels being adjacent to the second pixels, the method comprises determining an output of the sub-pixels included in the other one of the pixels using part of components of an input image signal corresponding to one of the first pixel and the second pixel that are adjacent to each other.

DETAILED DESCRIPTION OF THE PREFERRED EMBODIMENTS

Figure 1:
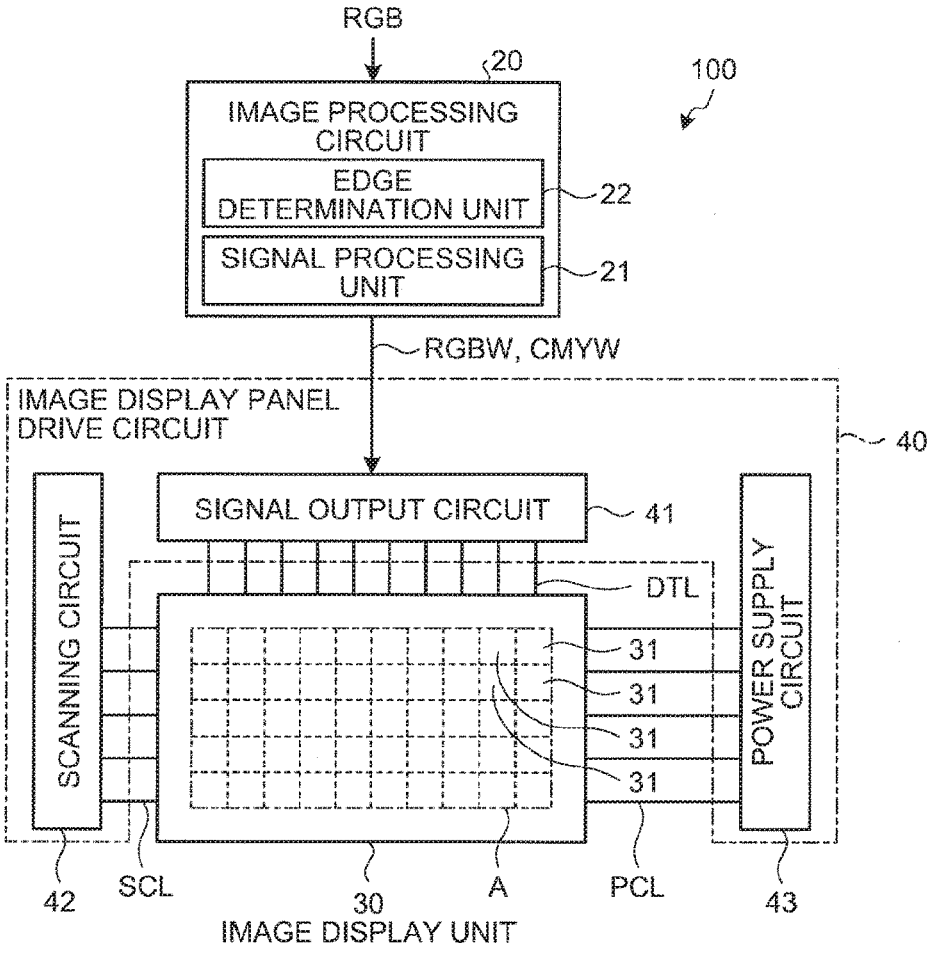
FIG. 1 is a block diagram illustrating an example of a configuration of an image display device according to an embodiment.

The following describes an embodiment of the present invention with reference to the drawings. The disclosure is merely an example, and the present invention naturally encompasses appropriate modifications maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same elements as those described in the drawings that have already been discussed are denoted by the same reference signs throughout the description and the drawings, and detailed description thereof will not be repeated in some cases.

Figure 2:
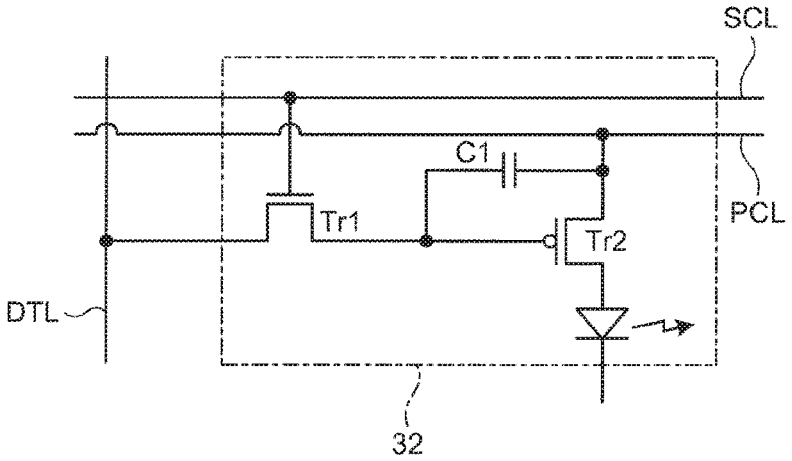
FIG. 2 is a diagram illustrating a lighting drive circuit of a sub-pixel included in a pixel of an image display unit according to the embodiment.
Figure 3:
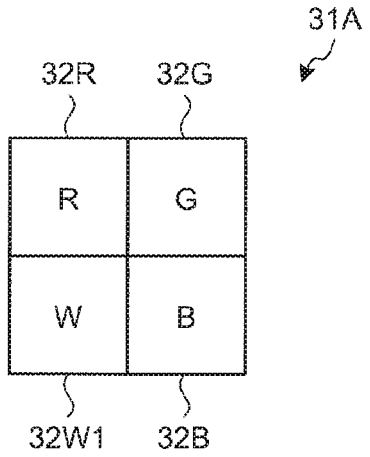
FIG. 3 is a diagram illustrating an array of sub-pixels of a first pixel according to the embodiment.
Figure 4:
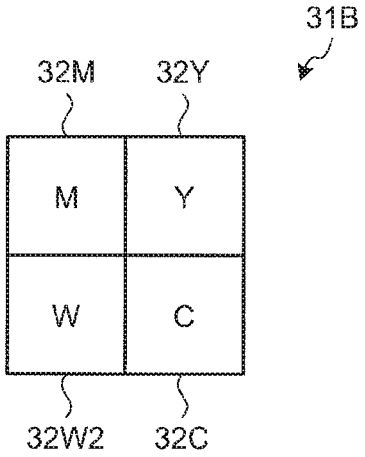
FIG. 4 is a diagram illustrating an array of sub-pixels of a second pixel according to the embodiment.
Figure 5:
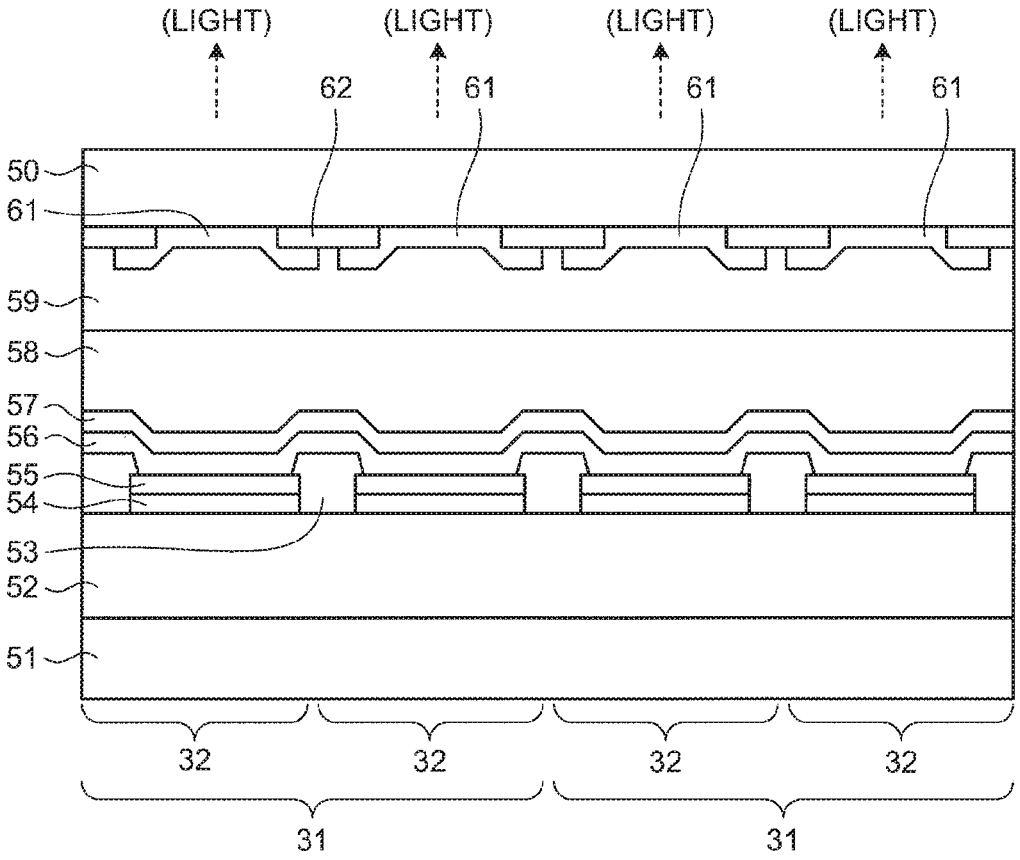
FIG. 5 is a diagram illustrating a cross-sectional structure of the image display unit according to the embodiment.

FIG. 1 is a block diagram illustrating an example of a configuration of an image display device 100 according to the embodiment. FIG. 2 is a diagram illustrating a lighting drive circuit of a sub-pixel 32 included in a pixel 31 of an image display unit 30 according to the embodiment. FIG. 3 is a diagram illustrating an array of sub-pixels 32 of a first pixel 31A according to the embodiment. FIG. 4 is a diagram illustrating an array of sub-pixels 32 of a second pixel 31B according to the embodiment. FIG. 5 is a diagram illustrating a cross-sectional structure of the image display unit 30 according to the embodiment.

As illustrated in FIG. 1, the image display device 100 includes an image processing circuit 20, the image display unit 30 serving as an image display panel, and an image display panel drive circuit 40 (hereinafter, also referred to as a drive circuit 40) that controls driving of the image display unit 30. A function of the image processing circuit 20 may be implemented as hardware or software, and is not specifically limited.

The image processing circuit 20 is coupled to the image display panel drive circuit 40 to drive the image display unit 30. The image processing circuit 20 includes a signal processing unit 21 and an edge determination unit 22. The signal processing unit 21 determines an output of the sub-pixels 32 (described later) included in each pixel 31 of the image display unit 30 corresponding to an input image signal. Specifically, for example, the signal processing unit 21 converts the input image signal of an RGB color space into an extended value of RGBW or an extended value of CMYW that is extended with four colors. The signal processing unit 21 outputs the generated output signal to the image display panel drive circuit 40. In this case, the output signal is a signal indicating an output (light emitting state) of the sub-pixels 32 included in the pixel 31. The edge determination unit 22 determines whether the input image signal is an input image signal corresponding to an edge of an image. Details about the determination by the edge determination unit 22 will be described later.

The drive circuit 40 is a control device of the image display unit 30, and includes a signal output circuit 41, a scanning circuit 42, and a power supply circuit 43. The drive circuit 40 for the image display unit 30 sequentially outputs an output signal to each pixel 31 of the image display unit 30 with the signal output circuit 41. The signal output circuit 41 is electrically coupled to the image display unit 30 via a signal line DTL. The drive circuit 40 for the image display unit 30 selects the sub-pixels 32 in the image display unit 30 with the scanning circuit 42, and controls ON/OFF of a switching element (for example, a thin film transistor (TFT)) to control operation of the sub-pixels 32. The scanning circuit 42 is electrically coupled to the image display unit 30 via a scanning line SCL. The power supply circuit 43 supplies electric power to a self-luminous body (described later) of each pixel 31 via a power supply line PCL.

As illustrated in FIG. 1, the image display unit 30 includes a display area A in which $P_0 \times Q_0$ pixels 31 ($P_0$ in a row direction, and $Q_0$ in a column direction) are arranged in a two-dimensional matrix (rows and columns). The image display unit 30 according to the embodiment includes a polygonal (for example, rectangular) planar display area having linear sides. However, this shape is merely an example of a specific shape of the display area A. The embodiment is not limited thereto, and can be appropriately modified.

The pixel 31 includes the first pixel 31A constituted of sub-pixels of three or more colors included in a first color gamut, and the second pixel 31B constituted of sub-pixels of three or more colors included in a second color gamut that is different from the first color gamut. When it is not necessary to distinguish the first pixel 31A from the second pixel 31B, they are collectively referred to as the pixel 31. The pixel 31 includes a plurality of sub-pixels 32, and lighting drive circuits of the sub-pixels 32 illustrated in FIG. 2 are arrayed in a two-dimensional matrix (rows and columns). The lighting drive circuit includes a control transistor Tr1, a driving transistor Tr2, and a charge holding capacitor C1. A gate of the control transistor Tr1 is coupled to the scanning line SCL, a source thereof is coupled to the signal line DTL, and a drain thereof is coupled to a gate of the driving transistor Tr2. One end of the charge holding capacitor C1 is coupled to the gate of the driving transistor Tr2, and the other end thereof is coupled to a source of the driving transistor Tr2. The source of the driving transistor Tr2 is coupled to the power supply line PCL, and a drain of the driving transistor Tr2 is coupled to an anode of an organic light-emitting diode serving as the self-luminous body. A cathode of the organic light-emitting diode is coupled to, for example, a reference potential (for example, a ground). In the example of FIG. 2, the control transistor Tr1 is an n-channel transistor, and the driving transistor Tr2 is a p-channel transistor. However, polarities of the transistors are not limited thereto. The polarity of each of the control transistor Tr1 and the driving transistor Tr2 may be determined as needed.

The first pixel 31A includes, for example, a first sub-pixel 32R, a second sub-pixel 32G, a third sub-pixel 32B, and a fourth sub-pixel 32W1. The first sub-pixel 32R displays a first primary color (for example, a red (R) component). The second sub-pixel 32G displays a second primary color (for example, a green (G) component). The third sub-pixel 32B displays a third primary color (for example, a blue (B) component). The fourth sub-pixel 32W1 displays a fourth color (a white (W) component in this embodiment) as an additional color component different from the first primary color, the second primary color, and the third primary color. As described above, three colors among the colors of the sub-pixels 32 included in the first pixel 31A correspond to red, green, and blue. For example, as illustrated in FIG. 3, the first sub-pixel 32R, the second sub-pixel 32G, the third sub-pixel 32B, and the fourth sub-pixel 32W1 are arranged in two rows and two columns (2×2) in the first pixel 31A. The second pixel 31B includes, for example, a fifth sub-pixel 32M, a sixth sub-pixel 32Y, a seventh sub-pixel 32C, and an eighth sub-pixel 32W2. The fifth sub-pixel 32M displays a first complementary color (for example, a magenta (M) component). The sixth sub-pixel 32Y displays a second complementary color (for example, a yellow (Y) component). The seventh sub-pixel 32C displays a third complementary color (for example, a cyan (C) component). The eighth sub-pixel 32W2 displays the fourth color (the white (W) component in this embodiment) as an additional color component different from the first complementary color, the second complementary color, and the third complementary color. For example, as illustrated in FIG. 4, the fifth sub-pixel 32M, the sixth sub-pixel 32Y, the seventh sub-pixel 32C, and the eighth sub-pixel 32W2 are arranged in two rows and two columns (2×2) in the second pixel 31B. As described above, the number of the sub-pixels 32 included in the first pixel 31A is the same as the number of the sub-pixels 32 included in the second pixel 31B in the embodiment. In the embodiment, the colors of the sub-pixels 32 included in one of the first pixel 31A and the second pixel 31B (for example, the second pixel 31B) are the complementary colors of the colors of the sub-pixels 32 included in the other pixel (first pixel 31A). The relation described above is merely an example of a relation between the first pixel 31A and the second pixel 31B. The relation is not limited thereto and can be appropriately modified. For example, the number of the sub-pixels 32 included in the first pixel 31A may be different from the number of the sub-pixels 32 included in the second pixel 31B. The colors of the sub-pixels 32 included in the first pixel 31A may be the complementary colors of the colors of the sub-pixels 32 included in the second pixel 31B. When it is not necessary to distinguish the first sub-pixel 32R, the second sub-pixel 32G, the third sub-pixel 32B, the fourth sub-pixel 32W1, the fifth sub-pixel 32M, the sixth sub-pixel 32Y, the seventh sub-pixel 32C, and the eighth sub-pixel 32W2 from each other, they are collectively referred to as the sub-pixels 32.

As illustrated in FIG. 5, the image display unit 30 includes a substrate 51, insulating layers 52 and 53, a reflective layer 54, a lower electrode 55, a self-luminous layer 56, an upper electrode 57, an insulating layer 58, an insulating layer 59, a color filter 61 serving as a color conversion layer, a black matrix 62 serving as a light shielding layer, and a substrate 50. Examples of the substrate 51 include, but are not limited to, a semiconductor substrate made of silicon and the like, a glass substrate, and a resin substrate. The substrate 51 forms or holds the lighting drive circuit and the like described above. The insulating layer 52 is a protective film that protects the lighting drive circuit and the like described above, and may be made of silicon oxide, silicon nitride, and the like. The lower electrode 55 is provided to each of the first sub-pixel 32R, the second sub-pixel 32G, the third sub-pixel 32B, the fourth sub-pixel 32W1, the fifth sub-pixel 32M, the sixth sub-pixel 32Y, the seventh sub-pixel 32C, and the eighth sub-pixel 32W2, and is an electric conductor serving as the anode (positive pole) of the organic light-emitting diode described above. The lower electrode 55 is a translucent electrode made of a translucent conductive material (translucent conductive oxide) such as indium tin oxide (ITO). The insulating layer 53 is called a bank, and partitions the first sub-pixel 32R, the second sub-pixel 32G, the third sub-pixel 32B, the fourth sub-pixel 32W1, the fifth sub-pixel 32M, the sixth sub-pixel 32Y, the seventh sub-pixel 32C, and the eighth sub-pixel 32W2. The reflective layer 54 is made of a material having metallic luster that reflects light from the self-luminous layer 56, for example, made of silver, aluminum, and gold. The self-luminous layer 56 includes an organic material, and includes a hole injection layer, a hole transport layer, a light-emitting layer, an electron transport layer, and an electron injection layer, which are not illustrated.

As a layer that generates a positive hole, for example, preferably used is a layer including an aromatic amine compound and a substance that exhibits an electron accepting property for the compound. In this case, the aromatic amine compound is a substance having an arylamine skeleton. Among aromatic amine compounds, especially preferred is a compound that contains triphenylamine in the skeleton thereof and has a molecular weight of 400 or more. Among the aromatic amine compounds containing triphenylamine in the skeleton thereof, especially preferred is a compound containing a condensed aromatic ring such as a naphthyl group in the skeleton thereof. Heat resistance of a light-emitting element is improved by using the aromatic amine compound containing triphenylamine and a condensed aromatic ring in the skeleton thereof. Specific examples of the aromatic amine compound include, but are not limited to, 4,4'-bis[N-(1-naphthyl)-N-phenylamino]biphenyl (abbreviated as α-NPD), 4,4'-bis[N-(3-methylphenyl)-N-phenylamino]biphenyl (abbreviated as TPD), 4,4',4"-tris(N,N-diphenylamino)triphenylamine (abbreviated as TDATA), 4,4',4"-tris[N-(3-methylphenyl)-N-phenylamino]triphenylamine (abbreviated as MTDATA), 4,4'-bis[N-{4-(N,N-di-m-tolylamino)phenyl}-N-phenylamino]biphenyl (abbreviated as DNTPD), 1,3,5-tris[N,N-di(m-tolyl)amino]benzene (abbreviated as m-MTDAB), 4,4',4"-tris(N-carbazolyl)triphenylamine (abbreviated as TCTA), 2,3-bis(4-diphenylaminophenyl)quinoxaline (abbreviated as TPAQn), 2,2',3,3'-tetrakis(4-diphenylaminophenyl)-6,6'-bisquinoxaline (abbreviated as D-TriPhAQn), and 2,3-bis{4-[N-(1-naphthyl)-N-phenylamino]phenyl}-dibenzo[f,h]quinoxaline (abbreviated as NPADiBzQn). The substance that exhibits the electron accepting property for the aromatic amine compound is not specifically limited. Examples of the substance include, but are not limited to, molybdenum oxide, vanadium oxide, 7,7,8,8-tetracyanoquinodimethane (abbreviated as TCNQ), and 2,3,5,6-tetrafluoro-7,7,8,8-tetracyano-quinodimethane (abbreviated as F4-TCNQ).

An electron transport substance is not specifically limited. Examples of the electron transport substance include, but are not limited to, a metal complex such as tris(8-quinolinolato) aluminum (abbreviated as Alq3), tris(4-methyl-8-quinolinolato)aluminum (abbreviated as Almq3), bis(10-hydroxybenzo[h]-quinolinolato)beryllium (abbreviated as BeBq2), bis(2-methyl-8-quinolinolato)-4-phenylphenolate-aluminum (abbreviated as BAlq), bis[2-(2-hydroxyphenyl)benzoxazolato]zinc (abbreviated as Zn(BOX)2), and bis[2-(2-hydroxyphenyl)benzothiazolato]zinc (abbreviated as Zn(BTZ)2). Examples of the electron transport substance also include, but are not limited to, 2-(4-biphenylyl)-5-(4-tert-butylphenyl)-1,3,4-oxadiazole (abbreviated as PBD), 1,3-bis[5-(p-tert-butylphenyl)-1,3,4-oxadiazol-2-yl]benzene (abbreviated as OXD-7), 3-(4-tert-butylphenyl)-4-phenyl-5-(4-biphenylyl)-1,2,4-triazole (abbreviated as TAZ), 3-(4-tert-butylphenyl)-4-(4-ethylphenyl)-5-(4-biphenylyl)-1,2,4-triazole (abbreviated as p-EtTAZ), bathophenanthroline (abbreviated as BPhen), and bathocuproine (abbreviated as BCP). A substance that exhibits an electron donating property for the electron transport substance is not specifically limited. Examples of the substance include, but are not limited to, an alkali metal such as lithium and cesium, an alkaline-earth metal such as magnesium and calcium, and a rare earth metal such as erbium and ytterbium. A substance selected from an alkali metal oxide and an alkaline-earth metal oxide such as lithium oxide ($Li_2O$), calcium oxide (CaO), sodium oxide ($Na_2O$), potassium oxide ($K_2O$), and magnesium oxide (MgO) may be used as the substance that exhibits the electron donating property for the electron transport substance.

To obtain red-based light emission, a substance exhibiting light emission that has a peak of emission spectrum in a range from 600 nm to 680 nm may be used. Examples of the substance exhibiting the red-based light emission include, but are not limited to, 4-dicyanomethylene-2-isopropyl-6-[2-(1,1,7,7-tetramethyljulolidine-9-yl)ethenyl]-4H-pyran (abbreviated as DCJTI), 4-dicyanomethylene-2-methyl-6-[2-(1,1,7,7-tetramethyljulolidine-9-yl)ethenyl]-4H-pyran (abbreviated as DCJT), 4-dicyanomethylene-2-tert-butyl-6-[2-(1,1,7,7-tetramethyljulolidine-9-yl)ethenyl]-4H-pyran (abbreviated as DCJTB), periflanthene, and 2,5-dicyano-1,4-bis[2-(10-methoxy-1,1,7,7-tetramethyljulolidine-9-yl) ethenyl]benzene. To obtain green-based light emission, a substance exhibiting light emission that has a peak of emission spectrum in a range from 500 nm to 550 nm may be used. Examples of the substance exhibiting the green-based light emission include, but are not limited to, N,N'-dimethylquinacridone (abbreviated as DMQd), coumarin 6, coumarin 545T, and tris(8-quinolinolato)aluminum (abbreviated as Alq3). To obtain blue-based light emission, a substance exhibiting light emission that has a peak of emission spectrum in a range from 420 nm to 500 nm may be used. The substance exhibiting the blue-based light emission include, but are not limited to, 9,10-bis(2-naphthyl)-tert-butylanthracene (abbreviated as t-BuDNA), 9,9'-bianthryl, 9,10-diphenylanthracene (abbreviated as DPA), 9,10-bis(2-naphthyl)anthracene (abbreviated as DNA), bis(2-methyl-8-quinolinolato)-4-phenylphenolate-gallium (abbreviated as BGaq), and bis(2-methyl-8-quinolinolato)-4-phenylphenolate-aluminum (abbreviated as BAlq). In addition to the substance that generates fluorescence as described above, a substance that generates phosphorescence can also be used as a light-emitting substance. Examples of the substance that generates phosphorescence include, but are not limited to, bis[2-(3,5-bis(trifluoromethyl)phenyl)pyridinato-N,C2']iridium(III)picolinate (abbreviated as Ir(CF3ppy)2(pic)), bis[2-(4,6-difluorophenyl)pyridinato-N,C2']iridium(III)acetylacetonate (abbreviated as FIr(acac)), bis[2-(4,6-difluorophenyl)pyridinato-N,C2']iridium(III)picolinate (abbreviated as FIr(pic)), and tris(2-phenylpyridinato-N,C2')iridium (abbreviated as Ir(ppy)3).

The upper electrode 57 is a translucent electrode made of a translucent conductive material (translucent conductive oxide) such as indium tin oxide (ITO). In the embodiment, ITO is exemplified as the translucent conductive material, but the translucent conductive material is not limited thereto. As the translucent conductive material, a conductive material having another composition such as indium zinc oxide (IZO) may be used. The upper electrode 57 serves as the cathode (negative pole) of the organic light-emitting diode. The insulating layer 58 is a sealing layer that seals the upper electrode 57 described above. As the insulating layer 58, silicon oxide, silicon nitride, and the like may be used. The insulating layer 59 is a planarization layer that prevents a level difference from being generated due to the bank. As the insulating layer 59, silicon oxide, silicon nitride, and the like may be used. The substrate 50 is a translucent substrate that protects the entire image display unit 30. For example, a glass substrate may be used as the substrate 50. In the example of FIG. 5, the lower electrode 55 serves as the anode (positive pole) and the upper electrode 57 serves as the cathode (negative pole). However, the embodiment is not limited thereto. The lower electrode 55 may serve as the cathode and the upper electrode 57 may serve as the anode. In this case, the polarity of the driving transistor Tr2 electrically coupled to the lower electrode 55 can be appropriately changed, and a stacking order of a carrier injection layer (the hole injection layer and the electron injection layer), a carrier transport layer (the hole transport layer and the electron transport layer), and the light-emitting layer can also be appropriately changed.

The image display unit 30 is a color display panel and includes the color filter 61, arranged between the sub-pixels 32 and an image observer, to transmit light of colors corresponding to the colors of the sub-pixels 32 among light-emitting components of the self-luminous layer 56. The image display unit 30 can emit light of colors corresponding to red (R), green (G), blue (B), cyan (C), magenta (M), yellow (Y), and white (W). The color filter 61 is not necessarily arranged between the image observer and the fourth sub-pixel 32W1 and the eighth sub-pixel 32W2 corresponding to white (W). In the image display unit 30, the light-emitting component of the self-luminous layer 56 can emit each color of the first sub-pixel 32R, the second sub-pixel 32G, the third sub-pixel 32B, the fourth sub-pixel 32W1, the fifth sub-pixel 32M, the sixth sub-pixel 32Y, the seventh sub-pixel 32C, and the eighth sub-pixel 32W2 without using the color conversion layer such as the color filter 61. For example, in the image display unit 30, a transparent resin layer may be provided to the fourth sub-pixel 32W1 in place of the color filter 61 for color adjustment. In this way, the image display unit 30 can prevent a large level difference from being generated in the fourth sub-pixel 32W1 by providing the transparent resin layer.

Figure 6:
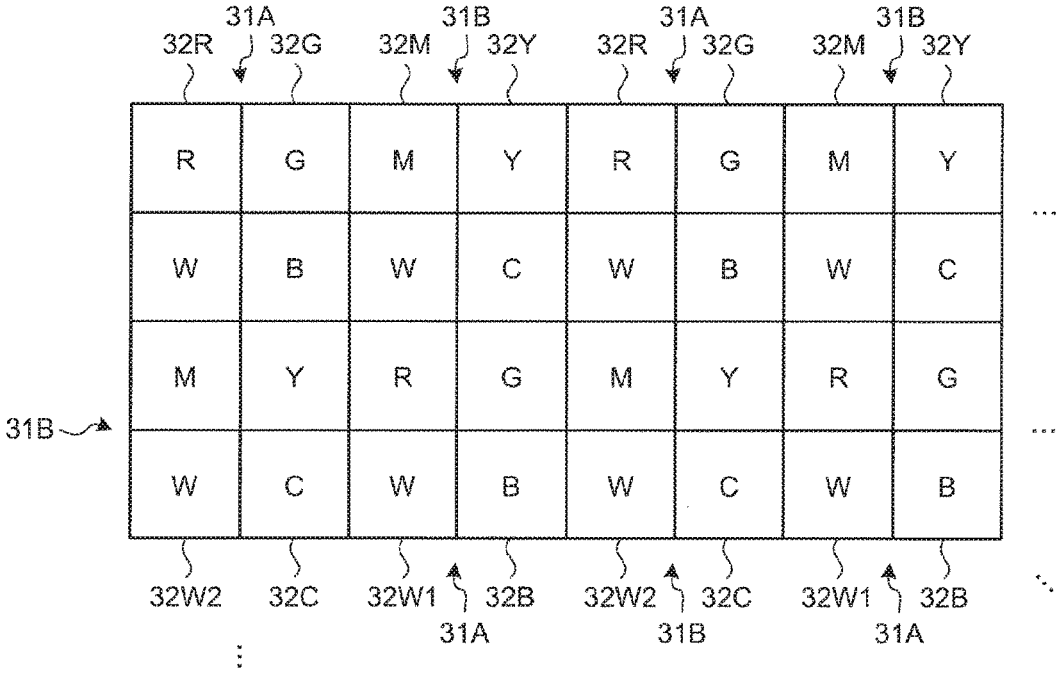
FIG. 6 is a diagram illustrating an example of a positional relation between the first pixel and the second pixel and an arrangement of sub-pixels included in each of the first pixel and the second pixel.

Next, the following describes a specific arrangement example of the pixels 31 and the sub-pixels 32 with reference to FIGS. 6 to 12. In the image display unit 30, the pixels 31 are arranged in a matrix. Specifically, as illustrated in FIG. 6, the first pixel 31A is adjacent to the second pixel 31B in the image display unit 30. More specifically, in the image display unit 30, the second pixels 31B are arranged in a staggered manner. Accordingly, the first pixels 31A adjacent to the second pixels 31B are also arranged in a staggered manner. The "staggered manner" herein means that, in a matrix arrangement in which partitions (outlines) between the pixels 31 draw a grid pattern in the display area, the pixels 31 are alternately arranged in the row direction and the column direction (or a vertical direction and a horizontal direction), which corresponds to what is called a checkered pattern (check pattern).

As described above, the image display device 100 includes the image display unit 30 in which the first pixel 31A constituted of the sub-pixels 32 of three or more colors included in the first color gamut and the second pixel 31B constituted of the sub-pixels 32 of three or more colors included in the second color gamut different from the first color gamut are arranged in a matrix, the first pixel 31A being adjacent to the second pixel 31B. In the embodiment, "adjacent to" means that the first pixel 31A is adjacent to the second pixel 31B in a direction along at least one of the row direction (horizontal direction) and the column direction (vertical direction) of the image display unit 30, and does not include a case in which the pixels 31 are arranged in a oblique direction tilted with respect to the row direction and the column direction.

FIG. 6 is a diagram illustrating an example of a positional relation between the first pixel 31A and the second pixel 31B and an arrangement of the sub-pixels 32 included in each of the first pixel 31A and the second pixel 31B. The arrangement of the sub-pixels 32 in the first pixel 31A and the arrangement of the sub-pixels 32 in the second pixel 31B may be made to have a certain correspondence relation. Specifically, the sub-pixels 32 in the first pixel 31A and the sub-pixels 32 in the second pixel 31B may be arranged so that arrangements of hues in the respective pixels 31 further approximate to each other when the hue of the sub-pixels 32 included in the first pixel 31A is compared with the hue of the sub-pixels 32 included in the second pixel 31B. More specifically, as illustrated in FIG. 6, in a case in which the sub-pixels 32 are arranged in two rows and two columns (2×2) in the first pixel 31A and the second pixel 31B, and the sub-pixels 32 in the first pixel 31A are the first sub-pixel 32R, the second sub-pixel 32G, the third sub-pixel 32B, and the fourth sub-pixel 32W1 in the order of the upper left, the upper right, the lower right, and the lower left, the sub-pixels 32 in the second pixel 31B may be the fifth sub-pixel 32M, the sixth sub-pixel 32Y, the seventh sub-pixel 32C, and the eighth sub-pixel 32W2 in the order of the upper left, the upper right, the lower right, and the lower left. In this case, when the first pixel 31A and the second pixel 31B are assumed to be hue circles, rotation directions of the hues are the same.

Figure 7:
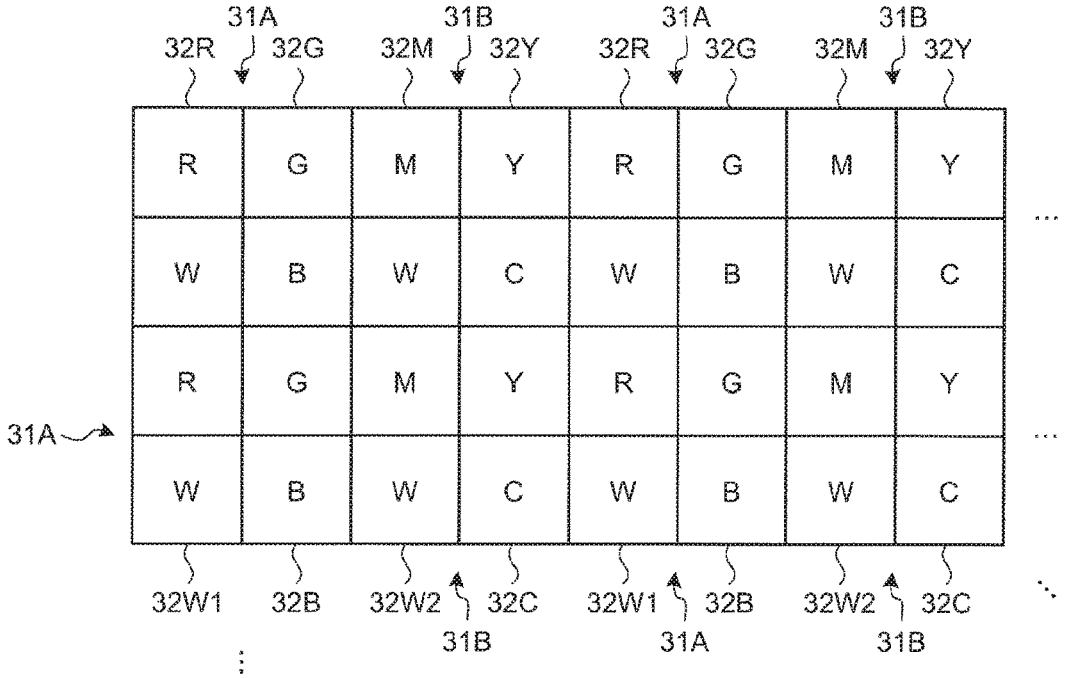
FIG. 7 is a diagram illustrating another example of the positional relation between the first pixel and the second pixel and the arrangement of the sub-pixels included in each of the first pixel and the second pixel.
Figure 8:
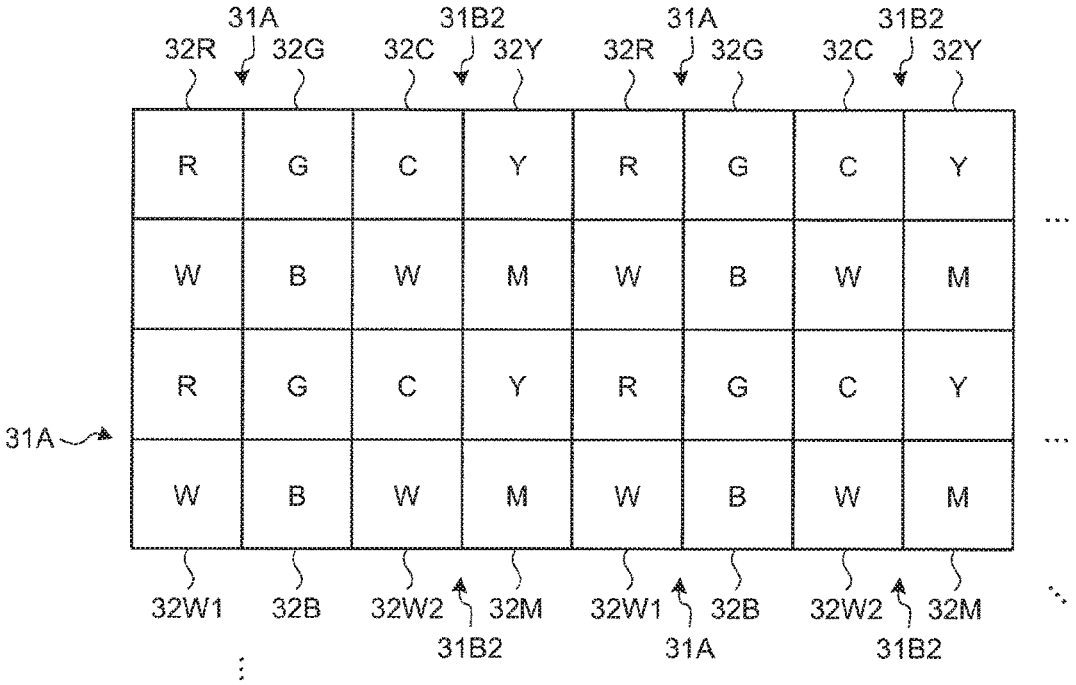
FIG. 8 is a diagram illustrating yet another example of the positional relation between the first pixel and the second pixel and the arrangement of the sub-pixels included in each of the first pixel and the second pixel.

As illustrated in FIG. 6, in principle, the following describes a case in which the second pixels 31B are arranged in a staggered manner and a relation between the arrangement of the sub-pixels 32 included in the first pixel 31A and the arrangement of the sub-pixels 32 included in the second pixel 31B corresponds to the color component. However, the present invention is not limited thereto. FIGS. 7 and 8 are diagrams illustrating another example of the positional relation between the first pixel 31A and the second pixel 31B (or a second pixel 31B2) and the arrangement of the sub-pixels 32 included in each of the first pixel 31A and the second pixels 31B (or the second pixel 31B2). For example, as illustrated in FIGS. 7 and 8, a column of the first pixels 31A and a column of the second pixels 31B arranged along one direction (for example, the column direction) may be adjacent to each other in the other direction (for example, the row direction). As illustrated in FIG. 8, the arrangement of the sub-pixels 32 in the first pixel 31A and the second pixel 31B2 may be determined so that luminance distribution of the first pixel 31A due to the arrangement of the sub-pixels 32 in the first pixel 31A further approximates to luminance distribution of the second pixel 31B2 due to the arrangement of the sub-pixels 32 in the second pixel 31B2. In this case, in the arrangement of the sub-pixels 32 in the first pixel 31A and the arrangement of the sub-pixels 32 in the second pixel 31B2, a relation of luminance intensity between the sub-pixels 32 in the respective pixels 31 are the same. The luminance distribution in this case is provided, for example, when all the sub-pixels 32 emit a predetermined maximum amount of light (for example, 100%). The second pixels 31B2 as illustrated in FIG. 8 may be arranged in a staggered manner. The arrangement of the sub-pixels 32 in each of the first pixel 31A and the second pixel 31B is not limited thereto, and can be appropriately modified.

As illustrated in FIG. 3, FIG. 4, and FIGS. 6 to 8, the arrangement of the white sub-pixel in the first pixel 31A is the same as the arrangement of the white sub-pixel in the second pixel 31B. Specifically, for example, the fourth sub-pixel 32W1 and the eighth sub-pixel 32W2 are both arranged at the lower left of the pixel 31. The white sub-pixel is not necessarily arranged at the lower left, and may be arranged at an arbitrary position in the pixel 31.

The output signal is individually output to the first pixel 31A and the second pixel 31B corresponding to the arrangement of the first pixel 31A and the second pixel 31B. Specifically, the output signal indicating a light emitting state of the first sub-pixel 32R, the second sub-pixel 32G, the third sub-pixel 32B, and the fourth sub-pixel 32W1 that emit light of red (R), green (G), blue (B), and white (W) is output to a position corresponding to the first pixel 31A, and the output signal indicating the light emitting state of the fifth sub-pixel 32M, the sixth sub-pixel 32Y, the seventh sub-pixel 32C, and the eighth sub-pixel 32W2 that emit light of magenta (M), yellow (Y), cyan (C), and white (W) is output to a position corresponding to the second pixel 31B.

Subsequently, the following describes a group of the first pixel 31A and the second pixel 31B. In the embodiment, the signal processing unit 21 handles one first pixel 31A and one second pixel 31B as a group of pixels 35, and processes the input image signal for each group excluding exception processing. That is, the signal processing unit 21 performs processing so that the input image signal corresponding to the two pixels 31 included in the group of pixels 35 is output and displayed with color extension by combining an output of the sub-pixels 32 included in the first pixel 31A included in the group of pixels 35 and an output of the sub-pixels 32 included in the second pixel 31B included in the group of pixels 35.

Figure 9:
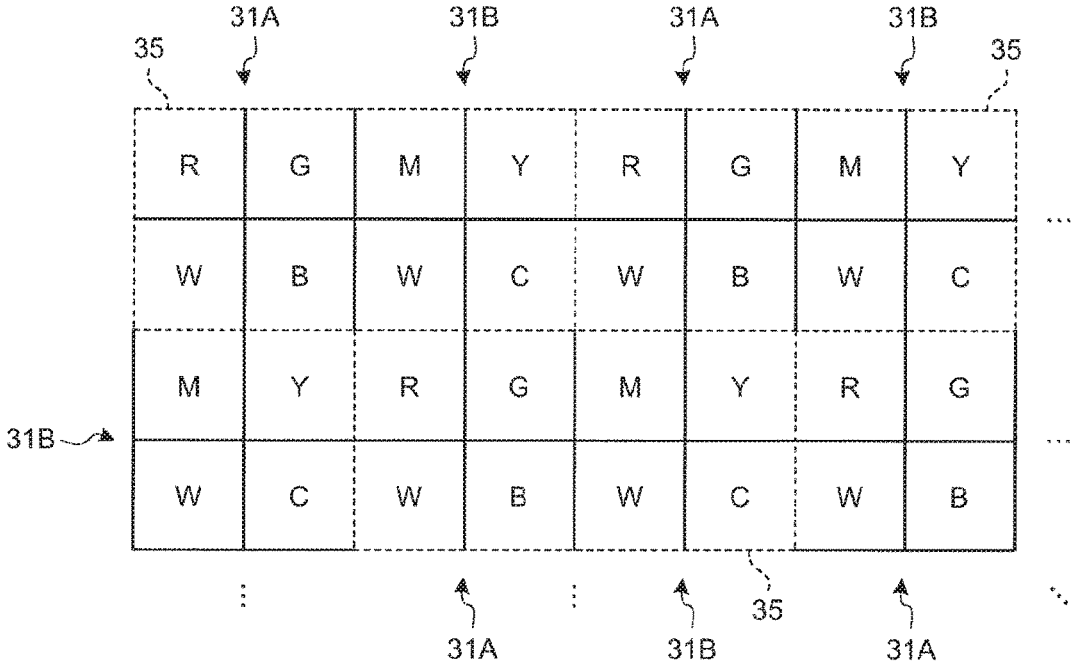
FIG. 9 is a diagram illustrating an example of an arrangement of a group of pixels and pixels to be a group.

FIG. 9 is a diagram illustrating an example of the arrangement of the group of pixels and the pixels to be the group. Specifically, as indicated by the dashed lines in FIG. 9, for example, the signal processing unit 21 handles one first pixel 31A and one second pixel 31B that is on the right side of the first pixel 31A as the group of pixels 35. With the second pixel 31B as a reference, the second pixel 31B is grouped with the first pixel 31A adjacent thereto on the left side. In this case, as illustrated in FIG. 9, respective groups of pixels are alternately arranged (in a header bond pattern).

Figure 10:
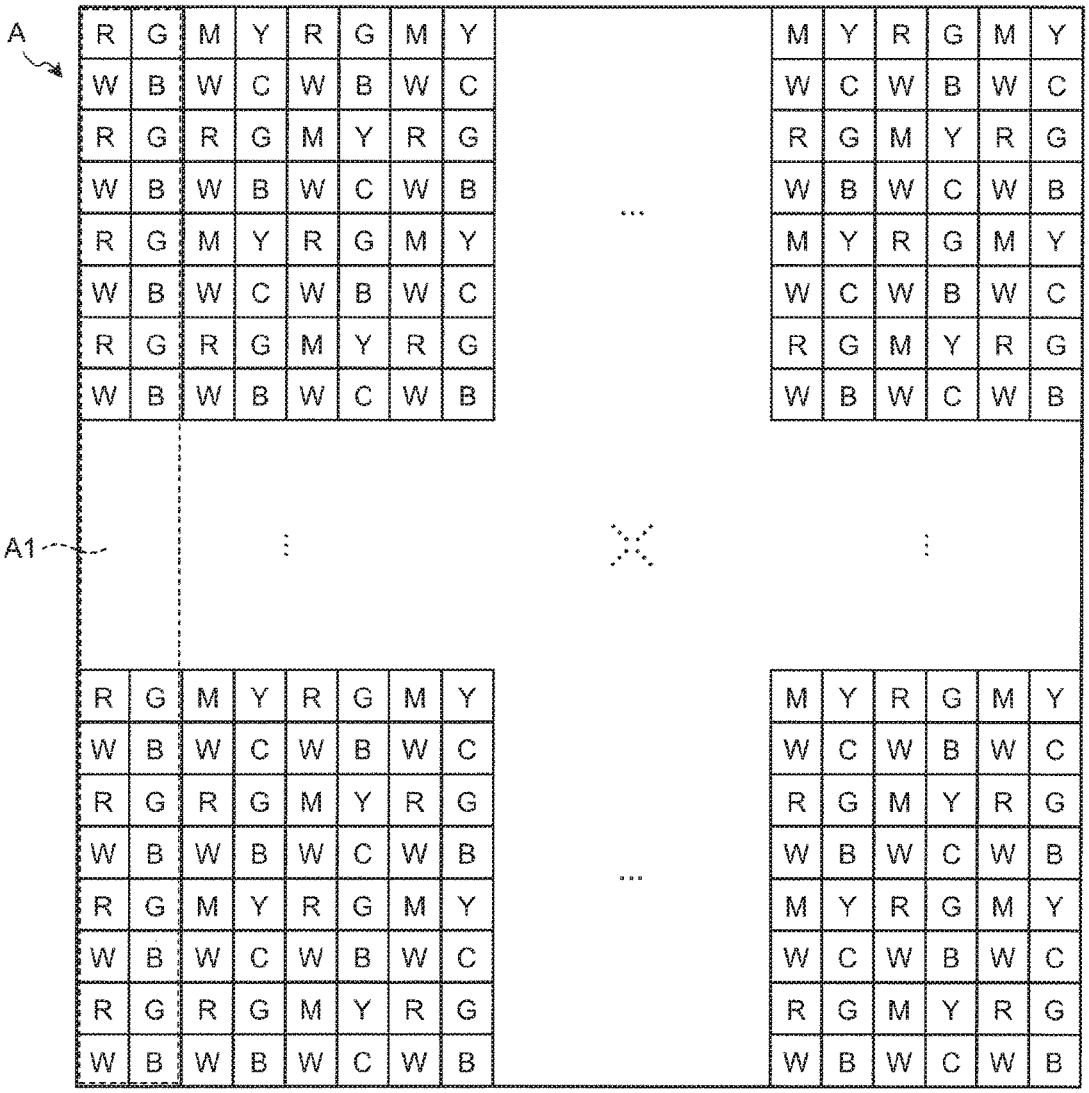
FIG. 10 is a diagram illustrating an example of a display area in which pixels adjacent to one side are first pixels.

A pixel adjacent to at least one side of the display area A may be the first pixel 31A. FIG. 10 is a diagram illustrating an example of the display area A in which the pixels adjacent to one side are the first pixels 31A. Specifically, as represented as a region A1 adjacent to the side in FIG. 10, for example, all the pixels constituting a pixel column adjacent to one side corresponding to an outer edge of the display area A may be the first pixels 31A. In this case, the first pixel 31A adjacent to the second pixel 31B on the right side among the first pixels 31A constituting the pixel column is grouped with the second pixel 31B. On the other hand, the first pixel 31A adjacent to the other first pixel 31A on the right side among the first pixels 31A constituting the pixel column is not adjacent to any second pixel 31B in the row direction and the column direction, so that the first pixel 31A is grouped with nothing. Each of the first pixels 31A independently performs output (for example, light emission) corresponding to each input image signal.

Figure 11:
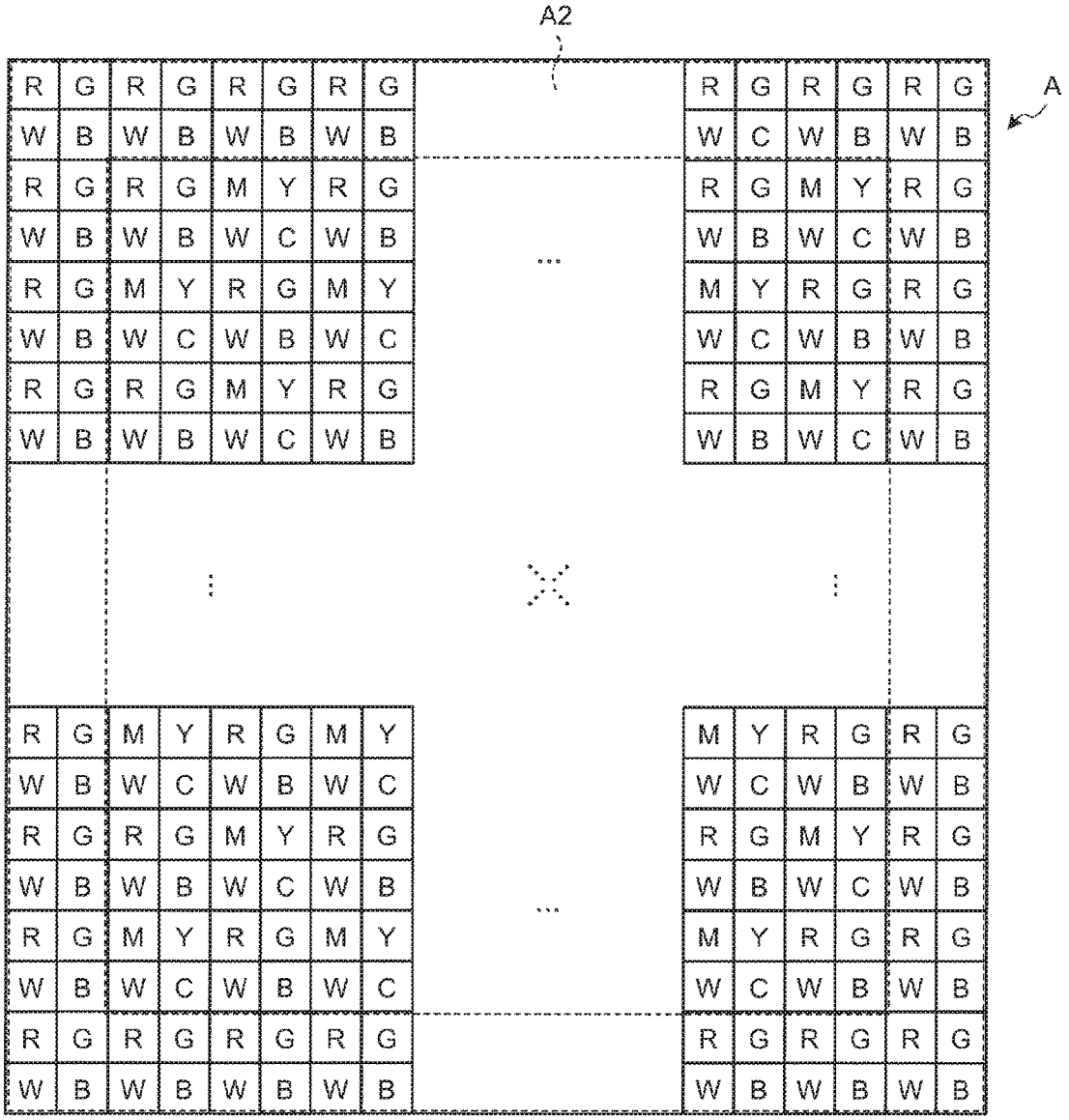
FIG. 11 is a diagram illustrating an example of a display area in which pixels adjacent to four sides are the first pixels.

The pixels adjacent to two or more sides of the display area A may be the first pixels 31A. FIG. 11 is a diagram illustrating an example of the display area A in which the pixels adjacent to four sides are the first pixels 31A. Specifically, as represented as a region A2 adjacent to the side in FIG. 11, for example, the pixels adjacent to all the sides of the rectangular display area A may be the first pixels 31A. In this case, in the image display device 100 or an electronic apparatus including a detection unit such as an acceleration sensor and a rotation control unit that controls a rotation state of a screen according to the detection unit, the second pixel 31B that is adjacent to the region A2 adjacent to the side can always be adjacent to the first pixel 31A. More specifically, under a condition that the group of pixels 35 is set along any one of the horizontal direction and the vertical direction, when all the pixels in the region A2 adjacent to the side corresponding to the four sides are the first pixels 31A, all the second pixels 31B including the second pixels 31B that are adjacent to the region A2 adjacent to the side can make a group under the condition irrespective of the rotation state. In this case, the detection unit detects an inclination of the image display device 100 by measuring gravity acceleration with respect to gravity larger than that of the earth and the like, for example. The rotation control unit determines the top, the bottom, the left, and the right of the display area A corresponding to a detection result of the detection unit, and causes the signal processing unit 21 or the drive circuit 40 to perform output corresponding to the determined top, bottom, left, and right. In FIG. 11, the pixels adjacent to the four sides are the first pixels 31A. Alternatively, only the pixels adjacent to two sides or three sides thereamong may be the first pixels 31A. When the image display device 100 has a polygonal shape other than a quadrangle, the pixels adjacent to part or all of the sides thereof may be the first pixels 31A.

Figure 12:
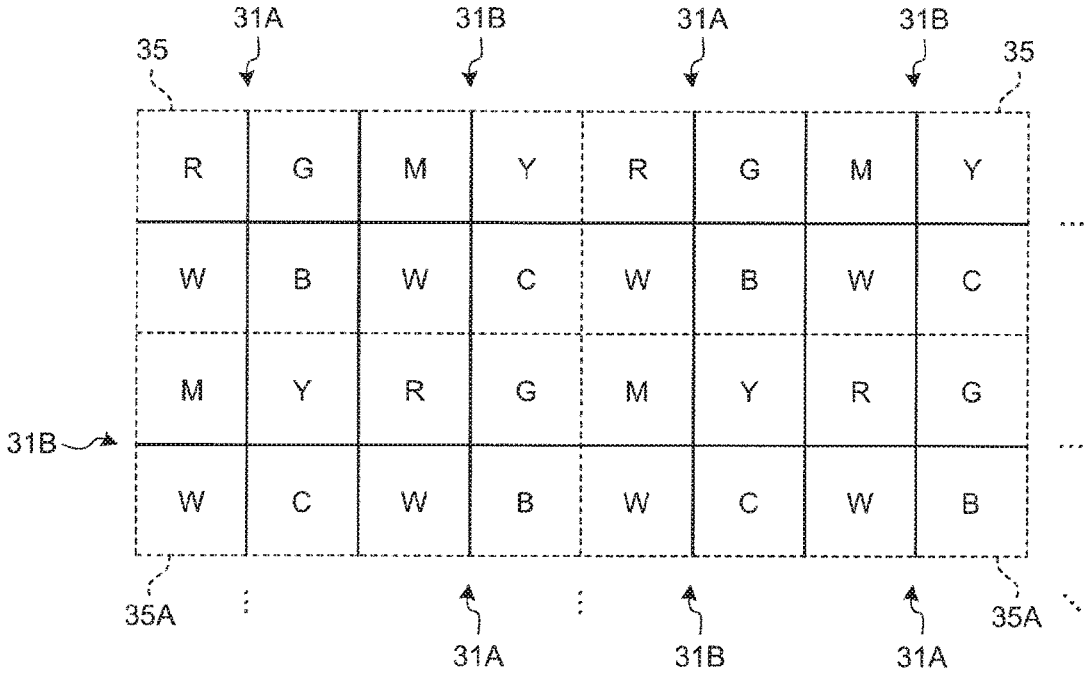
FIG. 12 is a diagram illustrating another example of the arrangement of a group of pixels and pixels to be a group.

In the following description, in principle, one first pixel 31A and one second pixel 31B that is on the right side of the first pixel 31A are handled as a group. However, the present invention is not limited thereto. The first pixel 31A and the second pixel 31B adjacent to each other in any direction may be grouped. FIG. 12 is a diagram illustrating another example of the arrangement of the group of pixels and the pixels to be a group. For example, as illustrated in FIG. 12, a left and right relation between the first pixel 31A and the second pixel 31B to be grouped may be replaced for each row. FIG. 12 illustrates an example in which a group of one first pixel 31A and one second pixel 31B that is on the left of the first pixel 31A is assumed to be a group of pixels 35A, the group of pixels 35 is arranged in one of the two pixel rows (an upper pixel row), and the group of pixels 35A is arranged in the other pixel row (a lower pixel row). The upper and lower relation between the rows of the group of pixels 35 and the group of pixels 35A is merely an example and not limited thereto. The upper and lower relation can be reversed. Although not illustrated in FIG. 12, in a case of three or more pixel rows, the group of pixels 35 and the group of pixels 35A are arranged to be replaced for each row. In an arrangement in which the first pixel 31A is adjacent to the second pixel 31B in the vertical direction, one first pixel 31A and one second pixel 31B adjacent to each other in the vertical direction may be caused to be the group of pixels. By setting the group along any of the vertical direction and the horizontal direction that is orthogonal to a direction in which higher resolution is required, the resolution in the direction orthogonal to the direction in which the group is set can be easily maintained at a higher level.

Next, the following describes processing performed by the image processing circuit 20 with reference to FIGS. 13 to 58. The signal processing unit 21 uses part of the components of the input image signal corresponding to one of the first pixel 31A and the second pixel 31B that are adjacent to each other to determine an output of the sub-pixels 32 included in the other pixel. Specifically, for example, the signal processing unit 21 determines the output of the sub-pixels 32 included in the first pixel 31A based on a combined component of a first component that includes components of the input image signal corresponding to the first pixel 31A and an out-of-color gamut component that is a component of the input image signal corresponding to the adjacent second pixel 31B the color of which cannot be extended with the sub-pixels 32 included in the second pixel 31B, and determines the output of the sub-pixels 32 included in the second pixel 31B based on a third component obtained by eliminating the out-of-color gamut component from a second component that includes components of the input image signal corresponding to the second pixel 31B. The "output of the sub-pixels 32" includes intensity of light when there is an output of light regardless of whether there is an output of light from the sub-pixels 32. That is, "determine the output of the sub-pixels 32" means to determine the light intensity from each sub-pixel 32. Additionally, "cause the component to be reflected in the output of the sub-pixels 32" means to reflect an increase or a decrease in the light intensity corresponding to the component in the intensity of light in the output of light from the sub-pixels 32.

In the embodiment, the input image signal corresponding to the RGB color space is used. The following describes a case in which each gradation of the red (R) component, the green (G) component, and the blue (B) component is 8 bits (256 gradations) in the input image signal, that is, a case in which the input image signal is configured in a range of (R,G,B)=(0,0,0) to (255,255,255). As described above, in the embodiment, the components of the input image signal correspond to three colors of sub-pixels 32 included in the first pixel 31A. Such an input image signal is merely an example of the components of the input image signal according to the present invention, and is not limited thereto. The input image signal can be appropriately modified. Specific numerical values of the input image signal described below are merely an example, and not limited thereto. Alternatively, any numerical value can be used.

Figure 13:
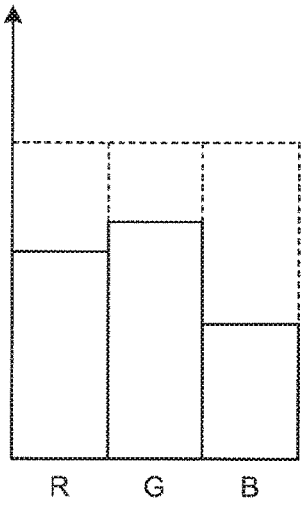
FIG. 13 is a diagram illustrating an example of components of an input image signal.

FIG. 13 is a diagram illustrating an example of the components of the input image signal. In the description with reference to FIGS. 13 to 20, described is a case in which both of the input image signal corresponding to the first pixel 31A included in the group of pixels 35 and the input image signal corresponding to the second pixel 31B included in the group of pixels 35 are input image signals showing the components of red (R), green (G), and blue (B) as illustrated in FIG. 13. That is, in this case, each of the first component as components of the input image signal corresponding to the first pixel 31A and the second component as components of the input image signal corresponding to the second pixel 31B is a combination of color values of red (R), green (G), and blue (B), and is a component (R,G,B) constituting a color represented by the combination.

Figure 14:
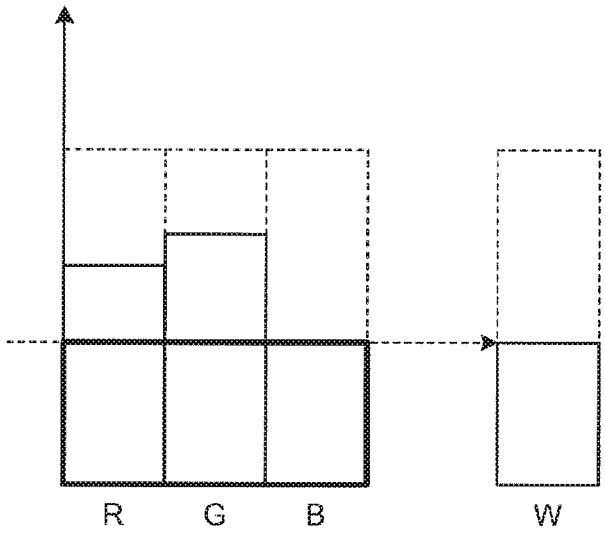
FIG. 14 is a diagram illustrating an example of processing for converting components of red (R), green (G), and blue (B) into a component of white (W)
Figure 15:
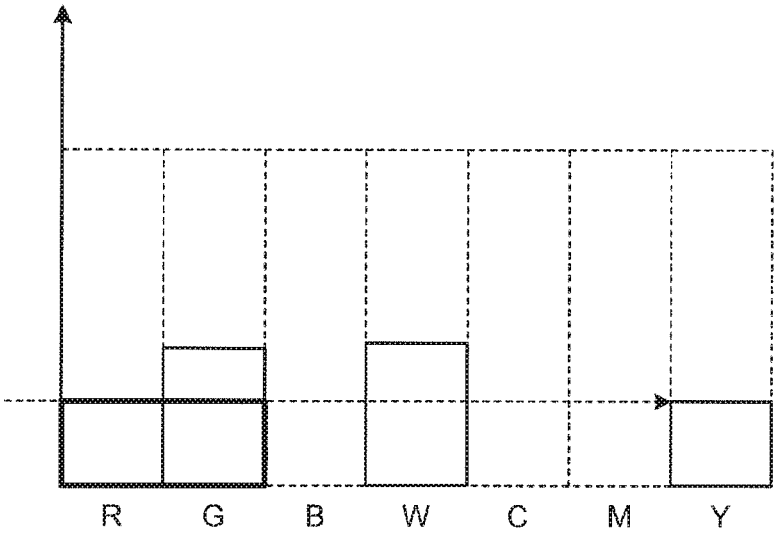
FIG. 15 is a diagram illustrating an example of processing for converting the components of red (R) and green (G) into a component of yellow (Y)
Figure 16:
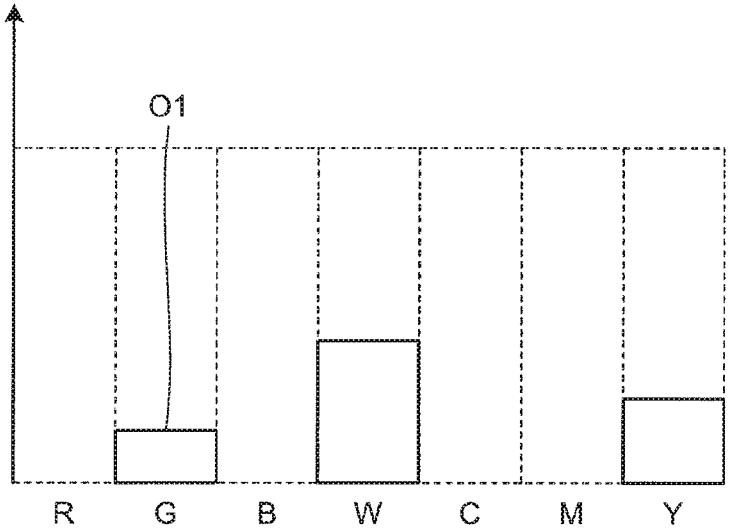
FIG. 16 is a diagram illustrating an example of components corresponding to an output of the second pixel and an out-of-color gamut component according to the embodiment.

First, the following describes processing related to determination of the output of the sub-pixels 32 included in the second pixel 31B. FIG. 14 is a diagram illustrating an example of processing for converting the components of red (R), green (G), and blue (B) into a component of white (W). FIG. 15 is a diagram illustrating an example of processing for converting the components of red (R) and green (G) into a component of yellow (Y). FIG. 16 is a diagram illustrating an example of the components corresponding to the output of the second pixel 31B and the out-of-color gamut component according to the embodiment. The signal processing unit 21 performs processing for converting the component that can be extended with the colors of the sub-pixels 32 included in the second pixel 31B among the components of the input image signal corresponding to the second pixel 31B into the colors of the sub-pixels 32 included in the second pixel 31B. Specifically, as illustrated in FIG. 14 for example, the signal processing unit 21 extracts, from the components of red (R), green (G), and blue (B), an amount of components corresponding to an amount of components the saturation of which is the smallest (in a case of FIG. 14, blue (B)) among the components of red (R), green (G), and blue (B) as the components of the input image signal corresponding to the second pixel 31B, and converts the amount of components extracted into white (W). White (W) is a color of the eighth sub-pixel 32W2. In this way, the signal processing unit 21 performs processing for converting, into white, the components that can be extended with white among the components of the input image signal corresponding to the second pixel 31B. The signal processing unit 21 performs similar processing on the other colors of sub-pixels 32 included in the second pixel 31B. Specifically, as illustrated in FIG. 15 for example, the signal processing unit 21 extracts, from the components of red (R) and green (G), an amount of components corresponding to a smaller amount of components (in a case of FIG. 15, red (R)) among the components of red (R) and green (G) that are not converted into white (W) as the components of the input image signal corresponding to the second pixel 31B, and converts the components into a color corresponding to the combination of the components (in a case of FIG. 15, yellow (Y)). Yellow (Y) is a color of the sixth sub-pixel 32Y. As a result, the components corresponding to the output of the second pixel 31B become the components of cyan (C), magenta (M), yellow (Y), and white (W) illustrated in FIG. 16.

FIG. 15 illustrates an example of converting the components of red (R) and green (G) into yellow (Y), but this is merely an example of conversion processing. The embodiment is not limited thereto. The signal processing unit 21 can convert the component of the input image signal corresponding to the second pixel 31B into the colors of the other sub-pixels 32 included in the second pixel 31B. Specifically, the signal processing unit 21 can convert the components of red (R) and blue (B) into magenta (M). Magenta (M) is a color of the fifth sub-pixel 32M. The signal processing unit 21 can also convert the components of green (G) and blue (B) into cyan (C). Cyan (C) is a color of the seventh sub-pixel 32C.

Figure 17:
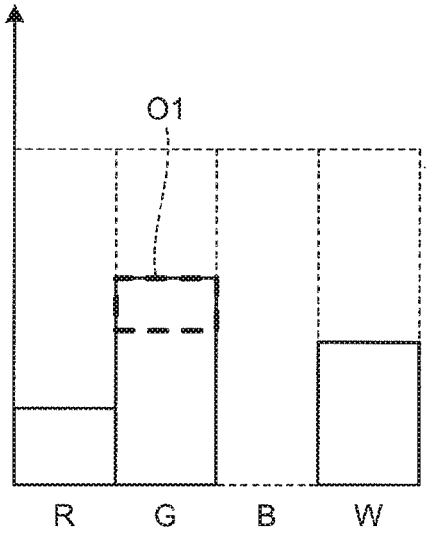
FIG. 17 is a diagram illustrating an example of a component corresponding to an output of the first pixel in which the out-of-color gamut component is added to the components of the input image signal illustrated in FIG. 13.

When the conversion processing illustrated in FIGS. 14 and 15 is performed on the input image signal corresponding to the second pixel 31B, as illustrated in FIG. 16, the component of green (G) that is not used for the conversion into white (W) and yellow (Y) remains from among the components of the input image signal corresponding to the second pixel 31B. In this case, the remaining component of green (G) cannot be extended with cyan (C), magenta (M), yellow (Y), and white (W) as the colors of the sub-pixels 32 included in the second pixel 31B. The remaining component is used, as the out-of-color gamut component, for determining the output of the sub-pixels 32 included in the first pixel 31A. In FIG. 16 and FIG. 17 described later, the out-of-color gamut component is denoted by a reference sign O1. That is, in this case, the third component obtained by eliminating the out-of-color gamut component from the second component as the components of the input image signal corresponding to the second pixel 31B is a combination of color values of red (R), green (G), and blue (B) obtained by eliminating the out-of-color gamut component (the out-of-color gamut component O1 in FIG. 16) from the component (second component) illustrated in FIG. 13, and is the component (R,G,B) constituting the color represented by the combination. The output of the sub-pixels determined with the third component becomes an output corresponding to the components of cyan (C), magenta (M), yellow (Y), and white (W) illustrated in FIG. 16.

Figure 18:
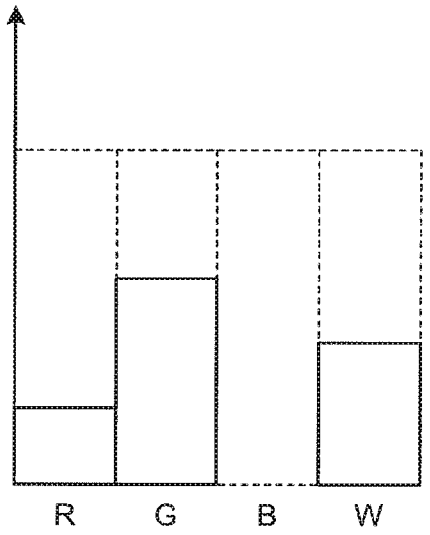
FIG. 18 is a diagram illustrating an example of the components corresponding to the output of the first pixel according to the embodiment.

Next, the following describes processing related to determination of the output of the sub-pixels 32 included in the first pixel 31A. FIG. 17 is a diagram illustrating an example of the components corresponding to the output of the first pixel 31A in which the out-of-color gamut component is added to the components of the input image signal illustrated in FIG. 13. FIG. 18 is a diagram illustrating an example of the components corresponding to the output of the first pixel 31A according to the embodiment. The signal processing unit 21 performs processing for converting the component that can be extended with the colors of the sub-pixels 32 included in the first pixel 31A among the components of the input image signal corresponding to the first pixel 31A into the colors of the sub-pixels 32 included in the first pixel 31A. Specifically, similarly to the second pixel 31B, as illustrated in FIG. 14 for example, the signal processing unit 21 extracts, from the components of red (R), green (G), and blue (B), an amount of components corresponding to an amount of components the saturation of which is the smallest (in the case of FIG. 14, blue (B)) among the components of red (R), green (G), and blue (B) as the components of the input image signal corresponding to the first pixel 31A, and converts the amount of components extracted into white (W). White (W) is a color of the fourth sub-pixel 32W1. In this way, the signal processing unit 21 performs processing for converting, into white, the components that can be extended with white among the components of the input image signal corresponding to the first pixel 31A. The signal processing unit 21 synthesizes the component of the input image signal corresponding to the first pixel 31A and the out-of-color gamut component. Specifically, as illustrated in FIG. 17, for example, the signal processing unit 21 adds the component of green (G) determined to be the out-of-color gamut component in FIG. 16 to the components of the input image signal corresponding to the first pixel 31A. As a result, the components corresponding to the output of the first pixel 31A become the components of red (R), green (G), blue (B), and white (W) illustrated in FIG. 18. That is, in this case, the combined component of the first component and the out-of-color gamut component is a combination of the color values of red (R), green (G), and blue (B) illustrated in FIGS. 17 and 18, and is the component (R,G,B) constituting the color represented by the combination.

In this way, the signal processing unit 21 processes the input image signals for two pixels corresponding to the group of pixels 35 to extend, with the first pixel 31A, the out-of-color gamut component as a component the color of which cannot be extended with the sub-pixels 32 included in the second pixel 31B in the input image signals corresponding to the two pixels. Accordingly, even when there is a component the color of which cannot be extended with the sub-pixels 32 included in one of the group of pixels 35, color extension corresponding to the input image signal can be performed in unit of the group of pixels 35.

As illustrated in the examples of FIGS. 16 and 18, the luminance of each pixel 31 can be secured by lighting the white sub-pixel by determining the outputs of the first pixel 31A and the second pixel 31B so that the white sub-pixel is lit when there is a component that can be converted into white in the components of the input image signal. That is, in terms of securing the luminance, the output of the sub-pixels 32 of the other colors can be further suppressed, so that a power-saving property at a higher level can be achieved.

For example, the signal processing unit 21 may cause the components of red (R), green (G), blue (B), and white (W) illustrated in FIG. 18 to be an output signal indicating the output of the sub-pixels 32 included in the first pixel 31A, and may cause the components of cyan (C), magenta (M), yellow (Y), and white (W) illustrated in FIG. 16 to be an output signal indicating the output of the sub-pixels 32 included in the second pixel 31B to be output to the first pixel 31A and the second pixel 31B. Since the out-of-color gamut component in the input image signal corresponding to the second pixel 31B is shifted to the first pixel 31A, the luminance corresponding to the out-of-color gamut component in the luminance output by the components of the input image signal corresponding to the second pixel 31B is shifted from the second pixel 31B to the first pixel 31A. The signal processing unit 21 may determine the output of the sub-pixels 32 included in the first pixel 31A by subtracting, from the combined component, a luminance adjustment component corresponding to the luminance of the first pixel 31A raised by the out-of-color gamut component in the combined component, and determine the output of the sub-pixels 32 included in the second pixel 31B based on the third component and the luminance adjustment component. In this way, by performing luminance adjustment between the first pixel 31A and the second pixel 31B using the luminance adjustment component, the first pixel 31A can output the luminance corresponding to the input image signal corresponding to the first pixel 31A, and the second pixel 31B can output the luminance corresponding to the input image signal corresponding to the second pixel 31B. That is, color extension corresponding to the input image signal can be performed by the group of pixels 35 without changing the luminance of each pixel 31 included in the group of pixels 35.

Figure 19:
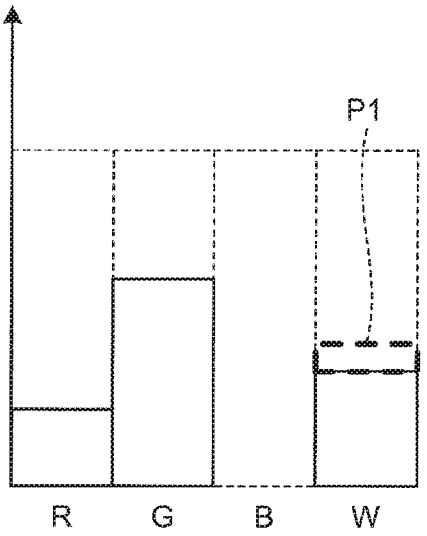
FIG. 19 is a diagram illustrating an example of the components corresponding to the output of the first pixel in which a luminance adjustment component is subtracted from the components illustrated in FIG. 18.
Figure 20:
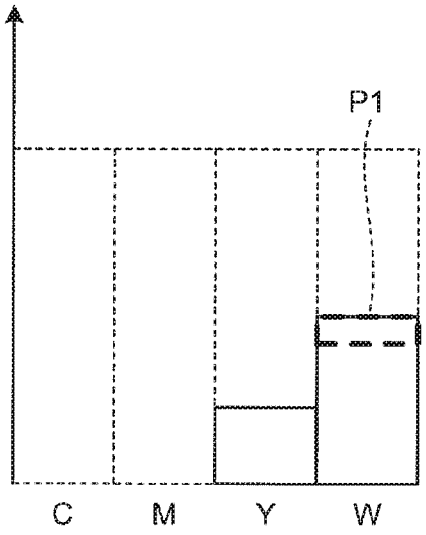
FIG. 20 is a diagram illustrating an example of the components corresponding to the output of the second pixel in which the luminance adjustment component is added to the output component illustrated in FIG. 16.

The following describes processing related to the luminance adjustment component with reference to FIGS. 19 and 20. FIG. 19 is a diagram illustrating an example of the components corresponding to the output of the first pixel 31A in which the luminance adjustment component is subtracted from the components illustrated in FIG. 18. FIG. 20 is a diagram illustrating an example of the components corresponding to the output of the second pixel 31B in which the luminance adjustment component is added to the output component illustrated in FIG. 16. The signal processing unit 21 first calculates the luminance added to the first pixel 31A by the out-of-color gamut component. Next, the signal processing unit 21 subtracts the component corresponding to the calculated luminance from the components of the first pixel 31A. Specifically, as illustrated in FIG. 19 for example, the signal processing unit 21 subtracts the component that can be extended with the second pixel 31B (in a case of FIG. 19, white (W)) to subtract the component corresponding to the luminance added to the first pixel 31A by the out-of-color gamut component. In the example illustrated in FIG. 19, the subtracted component of white (W) is the luminance adjustment component. In FIGS. 19 and 20, the luminance adjustment component is denoted by a reference sign P1. The signal processing unit 21 adds the luminance adjustment component subtracted from the first pixel 31A to the component of the second pixel 31B. Specifically, as illustrated in FIG. 20 for example, the signal processing unit 21 increases the component of white (W) in the components of the second pixel 31B by an amount of the component of white (W) that is subtracted from the components of the first pixel 31A in FIG. 19. By causing the components after processing illustrated in FIGS. 19 and 20 to be the output signal of the first pixel 31A and the output signal of the second pixel 31B, the luminance of each of the first pixel 31A and the second pixel 31B can be caused to be the luminance corresponding to each input image signal.

The luminance adjustment component is preferably a component of a color that can be extended with the sub-pixels 32 included in the second pixel 31B. When the component of the color that can be extended with the sub-pixels 32 included in the second pixel 31B cannot be extracted from the component corresponding to the output of the first pixel 31A as the luminance adjustment component, it is preferable to use, as the luminance adjustment component, a component of a color closer to the color component that can be extended with the colors of the sub-pixels 32 included in the second pixel 31B. For example, a combination of the components of green (G) and white (W) in the components corresponding to the output of the first pixel 31A can be shifted as a combination of the components of cyan (C) and yellow (Y) included in the second pixel 31B, so that the combination of the components of green (G) and white (W) can be employed as the luminance adjustment component. The signal processing unit 21 may divide the component of white (W) in the components corresponding to the output of the first pixel 31A into the component of green (G) of the first pixel 31A and the component of magenta (M) of the second pixel 31B, and may cause the component of magenta (M) to be the luminance adjustment component. When the component of white (W) is subtracted from the first pixel 31A as the luminance adjustment component, the luminance adjustment component may be reflected in the second pixel 31B separately as cyan (C), magenta (M), and yellow (Y). In this case, the resolution is increased in an image that is output and displayed, which improves an appearance of the image. When colors are close to each other between the output of the first pixel 31A and the output of the second pixel 31B, outputs of white (W) are preferably the same.

Figure 21:
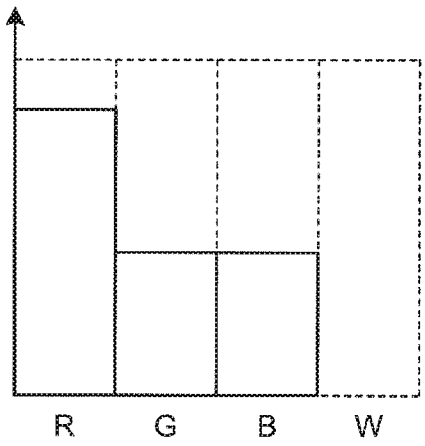
FIG. 21 is a diagram illustrating another example of the components of the input image signal.
Figure 22:
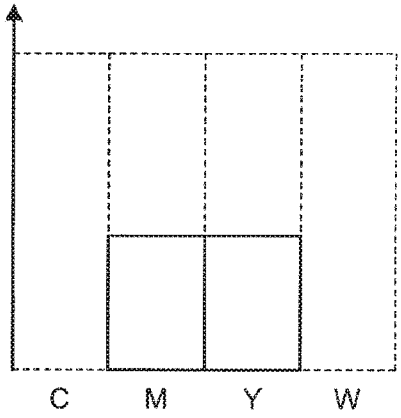
FIG. 22 is a diagram illustrating an example in which the components of the input image signal in FIG. 21 are converted into components of yellow (Y) and magenta (M)

In the examples illustrated in FIGS. 13 to 20, the signal processing unit 21 performs processing for causing a component that can be converted into white in the input image signal to be reflected in the output of the white sub-pixel more preferentially than the sub-pixels 32 of the other colors. However, the processing is merely an example of the conversion processing, and is not limited thereto. For example, the signal processing unit 21 may cause the component that can be converted into a color other than white among the components of the input image signal to be reflected in the output of the sub-pixels 32 more preferentially than the white sub-pixel. The processing related to the conversion into white or a color other than white may be performed after processing for moving the out-of-color gamut component of the second pixel 31B to the first pixel 31A. FIG. 21 is a diagram illustrating another example of the components of the input image signal. FIG. 22 is a diagram illustrating an example in which the components of the input image signal in FIG. 21 are converted into the components of yellow (Y) and magenta (M). Specifically, for example, when the components of the input image signal corresponding to the second pixel 31B are the components as illustrated in FIG. 21, the sub-pixel of yellow (Y) (sixth sub-pixel 32Y) may be lit by combining the components of red (R) and green (G), and the sub-pixel of magenta (M) (fifth sub-pixel 32M) may be lit by combining the components of red (R) and blue (B). That is, although the signal processing unit 21 may cause the sub-pixel of white (W) (eighth sub-pixel 32W2) to emit light by combining the components of red (R), green (G), and blue (B) among the components illustrated in FIG. 21, light emission of the sub-pixels 32 other than white (W) may be given priority. When the light emission of the sub-pixels 32 other than white (W) is given priority, as illustrated in FIG. 22, the signal processing unit 21 generates an output signal for causing the sub-pixels of yellow (Y) and magenta (M) to emit light. In this way, when the components of the input image signal are reflected in the sub-pixel of a color other than white (W) more preferentially than the sub-pixel of white (W), resolution in a display output can be further improved.

Figure 23:
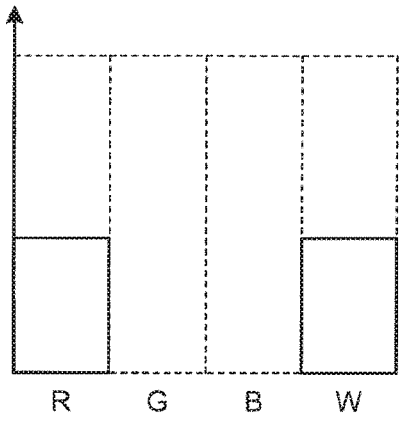
FIG. 23 is a diagram illustrating an example in which the components of red (R), green (G), and blue (B) of the input image signal in FIG. 21 are converted into the component of white (W)
Figure 24:
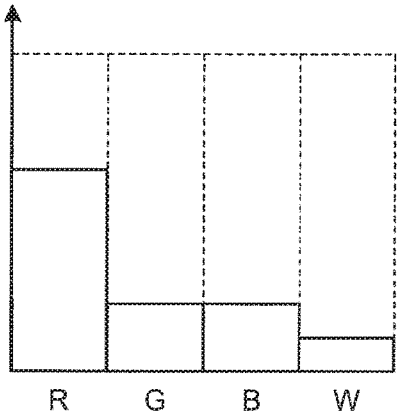
FIG. 24 is a diagram illustrating another example in which the components of red (R), green (G), and blue (B) of the input image signal in FIG. 21 are converted into the component of white (W)

The processing for causing the component that can be converted into a color other than white among the components of the input image signal to be reflected in the output of the sub-pixels 32 more preferentially than the white sub-pixel may also be applied to the first pixel 31A, not limited to the second pixel 31B. Of the white sub-pixels included in the first pixel 31A and the second pixel 31B, corresponding to an output of the one of white sub-pixel having smaller output, the signal processing unit 21 may determine the output of the other one of white sub-pixel. FIG. 23 is a diagram illustrating an example in which the components of red (R), green (G), and blue (B) of the input image signal in FIG. 21 are converted into the component of white (W). FIG. 24 is a diagram illustrating another example in which the components of red (R), green (G), and blue (B) of the input image signal in FIG. 21 are converted into the component of white (W). For example, the following describes a case in which the input image signal corresponding to the first pixel 31A included in the group of pixels 35 and the input image signal corresponding to the second pixel 31B included in the group of pixels 35 are both the input image signals that show the components of red (R), green (G), and blue (B) as illustrated in FIG. 21. In this case, if conversion into white (W) is given priority, the components that show the output of the first pixel 31A become only the components of red (R) and white (W) as illustrated in FIG. 23. As illustrated in FIG. 22, when the components that show the output of the second pixel 31B are components without light emission of the sub-pixel of white (W) (eighth sub-pixel 32W2), granularity in the display output may become obvious due to a difference between the output of the sub-pixel of white (W) (fourth sub-pixel 32W1) included in the first pixel 31A and the output of the sub-pixel of white (W) (eighth sub-pixel 32W2) included in the second pixel 31B. Accordingly, by distributing, to red (R), green (G), and blue (B), part of the components that can be converted into white (W) among the components of the input image signal corresponding to the first pixel 31A without converting them into white (W), as illustrated in FIG. 24, all of the sub-pixels of red (R), green (G), blue (B), and white (W) (the first sub-pixel 32R, the second sub-pixel 32G, the third sub-pixel 32B, and the fourth sub-pixel 32W1) can be caused to be in a light emitting state. In this way, the signal processing unit 21 may adjust the output of the white sub-pixel included in the first pixel 31A as illustrated in FIG. 24 based on the output of the white sub-pixel included in the second pixel 31B as illustrated in FIG. 22, for example. Due to this, the granularity in the display output can be further reduced. In the examples with reference to FIGS. 21 to 24, the output of the fourth sub-pixel 32W1 included in the first pixel 31A is determined corresponding to the output of the eighth sub-pixel 32W2 of the second pixel 31B in which the output of the sub-pixel of white (W) is smaller. Alternatively, when a magnitude relation of the outputs of the sub-pixels is reversed, for example, the output of the eighth sub-pixel 32W2 included in the second pixel 31B may be determined corresponding to the output of the fourth sub-pixel 32W1 included in the first pixel 31A.

A relation between the output of the white sub-pixel included in the second pixel 31B and the output of the white sub-pixel included in the first pixel 31A is optional. For example, when data in which the relation is determined in advance (such as table data) is prepared and the signal processing unit 21 is caused to perform processing corresponding to the data in processing the input image signal, the output of the white sub-pixel can be automatically adjusted. Out of the total amount of the luminance determined by the outputs of the first pixel 31A and the second pixel 31B, based on an amount of luminance determined by the output of the white sub-pixel included in one of the pixels, the signal processing unit 21 may adjust the output of the white sub-pixel included in the other one of the first pixel 31A and the second pixel 31B.

Figure 25:
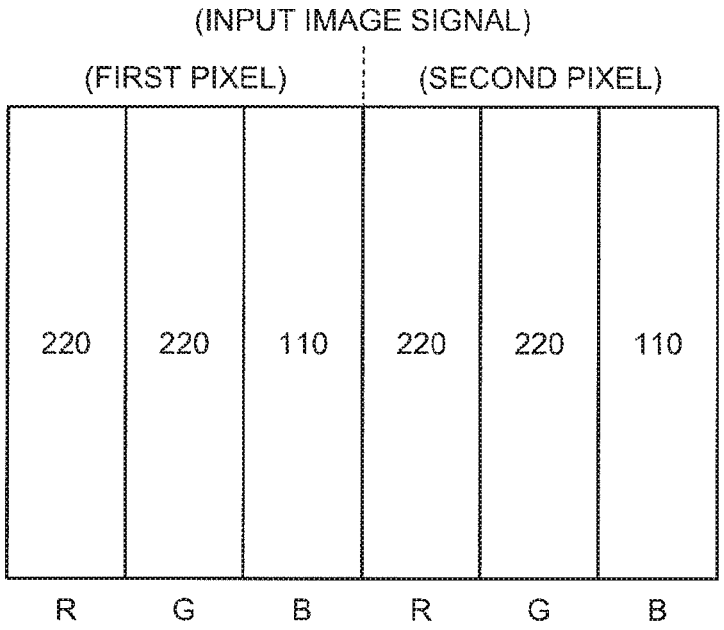
FIG. 25 is a diagram illustrating an example of values of red (R), green (G), and blue (B) as the components of input image signals of the first pixel and the second pixel.
Figure 26:
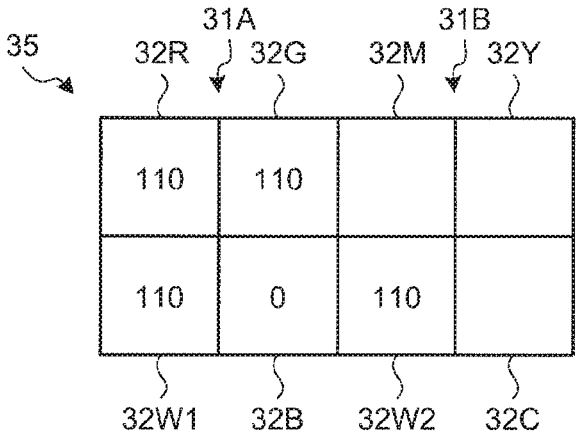
FIG. 26 is a diagram illustrating an example of a case in which components that can be converted into white (W) among the components illustrated in FIG. 25 are preferentially converted into white (W)
Figure 27:
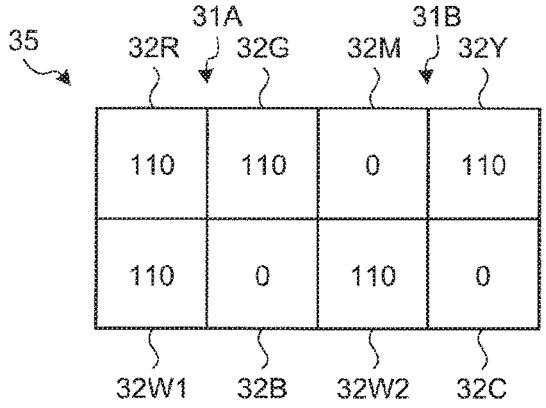
FIG. 27 is a diagram illustrating an example of converting components that can be converted into the colors of the sub-pixels other than white (W) included in the second pixel among the components illustrated in FIG. 26.
Figure 28:
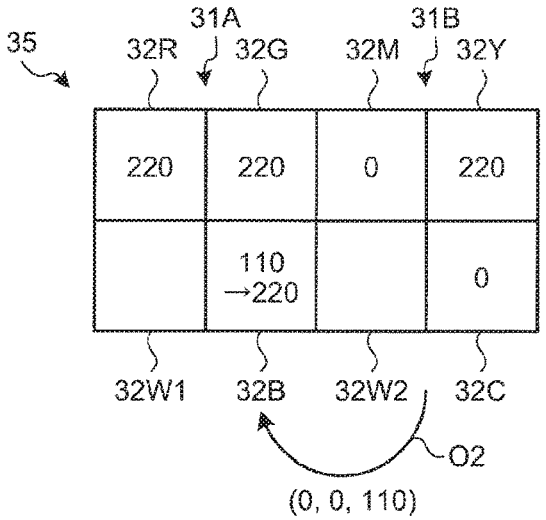
FIG. 28 is a diagram illustrating an example of a case in which the components that can be converted into the colors of the sub-pixels other than white (W) included in the second pixel among the components illustrated in FIG. 25 are preferentially converted into that color.
Figure 29:
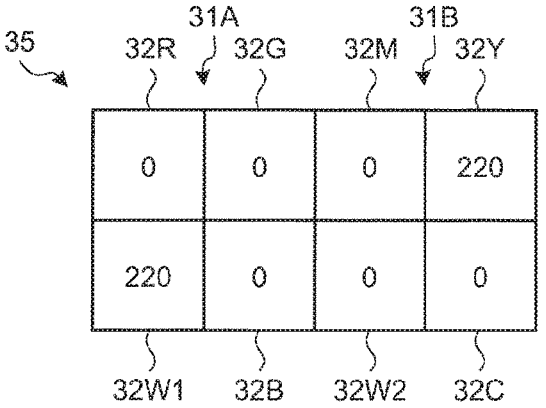
FIG. 29 is a diagram illustrating an example of converting the components that can be converted into white (W) among the components illustrated in FIG. 28.
Figure 30:
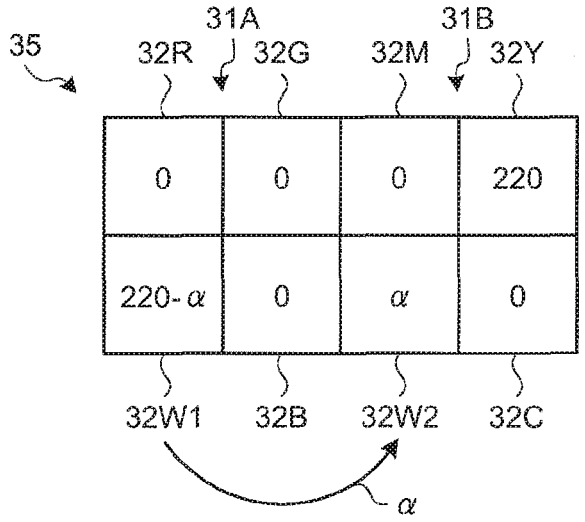
FIG. 30 is a diagram illustrating an example of a case in which luminance adjustment is performed on the components illustrated in FIG. 29 with the luminance adjustment component.

The signal processing unit 21 may change a method of determining the output of the sub-pixels 32 in each pixel corresponding to the input image signal according to the hue and the saturation of the input image signal and a luminance ratio of the out-of-color gamut component. The luminance ratio of the out-of-color gamut component indicates a luminance ratio of the out-of-color gamut component to the luminance of the second pixel before the out-of-color gamut component is moved. FIG. 25 is a diagram illustrating an example of values of red (R), green (G), and blue (B) as the components of the input image signals of the first pixel 31A and the second pixel 31B. FIG. 26 is a diagram illustrating an example of a case in which components that can be converted into white (W) among the components illustrated in FIG. 25 are preferentially converted into white (W). FIG. 27 is a diagram illustrating an example of converting components that can be converted into the colors of the sub-pixels 32 other than white (W) included in the second pixel 31B among the components illustrated in FIG. 26. FIG. 28 is a diagram illustrating an example of a case in which the components that can be converted into the colors of the sub-pixels 32 other than white (W) included in the second pixel 31B among the components illustrated in FIG. 25 are preferentially converted into that color. FIG. 29 is a diagram illustrating an example of converting the components that can be converted into white (W) among the components illustrated in FIG. 28. FIG. 30 is a diagram illustrating an example of a case in which luminance adjustment is performed on the components illustrated in FIG. 29 with the luminance adjustment component. For example, as illustrated in FIG. 25, the following describes a case in which the input image signal corresponding to the first pixel 31A included in the group of pixels 35 and the input image signal corresponding to the second pixel 31B included in the group of pixels 35 are both represented as follows: (R,G,B)=(220, 220,110). In this case, when the components that can be converted into white (W) are preferentially converted into white (W), as illustrated in FIG. 26, each of the components of white (W) in the first pixel 31A and the second pixel 31B becomes a component (110) corresponding to (R,G,B)=(110, 110, 110). At this point, (R,G,B)=(110,110,0) remains as a component that is not converted into white (W). Thereafter, a component among the components of the second pixel 31B that can be extended with the colors of the sub-pixels 32 included in the second pixel 31B is converted into the colors of the sub-pixels 32 included in the second pixel 31B, as illustrated in FIG. 27, the component represented as (R,G,B)=(110,110,0) is converted into a component (110) of yellow (Y). In this case, the out-of-color gamut component is not generated. On the other hand, among the components of the input image signal illustrated in FIG. 25, when the components that can be converted into the color other than white (W) are preferentially converted into the colors of the sub-pixels 32 other than white (W), for example, the component represented as (R,G,B)=(220,220, 0) is converted into a component (220) of yellow (Y) as illustrated in FIG. 28. In this case, a component represented as (R,G,B)=(0,0,110) among the components of the second pixel 31B is reflected in the output of the sub-pixels 32 in the first pixel 31A as the out-of-color gamut component (the out-of-color gamut component O2 illustrated in FIG. 28). In this case, the component represented as (R,G,B)=(0,0,110) that is the out-of-color gamut component is added to the component represented as (R,G,B)=(220,220,110) as the components of the input image signal corresponding to the first pixel 31A. Thereafter, as illustrated in FIG. 29, the components that can be converted into white (W) among input image signal components corresponding to the first pixel 31A are converted into white (W). That is, a component represented as (R,G,B)=(220,220,220) is converted into white (220). Thereafter, when luminance adjustment corresponding to the out-of-color gamut component is performed, as illustrated in FIG. 30, the component of white (W) (for example, $\alpha$) corresponding to the luminance adjustment component is subtracted from the component of the white sub-pixel (fourth sub-pixel 32W1) included in the first pixel 31A, and the component of white (W) is added to the component of the white sub-pixel (eighth sub-pixel 32W2) included in the second pixel 31B.

The output of the sub-pixels 32 illustrated in FIG. 27 excels in reduction of granularity as compared with the output of the sub-pixels 32 illustrated in FIG. 30 because the number of sub-pixels 32 that are lit is larger than that in FIG. 30. The output of the sub-pixels 32 illustrated in FIG. 30 excels in a power-saving property as compared with the output of the sub-pixels 32 illustrated in FIG. 27 because the number of sub-pixels 32 that are lit is smaller than that in FIG. 27.

When there are a plurality of combinations of the output of the sub-pixels 32 of the first pixel 31A and the output of the sub-pixels 32 of the second pixel 31B adjacent to the first pixel 31A based on the input image signal corresponding to adjacent two pixels, that is, the first pixel 31A and the second pixel 31B, the signal processing unit 21 may employ the output of the sub-pixels 32 of the first pixel 31A and the output of the sub-pixels 32 of the second pixel 31B so that the luminance distribution of the first pixel 31A further approximates to the luminance distribution of the second pixel 31B. For example, when the number of lit sub-pixels 32 included in the first pixel 31A is contrasted with the number of lit sub-pixels 32 included in the second pixel 31B as (A:B), (A:B)=(a:b) is established when the component of the input image signal is preferentially converted into the white component, and (A:B)=(c:d) is established when the component of the input image signal is preferentially converted into the component other than white. A smaller value between an absolute value of a difference between a and b and an absolute value of a difference between c and d may be employed. That is, such an output result may be employed because the luminance distribution of the pixels more approximates to each other in the output result in which the difference in the number of lit sub-pixels 32 in the respective pixels is smaller, which prevents deviation in the luminance. The signal processing unit 21 may employ the output of the sub-pixels 32 of the first pixel 31A and the output of the sub-pixels 32 of the second pixel 31B so that the luminance distribution of the first pixel 31A further approximates to the luminance distribution of the second pixel 31B based on an arrangement of the lit sub-pixels 32 in each pixel and intensity of the outputs of the lit sub-pixels 32.

Figure 31:
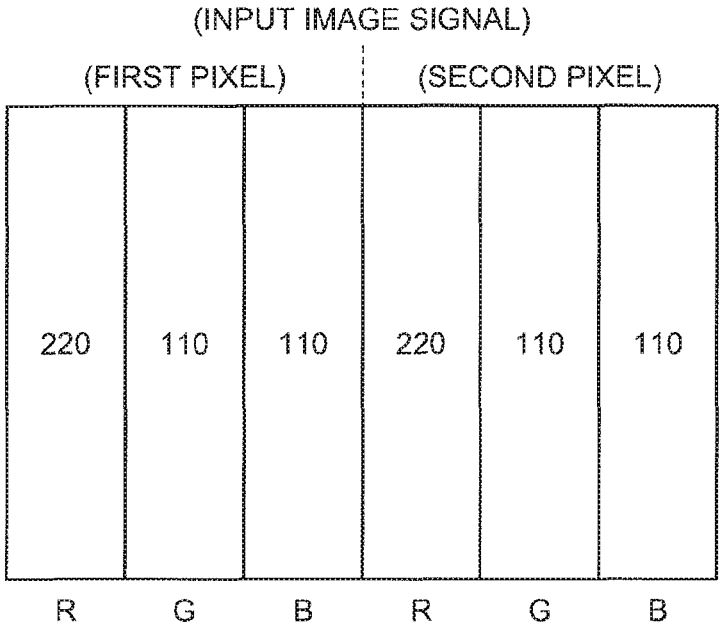
FIG. 31 is a diagram illustrating another example of the values of red (R), green (G), and blue (B) as the components of the input image signals of the first pixel and the second pixel.
Figure 32:
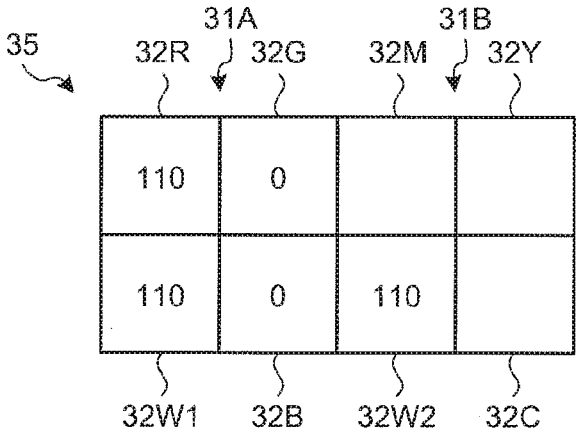
FIG. 32 is a diagram illustrating an example of a case in which the components that can be converted into white (W) among the components illustrated in FIG. 31 are preferentially converted into white (W)
Figure 33:
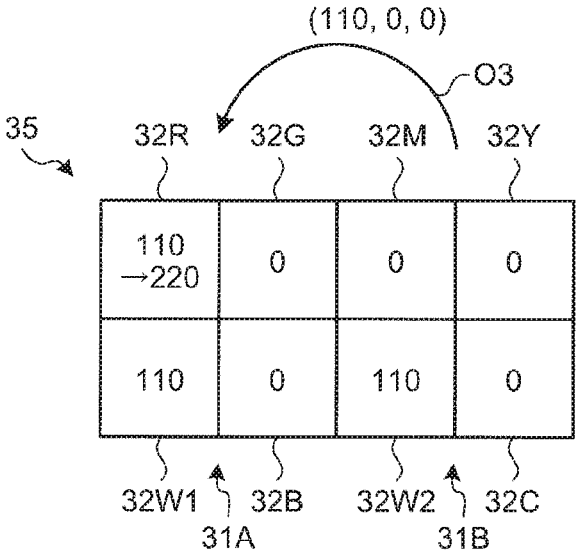
FIG. 33 is a diagram illustrating an example in which the out-of-color gamut component of the second pixel generated in the conversion illustrated in FIG. 32 is shifted to the first pixel.
Figure 34:
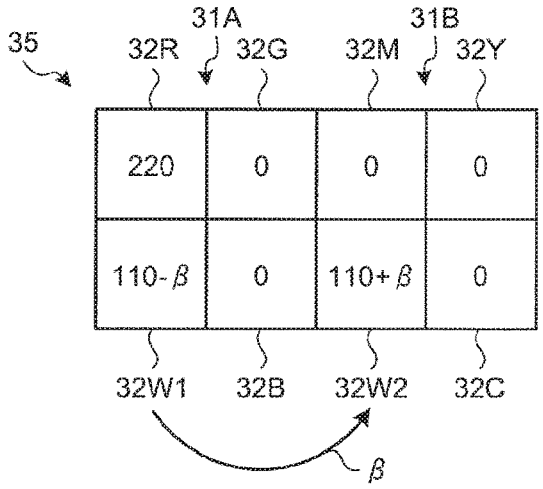
FIG. 34 is a diagram illustrating an example of a case in which luminance adjustment is performed on the components illustrated in FIG. 33 with the luminance adjustment component.
Figure 35:
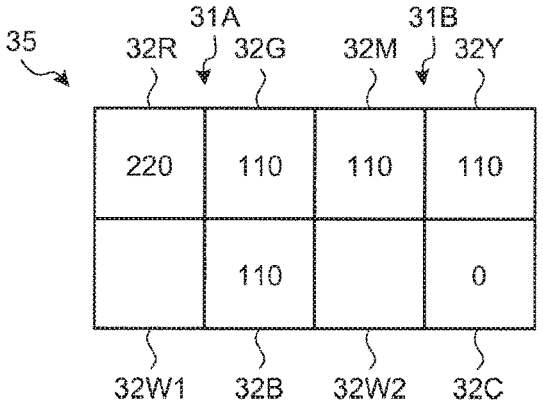
FIG. 35 is a diagram illustrating an example of a case in which the components that can be converted into the colors of the sub-pixels other than white (W) included in the second pixel among the components illustrated in FIG. 31 are preferentially converted into that color.
Figure 36:
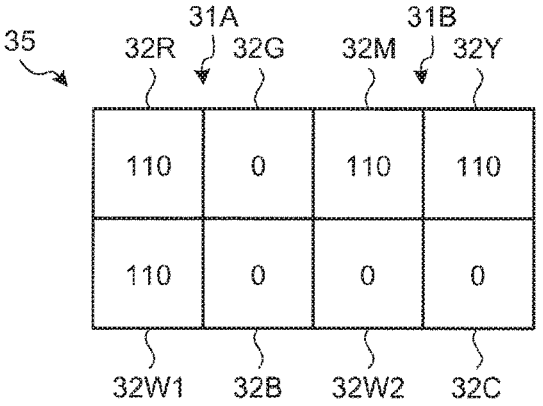
FIG. 36 is a diagram illustrating an example of converting the components that can be converted into white (W) among the components illustrated in FIG. 35.

FIG. 31 is a diagram illustrating another example of the values of red (R), green (G), and blue (B) as the components of the input image signals of the first pixel 31A and the second pixel 31B. FIG. 32 is a diagram illustrating an example of a case in which the components that can be converted into white (W) among the components illustrated in FIG. 31 are preferentially converted into white (W). FIG. 33 is a diagram illustrating an example in which the out-of-color gamut component of the second pixel 31B generated in the conversion illustrated in FIG. 32 is shifted to the first pixel 31A. FIG. 34 is a diagram illustrating an example of a case in which luminance adjustment is performed on the components illustrated in FIG. 33 with the luminance adjustment component. FIG. 35 is a diagram illustrating an example of a case in which the components that can be converted into the colors of the sub-pixels 32 other than white (W) included in the second pixel 31B among the components illustrated in FIG. 31 are preferentially converted into that color. FIG. 36 is a diagram illustrating an example of converting the components that can be converted into white (W) among the components illustrated in FIG. 35. As illustrated in FIG. 31, the following describes a case in which the input image signal corresponding to the first pixel 31A included in the group of pixels 35 and the input image signal corresponding to the second pixel 31B included in the group of pixels 35 are both represented as follows: (R,G,B) =(220,110,110). In this case, when the components that can be converted into white (W) are preferentially converted into white (W), as illustrated in FIG. 32, each of the components of white (W) in the first pixel 31A and the second pixel 31B becomes the component (110) corresponding to (R,G,B)=(110,110,110). At this time, (R,G,B)=(110,0,0) remains as a component that is not converted into white (W). In this case, (R,G,B)=(110,0,0) cannot be extended with the colors of the sub-pixels 32 included in the second pixel 31B, so that (R,G,B)=(110,0,0) is reflected in the output of the sub-pixels 32 in the first pixel 31A as the out-of-color gamut component (the out-of-color gamut component O3 illustrated in FIG. 33). That is, as illustrated in FIG. 33, no component is reflected in the output of the sub-pixels 32 other than white in the second pixel 31B. The component of red (R) in the first pixel 31A becomes the component (220) to which the out-of-color gamut component is added. When luminance adjustment corresponding to the out-of-color gamut component is performed, as illustrated in FIG. 34, the component of white (W) (for example, f) corresponding to the luminance adjustment component is subtracted from the component of the white sub-pixel (fourth sub-pixel 32W1) included in the first pixel 31A, and the component of white (W) is added to the component of the white sub-pixel (eighth sub-pixel 32W2) included in the second pixel 31B. On the other hand, among the components of the input image signal illustrated in FIG. 31, when the components that can be converted into the color other than white (W) are preferentially converted into the colors of the sub-pixels 32 other than white (W), for example, the component represented as (R,G,B)=(110,110,0) is converted into the component (110) of yellow (Y) as illustrated in FIG. 35. The component represented as (R,G,B)=(110,0,110) is converted into the component (110) of magenta (M). In this case, the out-of-color gamut component is not generated. Also in this case, as illustrated in FIG. 36, a component to be reflected in the output of the white sub-pixel (eighth sub-pixel 32W2) of the second pixel 31B is not generated in the components of the second pixel 31B. If the component that can be converted into white remains, this component is reflected in the output of the eighth sub-pixel 32W2. Among the components of the first pixel 31A, the component corresponding to (R,G,B)=(110,110,110) is converted into the component (110) of white (W), and the rest of the components corresponding to (R,G,B)=(110,0,0) remains as the component (110) of red (R).

Figure 37:
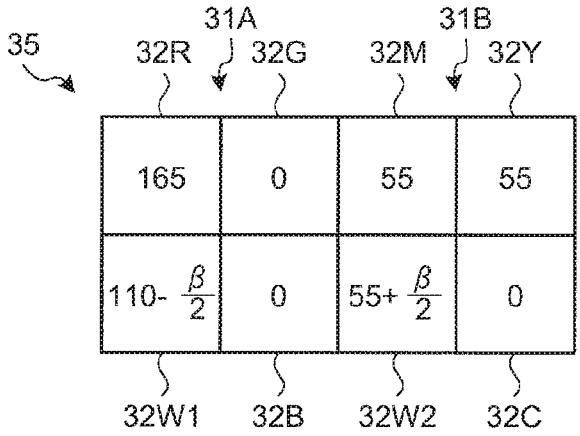
FIG. 37 is a diagram illustrating an example of combining the conversion result illustrated in FIG. 34 and the conversion result illustrated in FIG. 36.

The signal processing unit 21 may determine the output of the sub-pixels 32 in each pixel 31 included in the group of pixels 35 based on both of the result of a case in which the component of an image input signal is preferentially converted into white and the result of a case in which the component of the image input signal is preferentially converted into the color other than white. FIG. 37 is a diagram illustrating an example of combining the conversion result illustrated in FIG. 34 and the conversion result illustrated in FIG. 36. For example, in the example illustrated in FIG. 34, three sub-pixels 32 (the first sub-pixel 32R, the fourth sub-pixel 32W1, and the eighth sub-pixel 32W2) are lit among the eight sub-pixels 32 included in the group of pixels 35. In the example illustrated in FIG. 36, four sub-pixels 32 (the first sub-pixel 32R, the fourth sub-pixel 32W1, the fifth sub-pixel 32M, and the sixth sub-pixel 32Y) are lit among the eight sub-pixels 32 included in the group of pixels 35. In this case, the output illustrated in FIG. 34 and the output illustrated in FIG. 36 are combined at a predetermined ratio (for example, 1:1), five sub-pixels 32 (the first sub-pixel 32R, the fourth sub-pixel 32W1, the fifth sub-pixel 32M, the sixth sub-pixel 32Y, and the eighth sub-pixel 32W2) are lit as illustrated in FIG. 37. Accordingly, the granularity can be further reduced. A combination ratio is optional between the result of a case in which the component of the image input signal is preferentially converted into white and the result of a case in which the component of the image input signal is preferentially converted into the color other than white. The combination ratio may be changed corresponding to at least one of the hue indicated by the input image signal and the hue indicated by each of the results of the conversion. In this case, the combination ratio can be automatically determined by preparing data (such as table data) that indicates the combination ratio of each hue and causing the signal processing unit 21 to perform processing corresponding to the data in processing the input image signal. Fractions generated in combining the results are arbitrarily processed.

Figure 38:
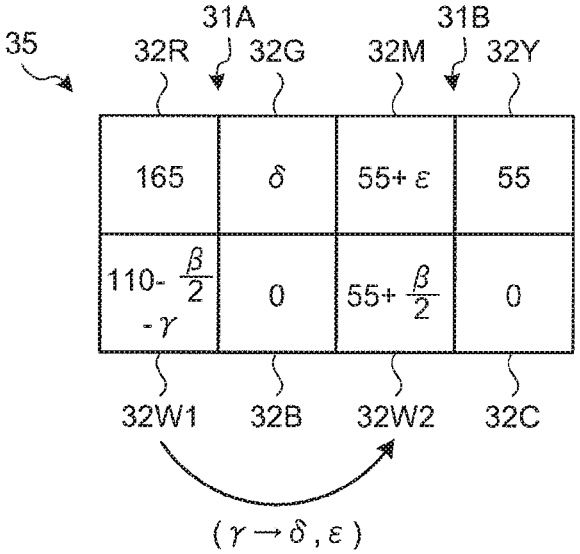
FIG. 38 is a diagram illustrating an example of a case in which part of the components having been converted into white, among the components indicated in the combining result illustrated in FIG. 37, is distributed to the components other than white.
Figure 39:
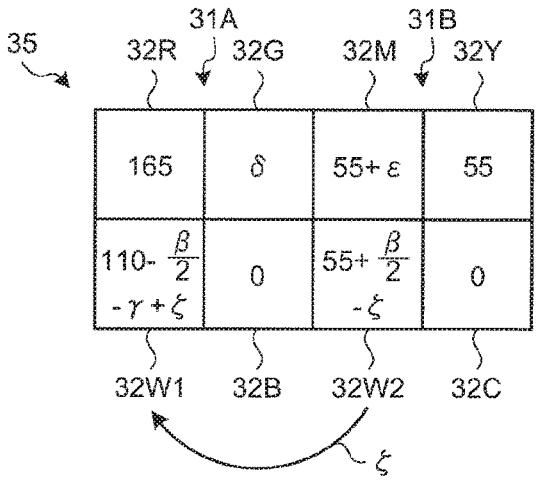
FIG. 39 is a diagram illustrating an example of a case in which luminance adjustment is performed on the components illustrated in FIG. 38 with the luminance adjustment component.

Additionally, the signal processing unit 21 may divide part of the components having been converted into white, into the components other than white. FIG. 38 is a diagram illustrating an example of a case in which part of the components having been converted into white, among the components indicated in the combining result illustrated in FIG. 37, is distributed to the components other than white. FIG. 39 is a diagram illustrating an example of a case in which luminance adjustment is performed on the components illustrated in FIG. 38 with the luminance adjustment component. Specifically, for example, the signal processing unit 21 may redistribute part of the components (γ) reflected in the output of the fourth sub-pixel 32W1 in the output of the sub-pixels 32 illustrated in FIG. 37 to the second sub-pixel 32G and the fifth sub-pixel 32M. In this case, as illustrated in FIG. 38, the components (δ, ε) distributed to the second sub-pixel 32G and the fifth sub-pixel 32M are reflected in the outputs of the second sub-pixel 32G and the fifth sub-pixel 32M, respectively. In this case, the luminance is shifted from the first pixel 31A to the second pixel 31B by an amount of the component (c) distributed to the fifth sub-pixel 32M. Accordingly, as illustrated in FIG. 39, the signal processing unit 21 subtracts the component (ζ) corresponding to the output of the eighth sub-pixel 32W2 by an amount of luminance corresponding to the component (ε) distributed to the fifth sub-pixel 32M, and causes the component (ζ) to be reflected in the output of the fourth sub-pixel 32W1. In such a case of performing redistribution, a ratio of the component to be redistributed to the color component before redistribution is optional. The ratio is preferably in a range in which a relation of the hue, the saturation, and the luminance among the pixels will not be changed.

In the description with reference to FIGS. 13 to 39, employed is a conversion method of performing a plurality of steps assuming that the processing for converting the component and the like of the input image signal into white or a color other than white is one step. This method is merely an example of a procedure of the conversion processing, and not limited thereto. For example, the component (R,G,B) of the input image signal may be converted into an arbitrary color corresponding to the colors of the sub-pixels 32 of each pixel 31 due to a color management mechanism. By way of specific example, the component (R,G,B) of the input image signal can be converted into a component (C,M,Y) of three colors included in the second pixel 31B by using data of 3×3 matrix. In a case of conversion using the color management mechanism, a ratio of the component to be converted may be set among the components of the input image signal.

Figure 40:
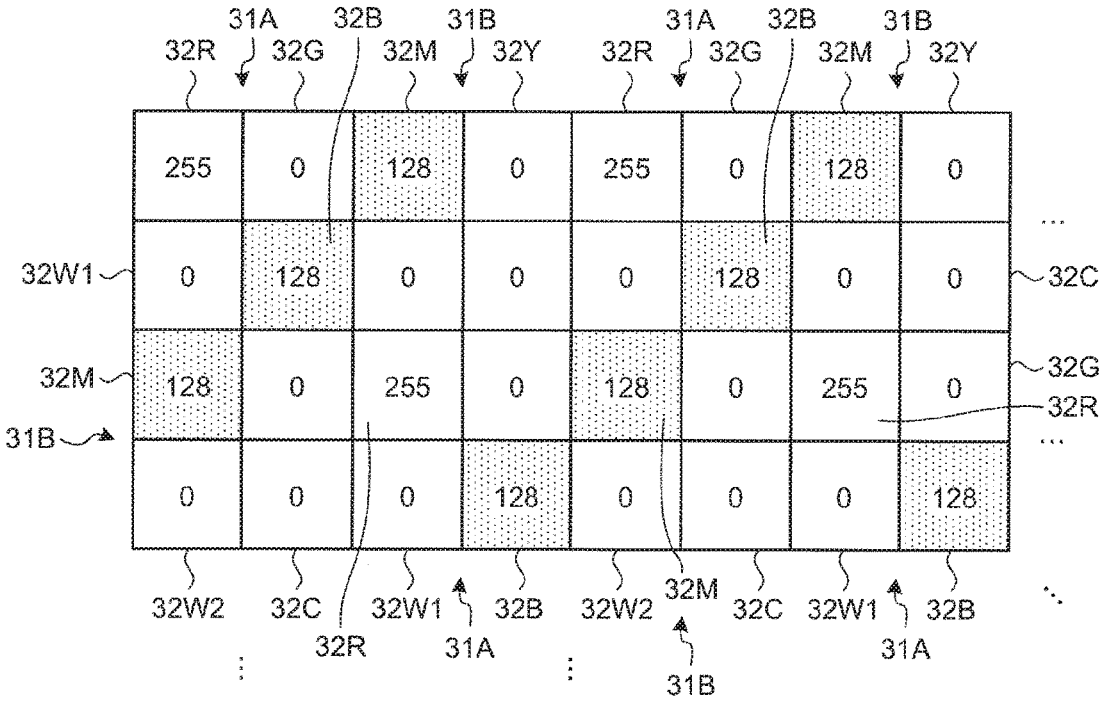
FIG. 40 is a diagram illustrating an example of a case in which an oblique line of a blue component appears to be present.
Figure 41:
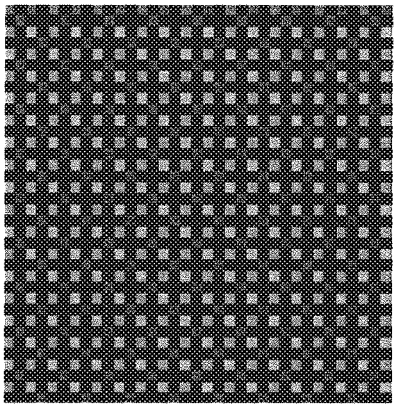
FIG. 41 is a diagram illustrating an example of a case in which the oblique line of the blue component appears to be present.
Figure 42:
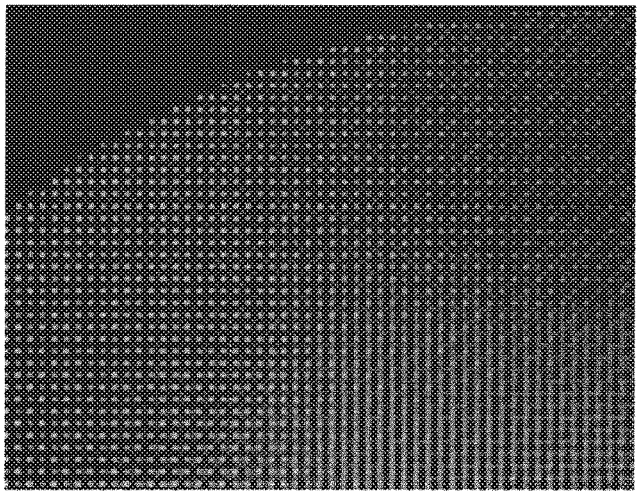
FIG. 42 is a diagram illustrating an example of a case in which the oblique line of the blue component appears to be present.

When the input image signal includes a component corresponding to a specific color, a line in a specific direction (for example, an oblique direction) appears to be present in the display area A in some cases. FIGS. 40, 41, and 42 are diagrams illustrating an example of a case in which an oblique line of a blue component appears to be present. Specifically, in the arrangement of the pixels 31 and the sub-pixels 32 illustrated in FIG. 6, for example, when an input pixel signal corresponding to magenta (M) is input in a range equal to or larger than the group of pixels 35, color extension of magenta (M) is performed in the first pixel 31A by combining the first sub-pixel 32R and the third sub-pixel 32B, and color extension of magenta (M) is performed with the fifth sub-pixel 32M in the second pixel 31B as illustrated in FIGS. 40, 41, and 42. In this case, the other sub-pixels 32 (the second sub-pixel 32G, the fourth sub-pixel 32W1, the sixth sub-pixel 32Y, the seventh sub-pixel 32C, and the eighth sub-pixel 32W2) are not used for color extension. Due to the blue component included in light from the third sub-pixel 32B and the blue component included in light from the fifth sub-pixel 32M, the oblique line of the blue component appears to be present in an oblique direction along which the third sub-pixel 32B is continuous to the fifth sub-pixel 32M. FIG. 40 illustrates a case in which the component of the input image signal corresponding to all the pixels 31 is represented as (R,G,B)=(192,0,128). In FIG. 40, the sub-pixels constituting the oblique line is marked.

In the above example, described is the line in the oblique direction in a case in which the input pixel signal corresponding to magenta (M) is input in a case of the arrangement of the pixels 31 and the sub-pixels 32 illustrated in FIG. 6, but the embodiment is not limited thereto. In an arrangement other than the arrangement of the pixels 31 and the sub-pixels 32 illustrated in FIG. 6, although the line does not show up with the input pixel signal corresponding to magenta (M), the line shows up with the input image signal corresponding to another color. Specifically, in a case in which, among the sub-pixels 32 of the first pixel 31A, for example, one of the sub-pixels 32 corresponding to one color (for example, the first sub-pixel 32R) is continuous to one of the sub-pixels 32 of the second pixel 31B including that color as a component (for example, the fifth sub-pixel 32M or the sixth sub-pixel 32Y corresponding to magenta (M) or yellow (Y) the component of which includes a primary color of red (R)) in the oblique direction, an oblique line of a red component appears to be present when the input image signal corresponding to magenta (M) or yellow (Y) is input. In a case of other input image signal and arrangement of the pixels 31 and the sub-pixels 32, such a line of any color may show up.

Such a line shows up more clearly as the saturation of the component (component of blue (B) in a case of magenta (M)) of the input image signal is higher, the component being common to the sub-pixels 32 (the third sub-pixel 32B and the fifth sub-pixel 32M in a case of FIG. 6, FIG. 40, FIG. 41, and FIG. 42) constituting the line. Additionally, the line shows up more clearly as the saturation of the component of the input image signal corresponding to the sub-pixels 32 adjacent to the sub-pixels 32 constituting the line is lower. Such a line of pixels including the same color component that are lit continuously in a straight line shows up when there is a certain or more difference between the output from the sub-pixels 32 including the same color component and the output from the sub-pixels 32 adjacent to the sub-pixels 32 including the same color component. The certain or more difference to cause the line to show up may vary depending on the colors of the sub-pixels 32 including the same color component and the colors of the sub-pixels 32 adjacent to the former sub-pixels 32, so that the difference is set corresponding to the arrangement of the sub-pixels 32 included in each of the first pixel 31A and the second pixel 31B. As described above, in the image display device 100 including the image display unit 30 in which the first pixels 31A constituted of the sub-pixels 32 of four colors included in the first color gamut and the second pixels 31B constituted of the sub-pixels 32 of four colors included in the second color gamut different from the first color gamut are arranged in a staggered manner and the sub-pixels 32 are arranged in a matrix, when the signal processing unit 21 determines the output of the sub-pixels 32 included in the first pixel 31A based on the first component as the components of the input image signal corresponding to the first pixel 31A and determines the output of the sub-pixels 32 included in the second pixel 31B based on the second component as the components of the input image signal corresponding to the second pixel 31B, a line in a specific direction (for example, the oblique direction) appears to be present in the display area A in some cases when the sub-pixels 32 (for example, the third sub-pixel 32B and the fifth sub-pixel 32M) including the same color component (for example, the blue component included in magenta (M)) are continuously lit in a straight line, and there is a certain or more difference between the output from the sub-pixels 32 including the same color component and the output from the sub-pixels 32 adjacent to the sub-pixels 32 including the same color component.

The signal processing unit 21 may perform processing for further reducing visibility of the line described above. As such processing, for example, the signal processing unit 21 determines the output of the sub-pixels 32 included in the first pixel 31A based on part or all of the first component from which an adjustment component including the same color component is eliminated, and determines the output of the sub-pixels 32 included in the second pixel 31B based on the second component and the adjustment component. As a specific example, the following describes the processing in the example illustrated in FIG. 40. In this case, the signal processing unit 21 causes a predetermined rate of components to be extended as magenta (M), in the component (R,G,B)=(192,0,128) of the input image signal corresponding to the first pixel 31A, to be the adjustment component. In this case, when the predetermined rate is 50%, that is, when the adjustment component corresponds to a half of the same color component in the first component, the adjustment component is represented as (R,G,B)=(64,0,64). When the predetermined rate is 100%, the adjustment component is represented as (R,G,B)=(128,0,128). The signal processing unit 21 determines the output of the sub-pixels 32 included in the first pixel 31A based on the component obtained by eliminating the adjustment component from the component of the input image signal corresponding to the first pixel 31A, and determines the output of the sub-pixels 32 included in the second pixel 31B based on the adjustment component and the component of the input image signal corresponding to the second pixel 31B.

When the output is not controlled with the adjustment component, the components of the third sub-pixel 32B included in the first pixel 31A and the fifth sub-pixel 32M included in the second pixel 31B are "128" and "128", respectively. On the other hand, for example, when the predetermined rate is 50% and the adjustment component is represented as (R,G,B)=(64,0,64), the components of the third sub-pixel 32B and the fifth sub-pixel 32M are "64" and "192", respectively. When the predetermined rate is 100% and the adjustment component is represented as (R,G,B)=(128,0,128), the components of the third sub-pixel 32B and the fifth sub-pixel 32M are "0" and "255", respectively. In this way, by setting the adjustment component to reduce the output of the third sub-pixel 32B, a state in which equivalent blue components are continued in the oblique direction can be further reduced. That is, the line of the blue components can be prevented from being generated in color extension of magenta (M). The processing related to the adjustment component can be similarly applied to a similar line that may be generated when an output corresponding to another color is performed in the arrangement of the other pixels 31 and sub-pixels 32.

Figure 43:
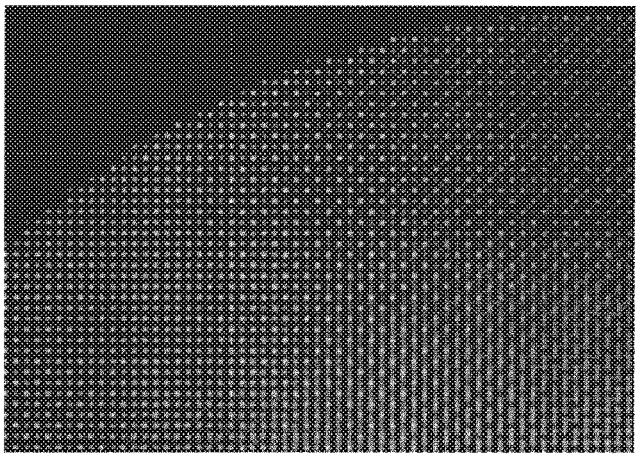
FIG. 43 is a diagram illustrating an example of a case in which 50% of components that can be extended as magenta (M) among the components of the input image signal corresponding to the first pixel is caused to be adjustment components.
Figure 44:
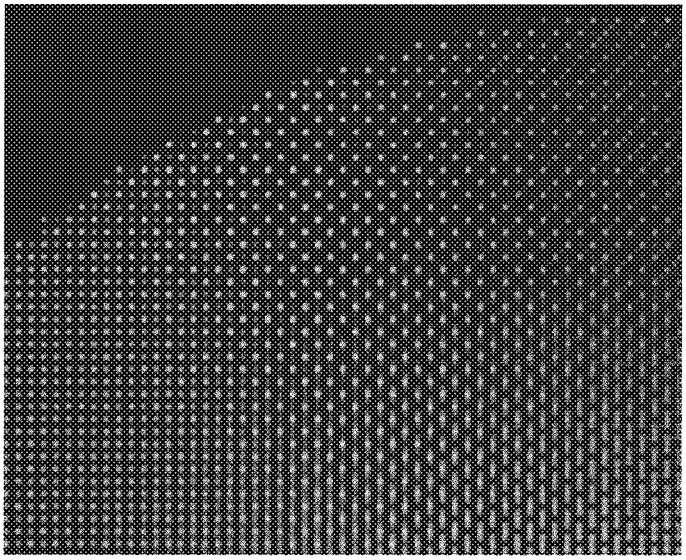
FIG. 44 is a diagram illustrating an example of a case in which 100% of the components that can be extended as magenta (M) among the components of the input image signal corresponding to the first pixel is caused to be adjustment components.

FIG. 43 is a diagram illustrating an example of a case in which 50% of components that can be extended as magenta (M) among the components of the input image signal corresponding to the first pixel 31A is caused to be the adjustment components. FIG. 44 is a diagram illustrating an example of a case in which 100% of the components that can be extended as magenta (M) among the components of the input image signal corresponding to the first pixel 31A is caused to be the adjustment components. A relation between the component of the input image signal and the adjustment component (for example, a predetermined rate) is optional. For example, as exemplified in FIG. 44, when there is no output from one of the continuous sub-pixels (third sub-pixel 32B), the line can be more securely prevented from being generated while the granularity is increased. As exemplified in FIG. 43, when output is performed in a state in which the output of one of the continuous sub-pixels (third sub-pixel 32B) is lowered, prevention of generation of the line and prevention of generation of the granularity can be both balanced. In this way, the relation between the component of the input image signal and the adjustment component (for example, the predetermined rate) may be appropriately determined corresponding to balance of prevention of generation of the line, the granularity, and the like. Processing of automatically preventing the line from being generated can be applied by preparing data (such as table data) indicating the relation between the component of the input image signal and the adjustment component (for example, the predetermined rate), and causing the signal processing unit 21 to perform processing corresponding to the data in processing the input image signal.

A processing method for preventing the line from being generated is not limited to the method described above. For example, a similar effect can be obtained, not only through the processing in unit of the group of pixels 35, by distributing the adjustment components among the components of the input image signal to 8 pixels (in the row direction, the column direction, and the oblique direction) around the sub-pixel of white (W) centered on the sub-pixel of white (W) included in each pixel 31. The adjustment component is not limited to a half of the same color component in the first component. For example, data (such as a table of the adjustment component) may be provided, the data indicating a degree of the adjustment component (for example, a rate thereof determined in a range from 0 to 100%) corresponding to the hue and the saturation of the color component of the line described above, to determine the adjustment component based on the data.

Next, the following describes a case in which the input image signal corresponding to the second pixel 31B is the input image signal corresponding to the edge of the image. The image display unit 30 performs output according to the input image signal corresponding to each of the pixels 31 to output and display the image in the display area A. In this case, when a component (for example, the out-of-color gamut component described above) corresponding to the input image signal of the pixel corresponding to a boundary (edge) of color generated between the input image signals of the pixels 31 is shifted to another pixel, the edge may be deviated due to the shifted component. Due to the edge, the boundary of color can be recognized to be apparently present between the adjacent pixels because at least one of the hue, the saturation, and the luminance is largely different between the adjacent pixels. For example, the edge means a boundary of a character, a line, and a figure of white or another color when a background is black (or vice versa). More specific determination (judgment) of the edge will be described later.

Figure 45:
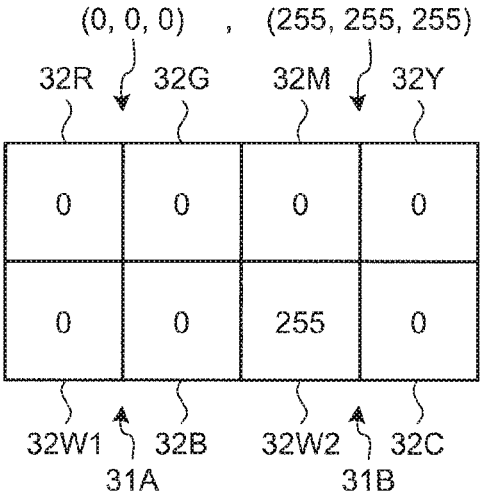
FIG. 45 is a diagram illustrating an example of a case in which each of the first pixel and the second pixel can independently perform output corresponding to the component of the input image signal.
Figure 46:
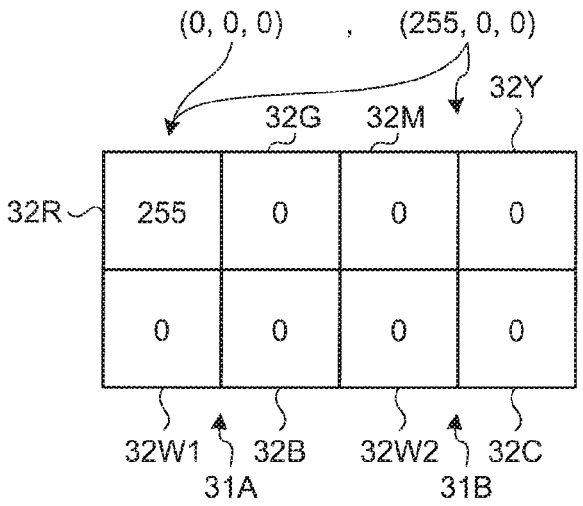
FIG. 46 is a diagram illustrating an example of a case in which the out-of-color gamut component is generated when the components of the input image signal corresponding to the second pixel are to be extended with the second pixel.
Figure 49:
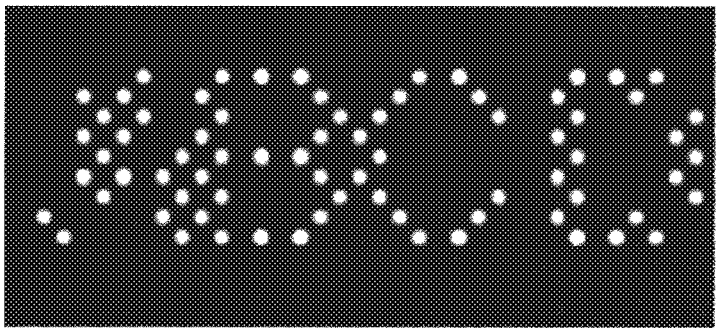
FIG. 49 is a diagram illustrating an example of edge deviation that can be caused when the out-of-color gamut component is simply moved with respect to the same input image signal as that plotted in FIG. 48.

FIG. 45 is a diagram illustrating an example of a case in which each of the first pixel 31A and the second pixel 31B can independently perform output corresponding to the component of the input image signal. FIG. 46 is a diagram illustrating an example of a case in which the out-of-color gamut component is generated when the components of the input image signal corresponding to the second pixel 31B are to be extended with the second pixel 31B. In a case in which each of the first pixel 31A and the second pixel 31B can independently perform output corresponding to the component of the input image signal, edge deviation is not caused even if any of the pixels 31 corresponds to the edge. For example, as illustrated in FIG. 45, when the input image signal corresponding to the first pixel 31A is represented as (R,G,B)=(0,0,0) and the input image signal corresponding to the second pixel 31B is represented as (R,G,B)=(255,255,255), edge deviation is not caused because any of the pixels can independently perform output corresponding to the component of the input image signal. On the other hand, in a case in which the input image signal corresponding to the second pixel 31B is a signal of a pixel corresponding to the edge of the image, the out-of-color gamut component is generated when the component of the input image signal corresponding to the second pixel 31B is to be extended with the second pixel 31B. As illustrated in FIG. 46 and FIG. 49 described later, when the out-of-color gamut component is shifted to the first pixel 31A, edge deviation may be caused such that the position of the edge is output as deviated from the second pixel 31B to the first pixel 31A. For example, as illustrated in FIG. 46, when the input image signal corresponding to the first pixel 31A is represented as (R,G,B)=(0,0,0) and the input image signal corresponding to the second pixel 31B is represented as (R,G,B)=(255,0,0), a component (255) of red (R) as the out-of-color gamut component in the second pixel 31B is shifted to the first pixel 31A. Due to this, edge deviation is caused such that positions of the pixel in which black is output and the pixel in which red is output are replaced with each other with respect to positions of an output of black (first pixel 31A) and an output of red (second pixel 31B) based on the input image signal. The edge deviation is more remarkably caused when the component to be shifted (for example, the out-of-color gamut component) is shifted to one of the sub-pixels 32 (for example, the first sub-pixel 32R in FIG. 46) that is not adjacent to the pixel (for example, the second pixel 31B in FIG. 46) in which the component to be shifted is generated.

The signal processing unit 21 may perform exception processing related to movement of part or all of the components of the input image signal of the pixel corresponding to the edge. For example, when the input image signal corresponding to the second pixel 31B is the input image signal corresponding to the edge of the image, the signal processing unit 21 may cause the out-of-color gamut component not to be reflected in the output of the sub-pixels 32 of the first pixel 31A that is not adjacent to the sub-pixels 32 of the second pixel 31B in which light is output. Specifically, the signal processing unit 21 may cause the out-of-color gamut component to be reflected in the output of one of the sub-pixels 32 of a color including the out-of-color gamut component among the sub-pixels 32 included in the second pixel 31B.

Figure 47:
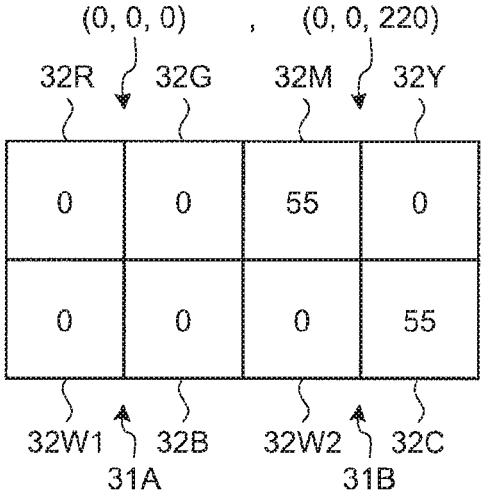
FIG. 47 is a diagram illustrating an example of a case in which the out-of-color gamut component is reflected in an output of a sub-pixel of a color including the out-of-color gamut component among the sub-pixels included in the second pixel.

FIG. 47 is a diagram illustrating an example of a case in which the out-of-color gamut component is reflected in the output of one of the sub-pixels 32 of a color including the out-of-color gamut component among the sub-pixels 32 included in the second pixel 31B. For example, when the input image signal corresponding to the second pixel 31B is the input image signal of the pixel corresponding to the edge and the component of the input image signal corresponding to the second pixel 31B is represented as (R,G,B)=(0,0,220), the signal processing unit 21 causes the blue component indicated by the input image signal to be reflected in both of the sub-pixels 32 (the fifth sub-pixel 32M and the seventh sub-pixel 32C) each including the blue component among the sub-pixels 32 included in the second pixel 31B. Specifically, the signal processing unit 21 maintains the hue and the luminance among the hue, the saturation, and the luminance of the color indicated by the input image signal corresponding to the second pixel 31B and allows only the saturation to be reduced, and determines the output of the sub-pixels 32 included in the second pixel 31B. More specifically, as illustrated in FIG. 47 for example, the signal processing unit 21 outputs the blue component (220) by outputting each of the fifth sub-pixel 32M and the seventh sub-pixel 32C including the blue component in a lighting state (for example, (C,M,Y)=(55,55,0)) in which the hue and the saturation of the input image signal is maintained. In this example, such an output is obtained because the luminance of cyan (C), magenta (M), and yellow (Y) as the complementary colors of red (R), green (G), and blue (B) is two times the luminance of red (R), green (G), and blue (B). As described above, in this embodiment, the complementary color having the same hue as that of the out-of-color gamut component is used in the output of the second pixel 31B. With such an output, color extension of the input image signal is not completely performed, but color extension closer to the input image signal can be performed without causing edge deviation.

Figure 48:
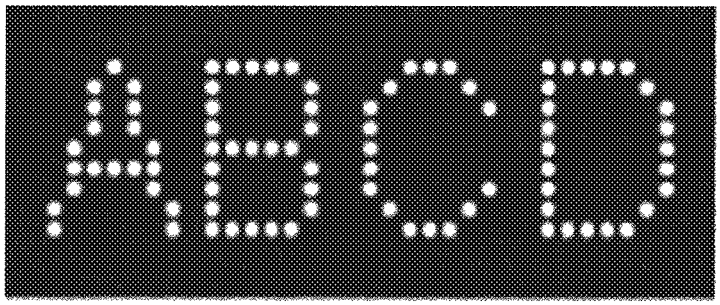
FIG. 48 is a diagram illustrating an example of a case in which characters of a primary color each are plotted by a line having a width of one pixel with a plurality of pixels in a display area all the pixels of which are the first pixels.
Figure 50:
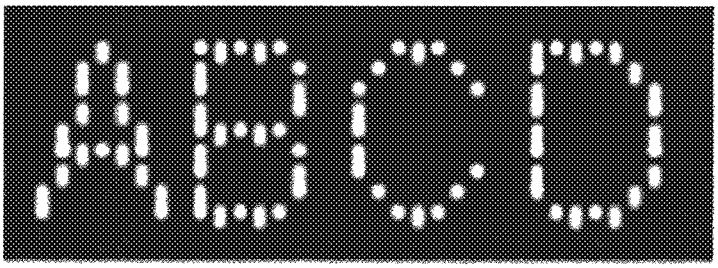
FIG. 50 is a diagram illustrating an example of a case in which the out-of-color gamut component is reflected in an output of a sub-pixel of a color including the out-of-color gamut component among the sub-pixels included in the second pixel with respect to the same input image signal as that plotted in FIG. 48.

FIG. 48 is a diagram illustrating an example of a case in which characters of a primary color each are plotted by a line having a width of one pixel with a plurality of pixels in the display area A all the pixels of which are the first pixels 31A. FIG. 49 is a diagram illustrating an example of edge deviation that can be caused when the out-of-color gamut component is simply moved with respect to the same input image signal as that plotted in FIG. 48. FIG. 50 is a diagram illustrating an example of a case in which the out-of-color gamut component is reflected in the output of one of the sub-pixels 32 of a color including the out-of-color gamut component among the sub-pixels 32 included in the second pixel 31B with respect to the same input image signal as that plotted in FIG. 48. FIGS. 49 and 50 illustrate output examples in the display area A in which the first pixel 31A is adjacent to the second pixel 31B. For example, the out-of-color gamut component is simply moved with respect to the input image signal in which the character of a primary color (for example, green) is plotted by a line having the width of one pixel with the pixels as illustrated in FIG. 48, the character may be deformed due to edge deviation as illustrated in FIG. 49. On the other hand, as illustrated in the example of FIG. 47, when the out-of-color gamut component is reflected in the output of one of the sub-pixels 32 of a color including the out-of-color gamut component among the sub-pixels 32 included in the second pixel 31B, the character can be prevented from being deformed due to edge deviation as illustrated in FIG. 50.

In the example illustrated in FIG. 47, assuming that deviation of hues of cyan (C) and magenta (M) each including the blue component with respect to the hue of blue (B) are substantially the same, the blue component is distributed to two pixels, that is, the fifth sub-pixel 32M and the seventh sub-pixel 32C. However, this is merely an example, and the embodiment is not limited thereto. When the sub-pixels 32 corresponding to the color closer to the out-of-color gamut component is narrowed down to one from among the sub-pixels 32 included in the second pixel 31B, the out-of-color gamut component may be reflected in the output of the one sub-pixel 32. When the input image signal corresponding to the second pixel 31B is the input image signal of the pixel corresponding to the edge, and when the out-of-color gamut component is included in the component of the input image signal corresponding to the second pixel 31B, the pixel in which the out-of-color gamut component is to be reflected is determined corresponding to a relation between the out-of-color gamut component and the colors of the sub-pixels 32 included in the second pixel 31B.

Figure 51:
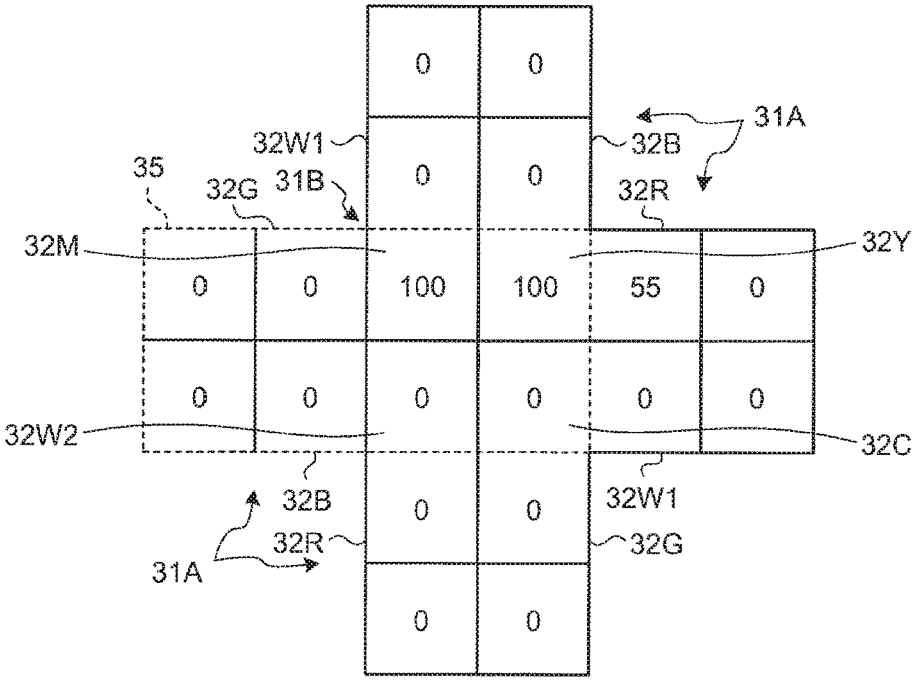
FIG. 51 is a diagram illustrating an example of a case in which the out-of-color gamut component is shifted to one of the sub-pixels included in the first pixel of another group that is present on the right side of the second pixel.
Figure 52:
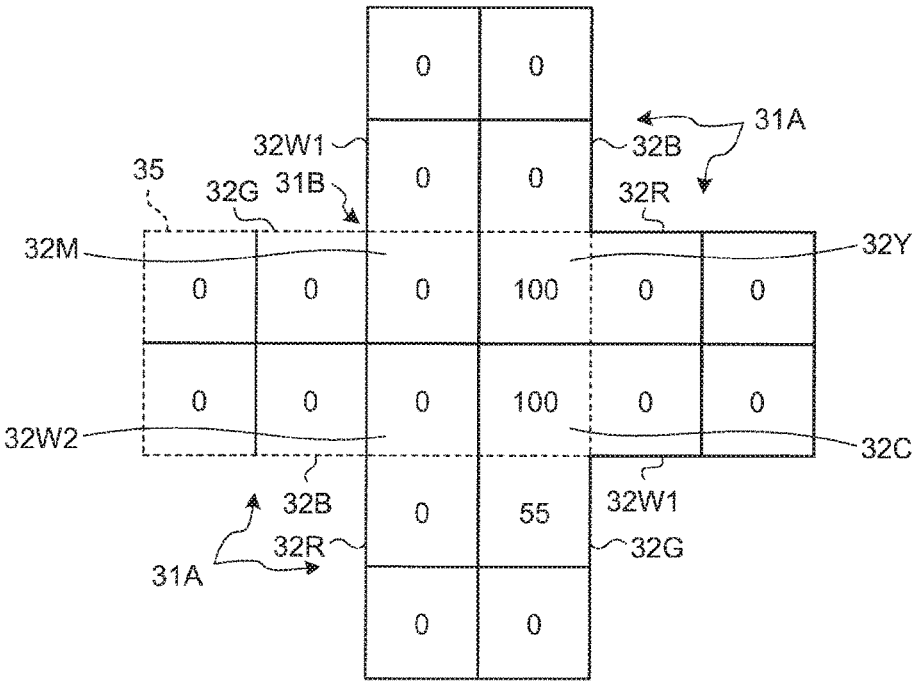
FIG. 52 is a diagram illustrating an example of a case in which the out-of-color gamut component is shifted to one of the sub-pixels included in the first pixel of another group that is present below the second pixel.

When the input image signal corresponding to the second pixel 31B is the input image signal corresponding to the edge of the image, the signal processing unit 21 may cause the out-of-color gamut component not to be reflected in the output of one of the sub-pixels 32 of the first pixel 31A that is not adjacent to one of the sub-pixels 32 of the second pixel 31B in which light is output, through another processing method. Specifically, in the image display unit 30 in which the first pixels 31A and the second pixels 31B are arranged in a staggered manner, when the input image signal corresponding to the second pixel 31B included in the group of pixels 35 is the input image signal corresponding to the edge of the image, the signal processing unit 21 may use the out-of-color gamut component corresponding to the second pixel 31B to determine the output of one of the sub-pixels 32 that is adjacent to one of the sub-pixels 32 of the second pixel 31B in which light is output among the sub-pixels 32 included in the first pixel 31A in another group adjacent to the second pixel 31B. The following describes an example of the above case with reference to FIGS. 51 and 52. FIG. 51 is a diagram illustrating an example of a case in which the out-of-color gamut component is shifted to one of the sub-pixels 32 included in the first pixel 31A of another group that is present on the right side of the second pixel 31B. FIG. 52 is a diagram illustrating an example of a case in which the out-of-color gamut component is shifted to one of the sub-pixels 32 included in the first pixel 31A of another group that is present below the second pixel 31B. In the examples illustrated in FIGS. 51 and 52, the input image signal corresponding to all of the first pixels 31A is represented as (R,G,B)=(0,0,0). In the example illustrated in FIG. 51, the input image signal corresponding to the second pixel 31B is represented as (R,G,B)=(255,100,100). In the example illustrated in FIG. 52, the input image signal corresponding to the second pixel 31B is represented as (R,G,B)=(100,255,100).

In the examples illustrated in FIGS. 51 and 52, it is assumed that the arrangement of the pixels 31 is the arrangement of the first pixels 31A and the second pixels 31B illustrated in FIG. 6, one first pixel 31A and one second pixel 31B that is on the right side of the first pixel 31A are handled as the group of pixels 35, the input image signal corresponding to the second pixel 31B is the input image signal of the pixel corresponding to the edge, and the out-of-color gamut component is included in the component of the input image signal corresponding to the second pixel 31B. In this case, when the sub-pixels 32 that are controlled to emit light with components from which the out-of-color gamut component is eliminated among the sub-pixels 32 included in the second pixel 31B are the fifth sub-pixel 32M (100) and the sixth sub-pixel 32Y (100) and the out-of-color gamut component is the red component, as illustrated in FIG. 51, the signal processing unit 21 causes the out-of-color gamut component (55) of the red component to be reflected in the first sub-pixel 32R included in the first pixel 31A (for example, the first pixel 31A present on the right side in FIG. 51) of another group that is adjacent to the right side of the sixth sub-pixel 32Y included in the second pixel 31B. When the sub-pixels 32 that are controlled to emit light with the components from which the out-of-color gamut component is eliminated among the sub-pixels 32 included in the second pixel 31B are the sixth sub-pixel 32Y (100) and the seventh sub-pixel 32C (100) and the out-of-color gamut component is a green component, as illustrated in FIG. 52, the signal processing unit 21 causes the out-of-color gamut component (55) of the green component to be reflected in the second sub-pixel 32G included in the first pixel 31A (for example, the first pixel 31A present on the lower side in FIG. 52) of another group that is adjacent to the lower side of the seventh sub-pixel 32C included in the second pixel 31B. In this way, by causing the out-of-color gamut component to be reflected in the output of the sub-pixels 32 included in the first pixel 31A of another group that is adjacent to one of the sub-pixels 32 of the second pixel 31B in which light is output, color extension can be performed with higher accuracy while minimizing edge deviation. Similarly, for example, when the sixth sub-pixel 32Y is included in the sub-pixels 32 that are controlled to emit light with the components from which the out-of-color gamut component is eliminated among the sub-pixels 32 included in the second pixel 31B and the out-of-color gamut component is the blue component, the signal processing unit 21 can also cause the out-of-color gamut component of the blue component to be reflected in the third sub-pixel 32B included in the first pixel 31A of another group present on the upper side of the second pixel 31B.

Figure 53:
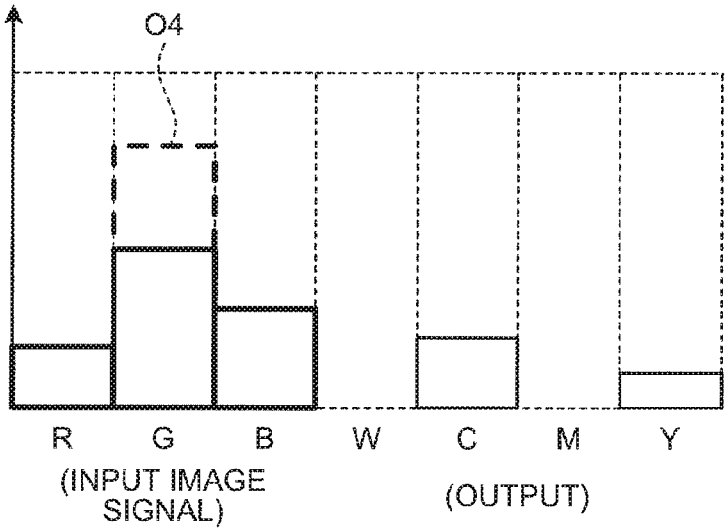
FIG. 53 is a diagram illustrating an example of the components, the out-of-color gamut component, and the output of the input image signal of the second pixel corresponding to an edge.

When the input image signal corresponding to the second pixel 31B included in the group of pixels 35 is the input image signal corresponding to the edge of the image, the signal processing unit 21 may determine the output of the sub-pixels 32 included in the first pixel 31A within a range in which the saturation and the luminance are not reversed between the second pixel 31B and the first pixel 31A in which the out-of-color gamut component of the second pixel 31B is reflected, and rotation of the hue is not caused. The rotation of the hue may be caused when a color for determining the hue to be the strongest in a case in which the out-of-color gamut component is not reflected in the first pixel 31A is different from a color for determining the hue to be the strongest in a case in which the out-of-color gamut component is reflected in the first pixel 31A. The following describes an example of the above case with reference to FIGS. 53 to 56. FIG. 53 is a diagram illustrating an example of the components, the out-of-color gamut component, and the output of the input image signal of the second pixel 31B corresponding to the edge. As a premise of this example, as illustrated in FIG. 53, the out-of-color gamut component and the output (C, M, Y) of the sub-pixels 32 included in the second pixel 31B are determined according to the components of the input image signal corresponding to the second pixel 31B. Among the components of red (R), green (G), and blue (B) as the components of the input image signal illustrated in FIG. 53, the component in which the out-of-color gamut component is generated is the green component (green (G)). In FIGS. 53 to 56, the out-of-color gamut component is denoted by a reference sign O4.

Figure 54:
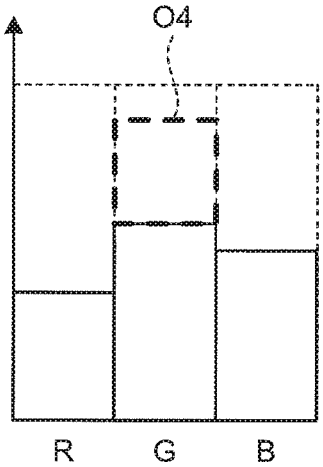
FIG. 54 is a diagram illustrating an example of the components of the input image signal of the first pixel in which a high and low relation of saturation may be reversed between the first pixel and the second pixel when the out-of-color gamut component is shifted.

FIG. 54 is a diagram illustrating an example of the components of the input image signal of the first pixel 31A in which a high and low relation of saturation may be reversed between the first pixel 31A and the second pixel 31B when the out-of-color gamut component is shifted. The following describes a case in which the component of the input image signal corresponding to the first pixel 31A in which the out-of-color gamut component illustrated in FIG. 53 is reflected is the component illustrated in FIG. 54. In this case, a component having the highest saturation is the green component in the first pixel 31A and the second pixel 31B. When the green component is compared with the green component before the out-of-color gamut component is shifted, the component of the input image signal corresponding to the second pixel 31B is larger than the component of the input image signal corresponding to the first pixel 31A. That is, the saturation of the second pixel 31B is higher than that of the first pixel 31A before the out-of-color gamut component is shifted. On the other hand, when the green component is compared with the green component after all of the out-of-color gamut components are shifted, the component of the input image signal corresponding to the second pixel 31B is smaller than the component of the input image signal corresponding to the first pixel 31A. That is, assuming that all of the out-of-color gamut components are shifted, the saturation of the second pixel 31B is lower than that of the first pixel 31A. In this way, when the high and low relation of saturation is reversed between the first pixel 31A and the second pixel 31B in a case in which all of the components included in the out-of-color gamut components are shifted, the signal processing unit 21 determines the output of the sub-pixels 32 included in the first pixel 31A within a range in which the high and low relation of saturation is not reversed. Specifically, the green component in the first pixel 31A may be enhanced within a range smaller than the green component in the second pixel 31B from which the out-of-color gamut component is subtracted, or all of the out-of-color gamut components may be discarded.

Figure 55:
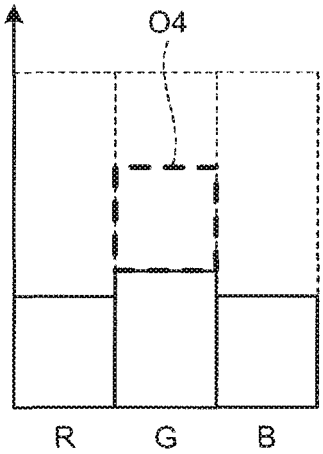
FIG. 55 is a diagram illustrating an example of the components of the input image signal of the first pixel in which a high and low relation of luminance may be reversed between the first pixel and the second pixel when the out-of-color gamut component is shifted.

FIG. 55 is a diagram illustrating an example of the components of the input image signal of the first pixel 31A in which a high and low relation of luminance or relation of luminance intensity may be reversed between the first pixel 31A and the second pixel 31B when the out-of-color gamut component is shifted. The following describes a case in which the component of the input image signal corresponding to the first pixel 31A in which the out-of-color gamut component illustrated in FIG. 53 is reflected is the component illustrated in FIG. 55. Regarding the luminance caused by the components of the input image signals of the first pixel 31A and the second pixel 31B before the out-of-color gamut component is shifted, the luminance of the second pixel 31B is higher than that of the first pixel 31A. On the other hand, regarding the luminance of the first pixel 31A and the second pixel 31B after all of the out-of-color gamut components are shifted, the luminance of the second pixel 31B is lower than that of the first pixel 31A. In this way, when the high and low relation of luminance is reversed between the first pixel 31A and the second pixel 31B in a case in which all of the components included in the out-of-color gamut component are shifted, the signal processing unit 21 determines the output of the sub-pixels 32 included in the first pixel 31A within a range in which the high and low relation of luminance is not reversed. Specifically, the out-of-color gamut component may be reflected within a range in which the luminance of the first pixel 31A can be caused to be less than the luminance of the second pixel 31B that has been reduced by subtracting the out-of-color gamut component, or all of the out-of-color gamut components may be discarded.

Figure 56:
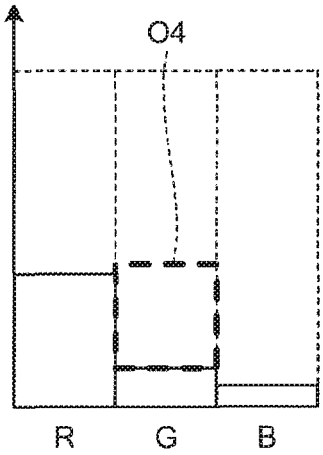
FIG. 56 is a diagram illustrating an example of the components of the input image signal of the first pixel in which a hue may be rotated in the first pixel when the out-of-color gamut component is shifted.

FIG. 56 is a diagram illustrating an example of the components of the input image signal of the first pixel 31A in which the hue may be rotated in the first pixel 31A when the out-of-color gamut component is shifted. The following describes a case in which the component of the input image signal corresponding to the first pixel 31A in which the out-of-color gamut component illustrated in FIG. 53 is reflected is the component illustrated in FIG. 56. In this case, among colors of the input image signal components corresponding to the first pixel 31A before the out-of-color gamut component is shifted, a color having the highest saturation is red. On the other hand, among the colors of the components after all of the out-of-color gamut components are shifted, the color having the highest saturation is the color of the out-of-color gamut component (green). That is, when all of the out-of-color gamut components are shifted, the hue is rotated because the color for determining the hue to be the strongest when the out-of-color gamut component is not reflected and the color for determining the hue to be the strongest when the out-of-color gamut component is reflected in the first pixel 31A are changed. The signal processing unit 21 determines the output of the sub-pixels 32 included in the first pixel 31A within a range in which such rotation of the hue is not caused. Specifically, the out-of-color gamut component may be reflected within a range in which the color for determining the hue to be the strongest before and after the out-of-color gamut component is reflected, or all of the out-of-color gamut components may be discarded.

The example described above with reference to FIGS. 53 to 56 is merely an example. The input image signal components and the out-of-color gamut components of the first pixel 31A and the second pixel 31B are not limited to the examples in FIGS. 53 to 56. The mechanism described above with reference to FIGS. 53 to 56 may be applied to other input image signals and out-of-color gamut components.

When the input image signal corresponding to the second pixel 31B is the input image signal corresponding to the edge of the image, the signal processing unit 21 may cause the out-of-color gamut component not to be reflected in the output of the sub-pixels 32 included in each of the first pixel 31A and the second pixel 31B. That is, at the time when the input image signal corresponding to the second pixel 31B is determined to be the input image signal corresponding to the edge of the image, the signal processing unit 21 may discard the out-of-color gamut component in the second pixel 31B so as not to be reflected in the output of any of the pixels. Accordingly, edge deviation can be prevented through simpler processing.

When the input image signal corresponding to the second pixel 31B is not the input image signal corresponding to the edge of the image, the signal processing unit 21 determines the output of the sub-pixels 32 included in each of the first pixel 31A and the second pixel 31B through the processing described with reference to FIGS. 13 to 44. That is, when the input image signal corresponding to the second pixel 31B is not the input image signal corresponding to the edge of the image, the signal processing unit 21 determines the output of the sub-pixels 32 included in the first pixel 31A based on a combined component of the first component as the components of the input image signal corresponding to the first pixel 31A and the out-of-color gamut component the color of which cannot be extended with the sub-pixels 32 included in the second pixel 31B in the input image signal corresponding to the adjacent second pixel 31B, and determines the output of the sub-pixels 32 included in the second pixel 31B based on the third component obtained by eliminating the out-of-color gamut component from the second component as the components of the input image signal corresponding to the second pixel 31B. More specifically, for example, the signal processing unit 21 performs processing related to the group of pixels 35. The processing related to the group of pixels 35 means processing for determining, when one first pixel 31A and one second pixel 31B are assumed to be the group of pixels 35 and the input image signal corresponding to the second pixel 31B is not the input image signal corresponding to the edge of the image, the output of the sub-pixels 32 included in the first pixel 31A based on a combined component of the first component and the out-of-color gamut component corresponding to the second pixel 31B included in the group of pixels 35 among the components of the input image signal corresponding to the group of pixels 35, and determining the output of the sub-pixels 32 included in the second pixel 31B in the group of pixels 35 based on the third component corresponding to the group of pixels 35 obtained by eliminating the out-of-color gamut component from the second component among the components of the input image signal corresponding to the group of pixels 35. The signal processing unit 21 may also perform at least one or more of pieces of other related processing. The other related processing includes: processing related to the luminance adjustment component; processing for preferentially converting the component of the image input signal into white, processing for preferentially converting the component of the image input signal into a color other than white, or a combination thereof; processing of distributing part of the components having been converted into white to components other than white; processing for further reducing visibility of the line in a specific direction in the display area A that may be generated when the input image signal includes a component corresponding to a specific color, and the like as described above.

Figure 57:
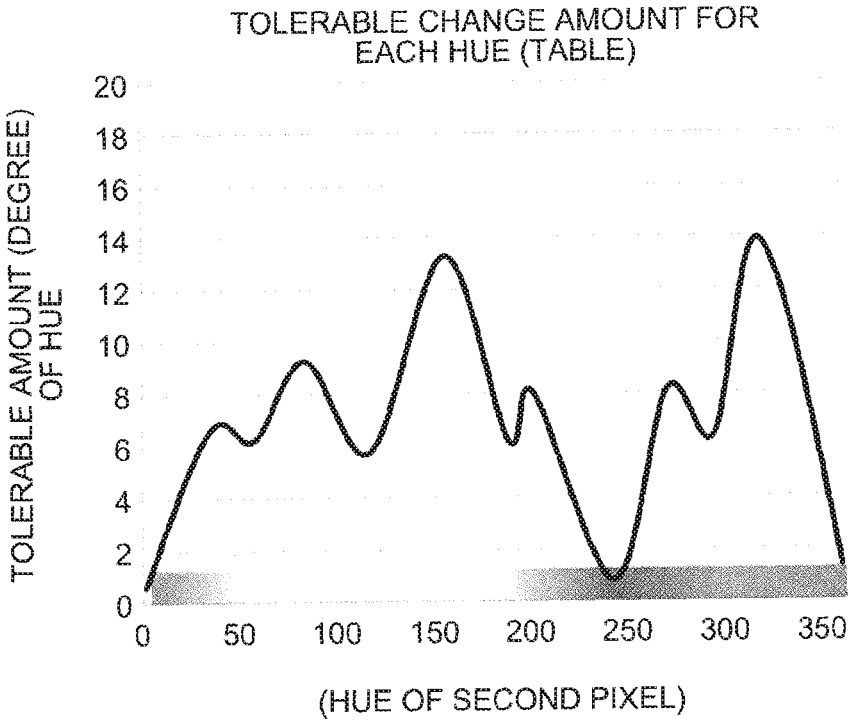
FIG. 57 is a diagram illustrating an example of a relation between the hue and a tolerable amount of the hue illustrated in a table used for detecting a pixel corresponding to the edge.

Next, the following describes content of determination processing performed by the edge determination unit 22, that is, a method of detecting the input image signal corresponding to the edge. In this description, assuming that two first pixels 31A are present to hold one second pixel 31B therebetween in the row direction, described is a method of determining whether the input image signal corresponding to the second pixel 31B corresponds to the edge. FIG. 57 is a diagram illustrating an example of a relation between the hue and a tolerable amount of the hue illustrated in a table used for detecting the pixel corresponding to the edge. The edge determination unit 22 calculates the hue indicated by the component of the input image signal corresponding to the second pixel 31B based on the following Expression 1, for example. In Expression 1, H indicates the hue. R, G, and B correspond to the respective values in the component (R,G,B) of the input image signal. MIN indicates the minimum value among the values in the component (R,G,B) of the input image signal. MAX indicates the maximum value among the values in the component (R,G,B) of the input image signal. Subsequently, the edge determination unit 22 refers to and acquires a value of the tolerable amount of the hue (HT) corresponding to the calculated hue of the second pixel 31B with reference to the table indicating the relation between the hue and the tolerable amount of the hue illustrated in FIG. 57. The edge determination unit 22 then calculates the hue indicated by the component of the input image signal corresponding to one of the first pixels 31A adjacent to the second pixel 31B in the row direction based on the following Expression 1. The edge determination unit 22 calculates, as ΔH1, an absolute value of a value obtained by subtracting the hue of the one of the first pixels 31A from the calculated hue of the second pixel 31B. Thereafter the edge determination unit 22 calculates a first determination value by dividing ΔH1 by HT. The edge determination unit 22 then calculates the hue indicated by the component of the input image signal corresponding to the other one of the first pixels 31A adjacent to the second pixel 31B in the row direction based on the following Expression 1. The edge determination unit 22 calculates, as ΔH2, an absolute value of a value obtained by subtracting the hue of the other one of the first pixels 31A from the calculated hue of the second pixel 31B. Thereafter the edge determination unit 22 calculates a second determination value by dividing ΔH2 by HT. The edge determination unit 22 adopts a larger value between the first determination value and the second determination value as a determination value. The edge determination unit 22 specifies the tolerable amount of the hue corresponding to the hue of the second pixel 31B based on the table indicating the relation between the hue and the tolerable amount of the hue illustrated in FIG. 57. The edge determination unit 22 determines whether the input image signal corresponds to the edge based on a comparison result between the determination value and the tolerable amount of the hue. For example, if the determination value exceeds the tolerable amount of the hue, the edge determination unit 22 determines that the input image signal corresponding to the second pixel 31B corresponds to the edge. On the other hand, if the determination value is equal to or smaller than the tolerable amount of the hue, the edge determination unit 22 determines that the input image signal corresponding to the second pixel 31B does not correspond to the edge. The graph depicted in FIG. 57 represents a typical tolerable amount ratio based on human sensibilities. Accordingly, regarding the obtained determination value, a tolerable amount for a human is already taken into account. The edge determination method according to the embodiment is not limited to using the table of a tolerable property of a human as it is. The determination may be performed while adjusting a level. Specifically, first, the determination value is calculated using data to which a tolerable value as illustrated in FIG. 57 is added, and then the edge is determined according to a relation between the determination value and a value based on the tolerable amount of the hue and a reference value. The reference value is a coefficient with respect to the tolerable amount of the hue. When the table of the tolerable value is directly reflected in the result, the reference value is 1.0 (equal magnification). To strictly perform determination as compared with the tolerable value table, the reference value is set to be lower. To loosely perform determination as compared with the tolerable value table, the reference value is set to be higher.

$$H = \begin{cases} \text{undefinded}, & \text{if MIN} = \text{MAX} \\ 60 \times \dfrac{G-R}{\text{MAX}-\text{MIN}} + 60, & \text{if MIN} = B \\ 60 \times \dfrac{B-G}{\text{MAX}-\text{MIN}} + 180, & \text{if MIN} = R \\ 60 \times \dfrac{R-B}{\text{MAX}-\text{MIN}} + 300, & \text{if MIN} = G \end{cases} \quad (1)$$

The edge can be detected based on the luminance. The edge determination unit 22 calculates the luminance of the component from the component of the input image signal corresponding to the second pixel 31B. Specifically, the edge determination unit 22 calculates the luminance from a luminance ratio of the components of red (R), green (G), and blue (B) as the components of the input image signal. The luminance ratio indicates luminance corresponding to an amount of components. The edge determination unit 22 calculates the luminance of the components of the input image signal corresponding to two first pixels 31A that are present to hold one second pixel 31B therebetween in the row direction. The edge determination unit 22 calculates a difference or a ratio between the luminance of the component of the input image signal corresponding to the second pixel 31B and the luminance of the components of the input image signals corresponding to the two first pixels 31A. The edge determination unit 22 compares a larger luminance difference (or luminance ratio) with a predetermined reference value of a difference (or ratio) of the luminance, and determines whether the input image signal corresponding to the second pixel 31B corresponds to the edge according to the comparison result. For example, if the calculated value is larger than the reference value, the edge determination unit 22 determines that the input image signal corresponding to the second pixel 31B corresponds to the edge. On the other hand, if the calculated value is equal to or smaller than the reference value, the edge determination unit 22 determines that the input image signal corresponding to the second pixel 31B does not correspond to the edge.

The edge can also be detected based on the saturation. For example, if a difference between the saturation of the component of the input image signal corresponding to the second pixel 31B and the saturation of the components of the input image signals corresponding to the two first pixels 31A that are present to hold the second pixel 31B therebetween in the row direction is smaller than the predetermined reference value, the edge determination unit 22 may determine that the input image signal corresponding to the second pixel 31B does not correspond to the edge.

In the method of detecting the edge described above, the edge determination unit 22 determines whether the input image signal corresponding to the second pixel 31B in the row direction corresponds to the edge. Alternatively, the same determination may be performed for the first pixel 31A adjacent to the second pixel 31B in the column direction. Regardless of the above processing, if one of the first pixel 31A and the second pixel 31B is a monochrome pixel (white—(gray scale)—black, not having a hue) and the other pixel is a color pixel (having a hue), the edge determination unit 22 determines that the first pixel 31A and the second pixel 31B correspond to the edge. If the first pixel 31A and the second pixel 31B are monochrome pixels, the edge determination unit 22 determines that the first pixel 31A and the second pixel 31B do not correspond to the edge (determination is not required because each of the pixels has a W sub-pixel). The edge determination unit 22 determines whether the input image signal corresponding to the second pixel 31B is the input image signal corresponding to the edge of the image based on the determination result obtained by any one of the methods including the method of detecting the edge described above or a combination thereof. These methods can also be used for detecting whether the input image signal corresponding to the first pixel 31A is the edge.

In the pixel corresponding to the edge, when part or all of the out-of-color gamut components are discarded, the luminance corresponding to the discarded out-of-color gamut components is lost from the second pixel 31B. The luminance corresponding to the out-of-color gamut component reflected in the first pixel 31A of another group among the out-of-color gamut components of the pixel corresponding to the edge is subtracted from the second pixel 31B, and the luminance corresponding to the out-of-color gamut component is increased in the first pixel 31A of this group. To reduce the luminance difference between the second pixel 31B and the first pixel 31A adjacent to the second pixel 31B caused as described above, component adjustment may be performed to shift the luminance from the first pixel 31A to the second pixel 31B. Specifically, for example, the signal processing unit 21 may determine the output of the sub-pixels 32 of each of the first pixel 31A and the second pixel 31B using the luminance adjustment component described above to reduce the luminance difference.

In FIG. 57 and Expression 1, the hue is based on an HSV color space. However, a color space for determining the hue is not limited to the HSV space in the present invention. For example, an angle from white (W) in an xy chromaticity diagram of XYZ color system or a U-star V-star (u*v*) color space may be used.

Figure 58:
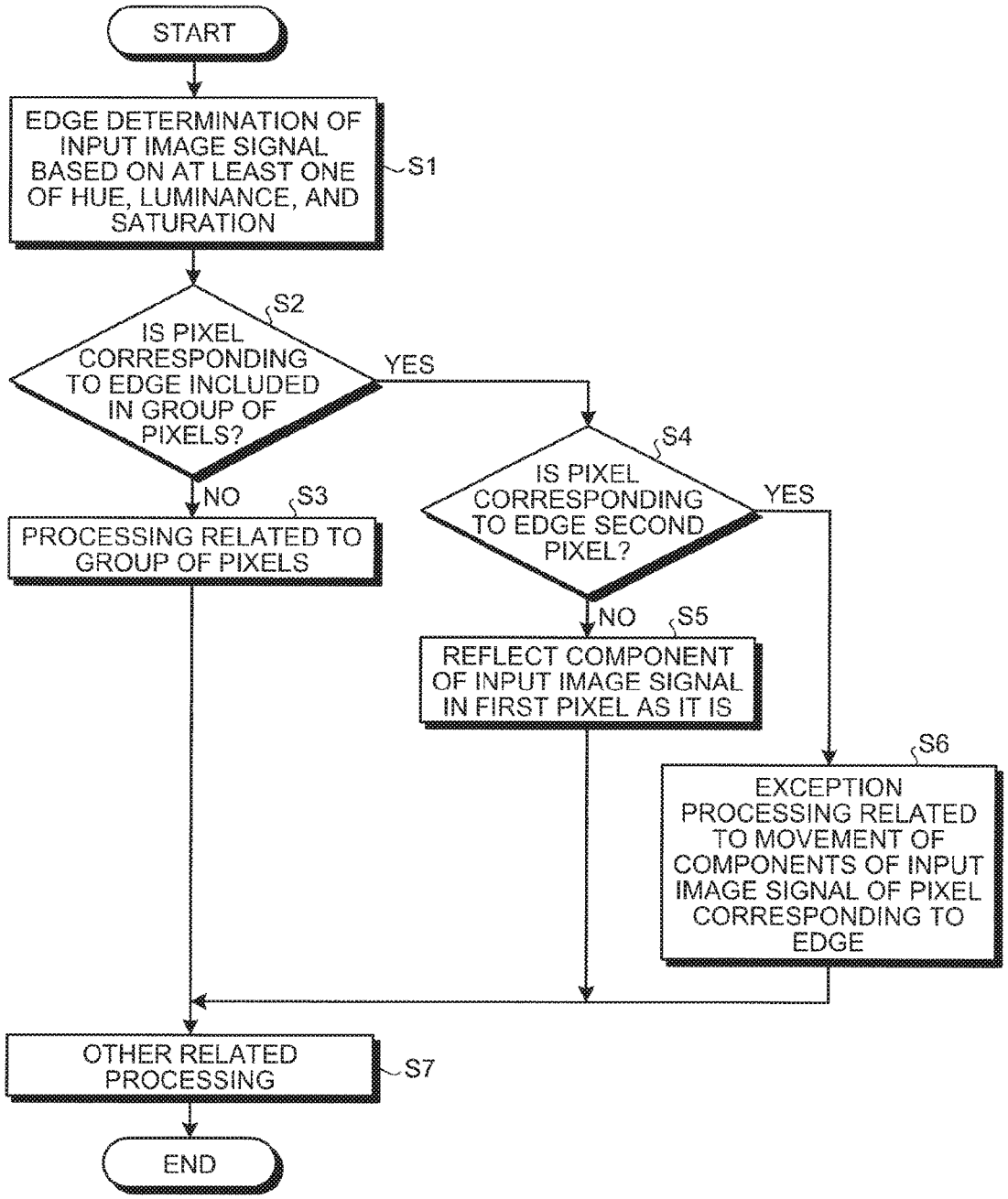
FIG. 58 is a flowchart illustrating an example of a processing procedure for an edge of an image.

Next, the following describes an example of a processing procedure related to the edge of the image with reference to FIG. 58. FIG. 58 is a flowchart illustrating an example of a processing procedure for the edge of the image. The edge determination unit 22 determines whether the input image signal corresponding to each pixel 31 corresponds to the edge based on at least one of the hue, the luminance, and the saturation (Step S1). If it is determined that both of the pixels in the group of pixels 35 do not correspond to the edge (No at Step S2), the signal processing unit 21 performs processing related to the group of pixels 35 on the group of pixels 35 (Step S3). On the other hand, if it is determined that the input image signal corresponding to any of the pixels included in the group of pixels 35 corresponds to the edge (Yes at Step S2), the edge determination unit 22 determines whether the input image signal determined to correspond to the edge corresponds to the second pixel 31B (Step S4). If the input image signal does not correspond to the second pixel 31B, that is, if the input image signal corresponds to the first pixel 31A (No at Step S4), the signal processing unit 21 causes the components of the input image signal to be reflected in the first pixel 31A (Step S5). If the input image signal corresponds to the second pixel 31B (Yes at Step S4), the signal processing unit 21 performs exception processing related to movement of part or all of the components on the components of the input image signal of the pixel corresponding to the edge (Step S6). Specifically, the exception processing is any of the pieces of the processing described with reference to FIG. 47, FIG. 51, FIG. 52, or FIG. 53 to FIG. 56, for example. After the processing at Step S3, Step S5, or Step S6, the signal processing unit 21 may perform at least one or more of the pieces of other related processing (Step S7).

Figure 59:
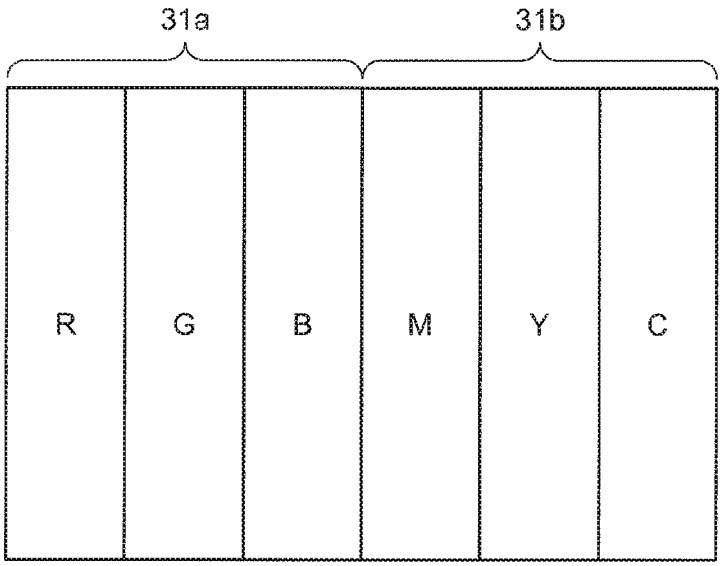
FIG. 59 is a diagram illustrating an example of an arrangement of sub-pixels included in each of the first pixel and the second pixel according to a modification.
Figure 60:
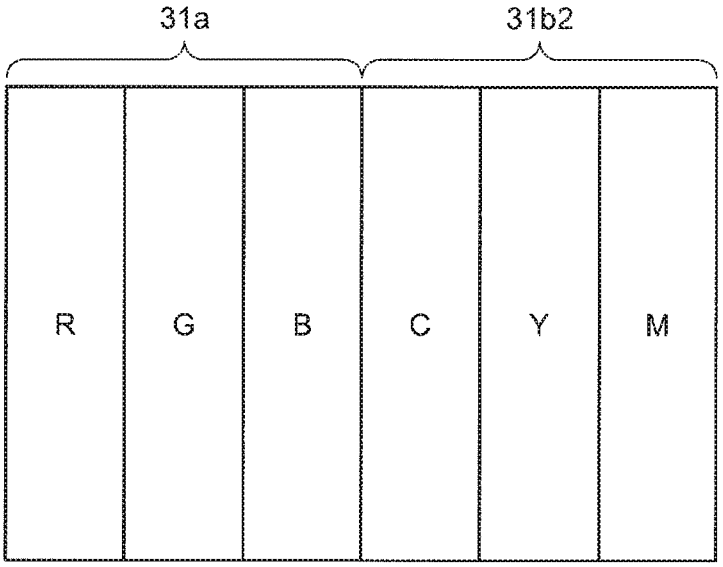
FIG. 60 is a diagram illustrating another example of the arrangement of the sub-pixels included in each of the first pixel and the second pixel.

As illustrated in FIG. 3 and FIG. 4, for example, the pixel 31 according to the embodiment has a square shape, and the sub-pixels 32 are arranged in a two-dimensional matrix (rows and columns) in each pixel 31. However, this arrangement is merely an example of an aspect of the pixel 31 and the sub-pixels 32, and the embodiment is not limited thereto. For example, the pixel 31 may include a plurality of sub-pixels 32 arranged to partition the pixel in a stripe shape. The number of sub-pixels included in one pixel 31 is not limited to four. The pixel 31 does not necessarily include the white sub-pixel. The following describes a modification of the present invention with reference to FIGS. 59 to 76. FIG. 59 is a diagram illustrating an example of the arrangement of the sub-pixels included in each of a first pixel 31*a* and a second pixel 31*b* according to the modification. FIG. 60 is a diagram illustrating another example of the arrangement of the sub-pixels included in each of the first pixel 31*a* and a second pixel 31*b*2. Specifically, as illustrated in FIG. 59 and FIG. 60, for example, the image display unit 30 may include the first pixel 31*a* including stripe-shaped sub-pixels of red (R), green (G), and blue (B), and the second pixel 31*b* including stripe-shaped sub-pixels of cyan (C), magenta (M), and yellow (Y). The arrangement of the stripe-shaped sub-pixels is optional. In the example illustrated in FIG. 59, the sub-pixels in each pixel are arranged so that a rotation order of the hue in the arrangement of the sub-pixels included in the first pixel 31*a* is identical to a rotation order of the hue in the arrangement of the sub-pixels included in the second pixel 31*b*. In the example illustrated in FIG. 60, the sub-pixels in each pixel are arranged so that a luminance order in the arrangement of the sub-pixels included in the first pixel 31*a* is identical to a luminance order in the arrangement of the sub-pixels included in the second pixel 31*b*2. FIG. 59 and FIG. 60 illustrate the examples of the pixels including the sub-pixels arranged to draw stripes in a vertical direction. Alternatively, the stripes may be drawn in a horizontal direction. In a case of the sub-pixels that are not arranged in two rows and two columns as described above, a line in the oblique direction is not generated. In other words, the line in the oblique direction can be prevented from being generated due to the shape of the sub-pixel. Even in the arrangement of two rows and two columns, the line in the oblique direction can be reduced by causing the sub-pixels in each pixel to be closer to the center of the pixel.

Figure 61:
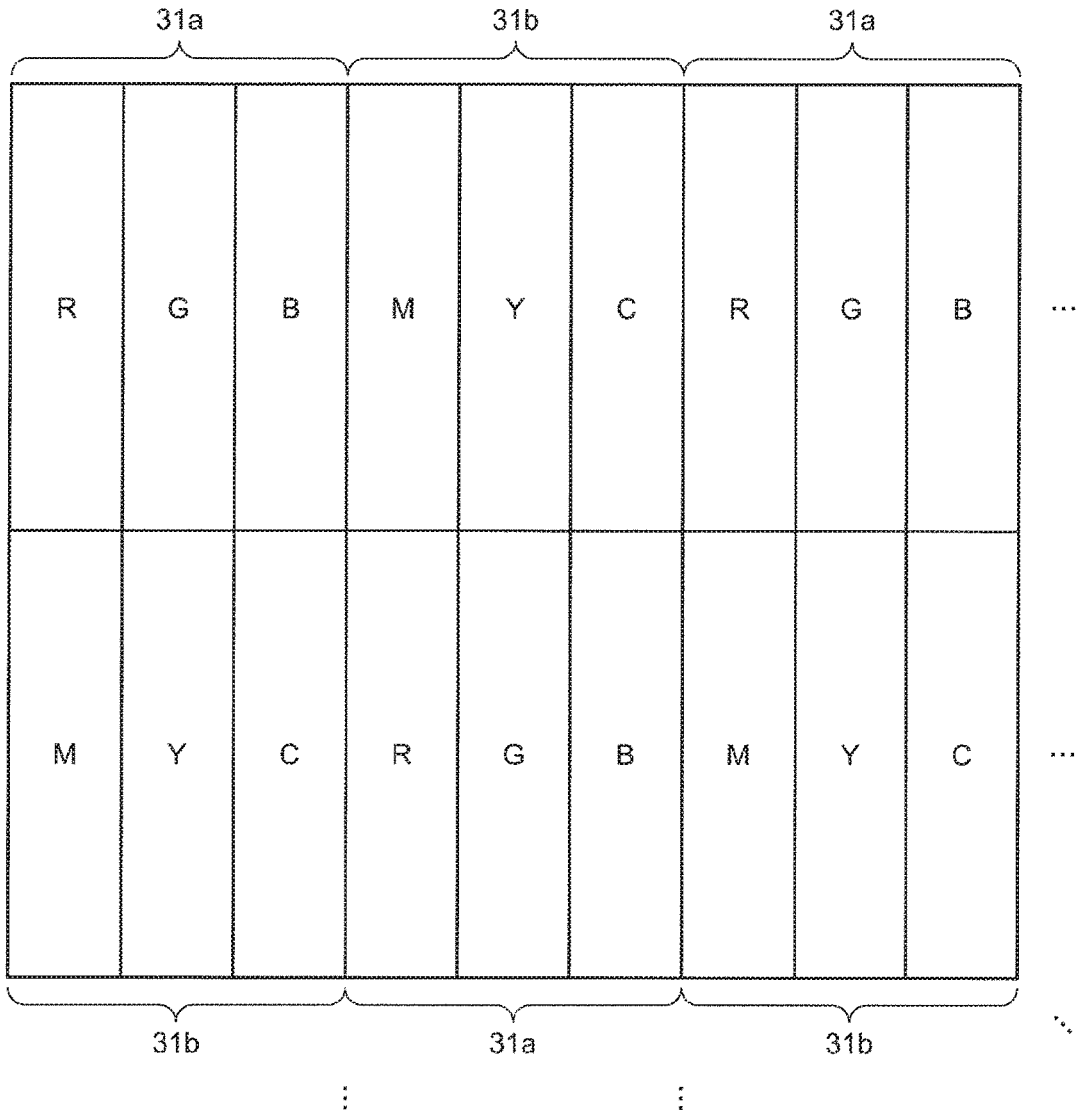
FIG. 61 is a diagram illustrating an example of a positional relation between the first pixel and the second pixel and the arrangement of the sub-pixels included in each of the first pixel and the second pixel according to the modification.
Figure 62:
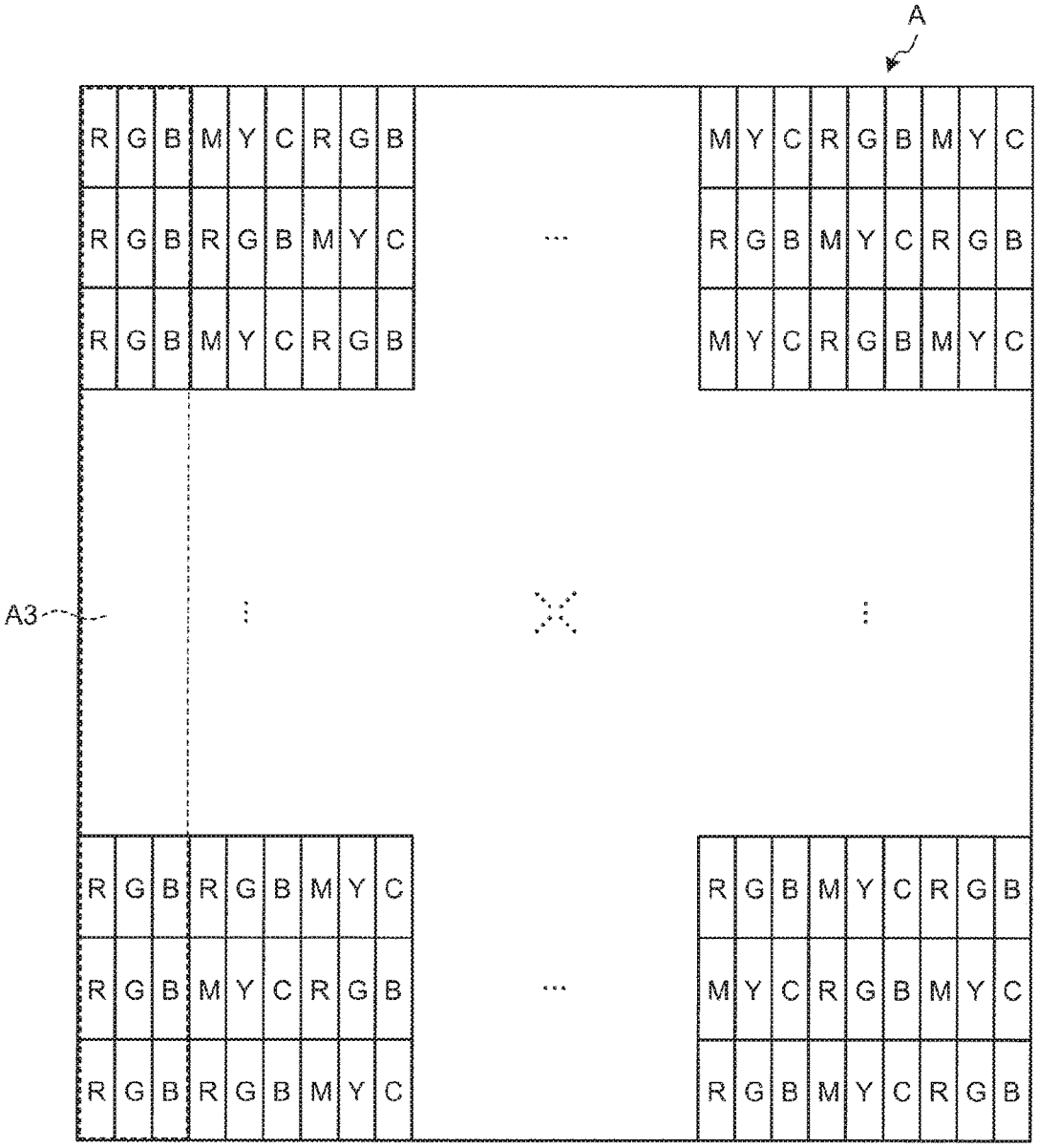
FIG. 62 is a diagram illustrating an example of the display area in which pixels adjacent to one side are the first pixels according to the modification.
Figure 63:
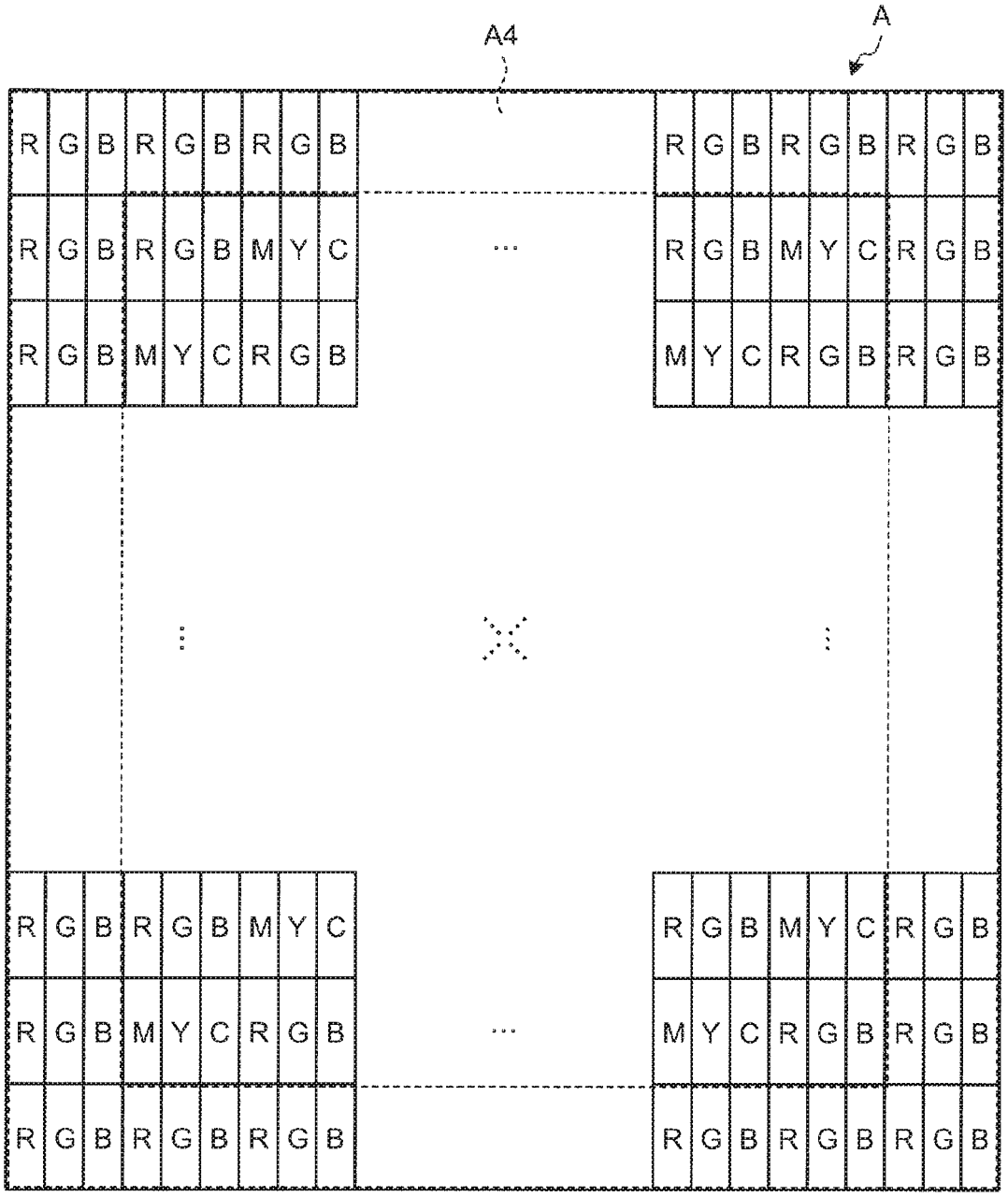
FIG. 63 is a diagram illustrating an example of the display area in which pixels adjacent to four sides are the first pixels according to the modification.

FIG. 61 is a diagram illustrating an example of a positional relation between the first pixel 31*a* and the second pixel 31*b* and the arrangement of the sub-pixels included in each of the first pixel 31*a* and the second pixel 31*b* according to the modification. FIG. 62 is a diagram illustrating an example of the display area A in which pixels adjacent to one side are the first pixels 31*a* according to the modification. FIG. 63 is a diagram illustrating an example of the display area A in which pixels adjacent to four sides are the first pixels 31*a* according to the modification. When the sub-pixels are arranged in a stripe shape or one pixel includes three sub-pixels as illustrated in FIG. 61, similarly to the pixel including the sub-pixels arranged in two rows and two columns, the second pixels 31*b* may be arranged in a staggered manner. As represented by a region A3 adjacent to the side in FIG. 62 and a region A4 adjacent to the side in FIG. 63, the pixels adjacent to at least one side of the display area A may be the first pixels 31*a*. The arrangements of the pixels illustrated in FIGS. 61 to 63 and processing performed by the signal processing unit 21 described below can also be applied to the second pixel 31*b*2, and to a first pixel and a second pixel having another arrangement of the sub-pixels 32.

Figure 64:
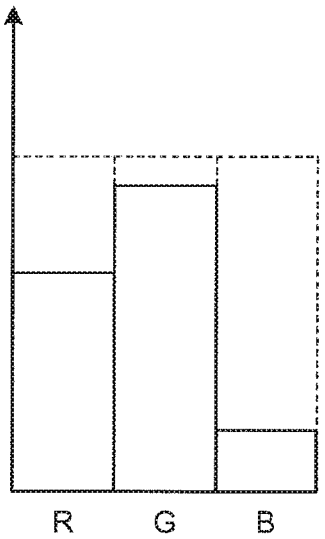
FIG. 64 is a diagram illustrating another example of the components of the input image signal corresponding to the second pixel.

With reference to FIGS. 64 to 72, the following describes processing based on the input image signal performed by the signal processing unit 21 in a case in which one pixel includes three sub-pixels. FIG. 64 is a diagram illustrating another example of the components of the input image signal corresponding to the second pixel 31*b*. In the description with reference to FIGS. 64 to 72, described is a case in which the input image signal corresponding to the second pixel 31*b* is the input image signal indicating the components of red (R), green (G), and blue (B) as illustrated in FIG. 64.

Figure 65:
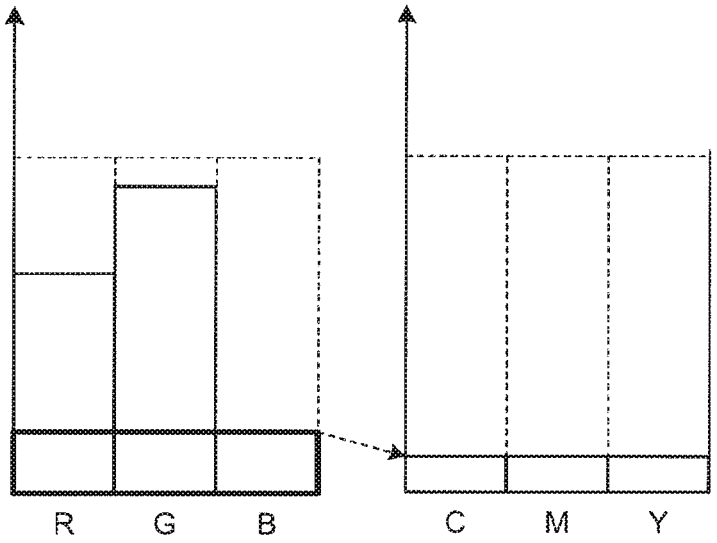
FIG. 65 is a diagram illustrating an example of processing for converting the components of red (R), green (G), and blue (B) into components of cyan (C), magenta (M), and yellow (Y)
Figure 66:
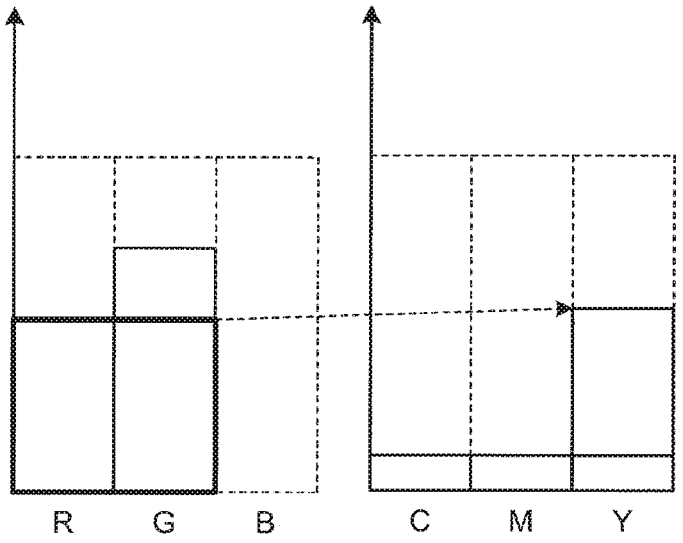
FIG. 66 is a diagram illustrating another example of processing for converting the components of red (R) and green (G) into the component of yellow (Y)
Figure 67:
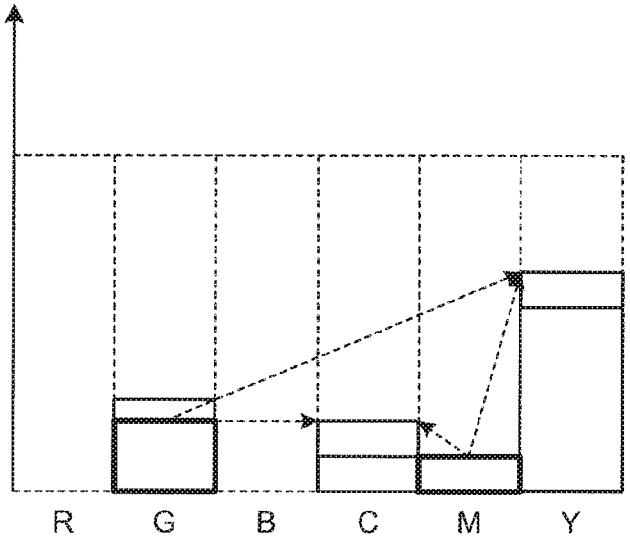
FIG. 67 is a diagram illustrating an example of processing for converting the components of green (G) and magenta (M) into the components of cyan (C) and yellow (Y)
Figure 68:
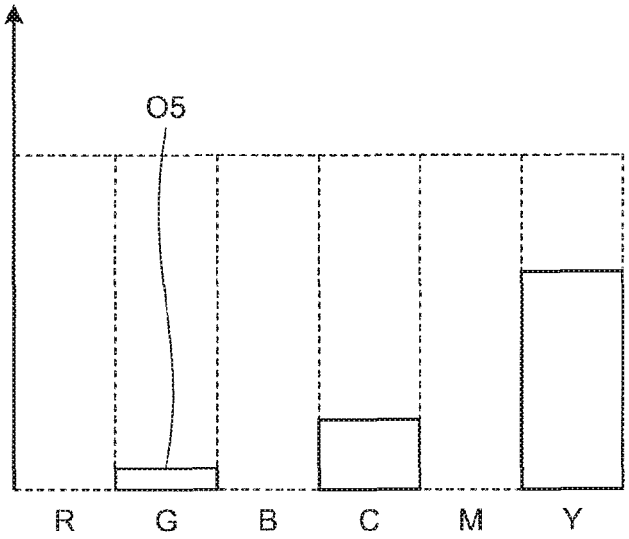
FIG. 68 is a diagram illustrating an example of the components corresponding to the output of the second pixel and the out-of-color gamut component according to the modification.
Figure 70:
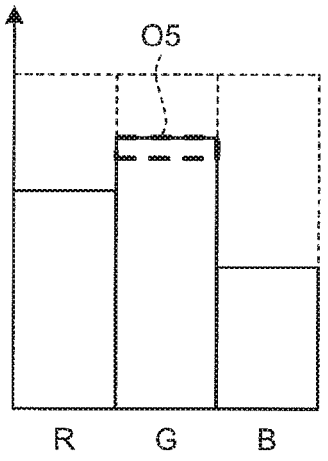
FIG. 70 is a diagram illustrating an example of the components corresponding to the output of the first pixel in which the out-of-color gamut component is added to the component of the input image signal illustrated in FIG. 69.

First, the following describes processing related to determination of an output of the sub-pixels included in the second pixel 31*b*. FIG. 65 is a diagram illustrating an example of processing for converting the components of red (R), green (G), and blue (B) into the components of cyan (C), magenta (M), and yellow (Y). FIG. 66 is a diagram illustrating another example of processing for converting the components of red (R) and green (G) into the component of yellow (Y). FIG. 67 is a diagram illustrating an example of processing for converting the components of green (G) and magenta (M) into the components of cyan (C) and yellow (Y). FIG. 68 is a diagram illustrating an example of the components corresponding to the output of the second pixel 31*b* and the out-of-color gamut component according to the modification. The signal processing unit 21 performs processing for converting the components that can be extended with the colors of the sub-pixels included in the second pixel 31*b* among the components of the input image signal corresponding to the second pixel 31*b* into the colors of the sub-pixels included in the second pixel 31*b*. Specifically, as illustrated in FIG. 65 for example, the signal processing unit 21 extracts, from the components of red (R), green (G), and blue (B), an amount of components corresponding to an amount of components the saturation of which is the smallest (in a case of FIG. 65, blue (B)) among the components of red (R), green (G), and blue (B) as the components of the input image signal corresponding to the second pixel 31*b*, and converts the components into the components of cyan (C), magenta (M), and yellow (Y), respectively. The signal processing unit 21 then extracts, from the components of red (R) and green (G), an amount of components corresponding to a smaller amount of components (in a case of FIG. 66, red (R)) among the components of red (R) and green (G) that are not converted in the description with reference to FIG. 65 as the components of the input image signal corresponding to the second pixel 31*b*, and converts the components into a color corresponding to the combination of the components (in the case of FIG. 66, yellow (Y)). The signal processing unit 21 uses part or all of the components (in a case of FIG. 67, green (G)) that are not converted among the components of the input image signal corresponding to the second pixel 31*b* and the component converted into a complementary color (in the case of FIG. 67, magenta (M)) that does not use the above component and is the color of one of the sub-pixels included in the second pixel 31*b* at a ratio of 2:1, and converts the components into the color of another sub-pixel (in the case of FIG. 67, cyan (C) and yellow (Y)). In the example illustrated in FIG. 67, the component of green (G) and the component of magenta (M) the amount of which is half of the component of green (G) are converted into cyan (C) and yellow (Y). Alternatively, combinations of other colors can be similarly employed. That is, color conversion can be performed based on a relation represented by the following expressions (2) to (4). As a result of the processing described with reference to FIGS. 65 to 67, the components corresponding to the output of the second pixel 31*b* become the components of cyan (C), magenta (M), and yellow (Y) illustrated in FIG. 68, and the component of green (G) becomes the out-of-color gamut component. In FIG. 68 and FIG. 70 described later, the out-of-color gamut component is denoted by a reference sign O5.

$$2R+C=YM \tag{2}$$

$$2G+M=CY \tag{3}$$

$$2B+Y=CM \tag{4}$$

Figure 69:
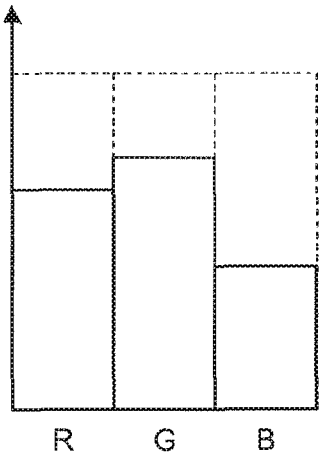
FIG. 69 is a diagram illustrating an example of the components of the input image signal corresponding to the first pixel.

The following describes processing related to determination of the output of the sub-pixels included in the first pixel 31*a*. FIG. 69 is a diagram illustrating an example of the components of the input image signal corresponding to the first pixel 31*a*. FIG. 70 is a diagram illustrating an example of the components corresponding to the output of the first pixel 31*a* in which the out-of-color gamut component is added to the component of the input image signal illustrated in FIG. 69. In the description with reference to FIGS. 69 to 72, described is a case in which the input image signal corresponding to the first pixel 31*a* is the input image signal indicating the components of red (R), green (G), and blue (B) as illustrated in FIG. 69. The signal processing unit 21 synthesizes the component of the input image signal corresponding to the first pixel 31*a* and the out-of-color gamut component. Specifically, as illustrated in FIG. 70 for example, the signal processing unit 21 adds the component of green (G), which is the out-of-color gamut component in FIG. 68, to the component of the input image signal corresponding to the first pixel 31*a*.

Figure 71:
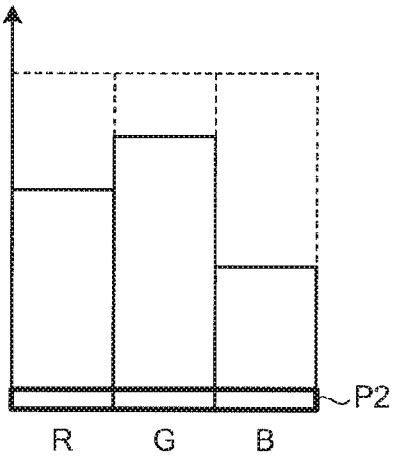
FIG. 71 is a diagram illustrating an example of the components corresponding to the output of the first pixel in which the luminance adjustment component is subtracted from the components illustrated in FIG. 70.
Figure 72:
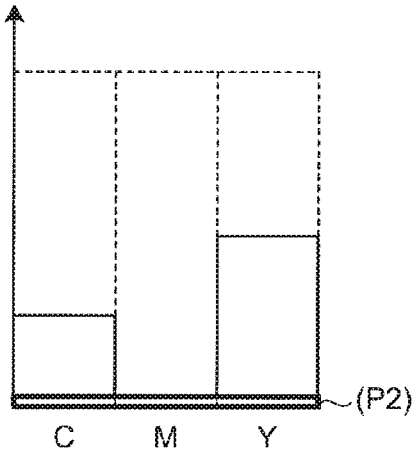
FIG. 72 is a diagram illustrating an example of the components corresponding to the output of the second pixel in which the luminance adjustment component is added to the output components illustrated in FIG. 68.

The signal processing unit 21 can perform luminance adjustment using the luminance adjustment component even when three sub-pixels are included in one pixel. FIG. 71 is a diagram illustrating an example of the components corresponding to the output of the first pixel 31*a* in which the luminance adjustment component is subtracted from the components illustrated in FIG. 70. FIG. 72 is a diagram illustrating an example of the components corresponding to the output of the second pixel 31*b* in which the luminance adjustment component is added to the output components illustrated in FIG. 68. Specifically, the signal processing unit 21 first calculates the luminance added to the first pixel 31*a* by the out-of-color gamut component. Next, the signal processing unit 21 subtracts the component corresponding to the calculated luminance from the component of the first pixel 31*a*. Specifically, as illustrated in FIG. 71 for example, the signal processing unit 21 subtracts the components that can be extended with the second pixel 31*b* (in a case of FIG. 71, the components of red (R), green (G), and blue (B) the amount of which are the same) as the luminance adjustment components to subtract the components corresponding to the luminance added to the first pixel 31*a* by the out-of-color gamut component. The signal processing unit 21 adds, to the components of the second pixel 31*b*, the luminance adjustment component subtracted from the first pixel 31*a*. Specifically, as illustrated in FIG. 72, for example, the signal processing unit 21 increases the components of cyan (C), magenta (M), and yellow (Y) in the components of second pixel 31*b* by an amount of the components of red (R), green (G), and blue (B) subtracted from the components of the first pixel 31*a* in FIG. 71. The luminance adjustment component is denoted by a reference sign P2 in FIG. 71, and an amount of change in the component due to the luminance adjustment component is denoted by (P2) in FIG. 72.

In the example with reference to FIGS. 71 and 72, luminance adjustment is performed by converting the components of red (R), green (G), and blue (B) into the components of cyan (C), magenta (M), and yellow (Y), respectively. However, this luminance adjustment is merely an example, and the embodiment is not limited thereto. For example, components corresponding to two colors among the components of red (R), green (G), and blue (B) may be subtracted from the first pixel as the luminance adjustment components, and a color extended with the two colors may be reflected in the sub-pixels included in the second pixel 31*b*.

Figure 73:
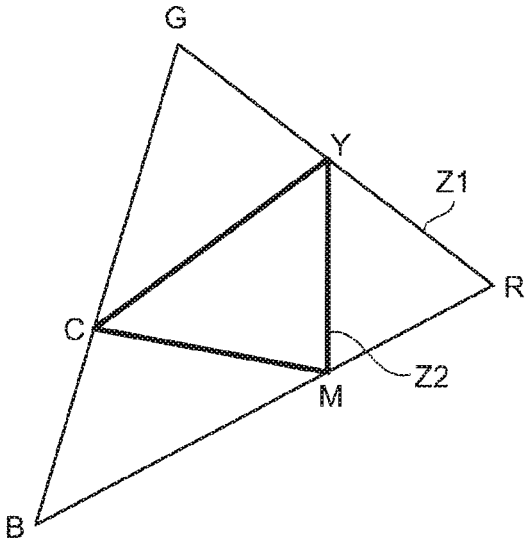
FIG. 73 is a diagram illustrating an example of a color space corresponding to the colors of the sub-pixels included in the first pixel and a color space corresponding to the colors of the sub-pixels included in the second pixel.
Figure 74:
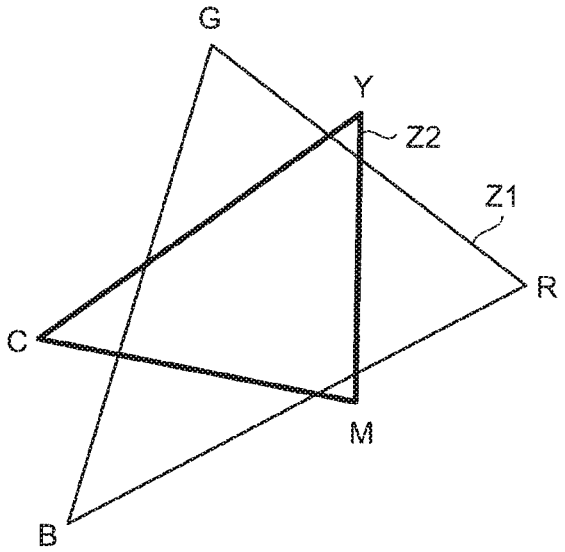
FIG. 74 is a diagram illustrating another example of the color space corresponding to the colors of the sub-pixels included in the first pixel and the color space corresponding to the colors of the sub-pixels included in the second pixel.
Figure 75:
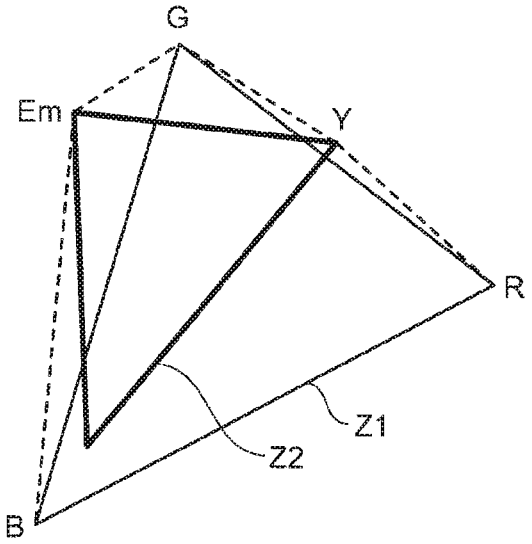
FIG. 75 is a diagram illustrating another example of the color space corresponding to the colors of the sub-pixels included in the first pixel and the color space corresponding to the colors of the sub-pixels included in the second pixel.
Figure 76:
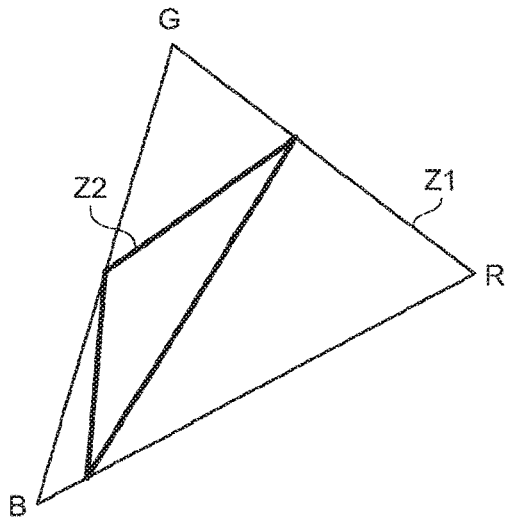
FIG. 76 is a diagram illustrating another example of the color space corresponding to the colors of the sub-pixels included in the first pixel and the color space corresponding to the colors of the sub-pixels included in the second pixel.

FIG. 73 is a diagram illustrating an example of a color space corresponding to the colors of the sub-pixels included in the first pixel and a color space corresponding to the colors of the sub-pixels included in the second pixel. FIGS. 74 to 76 are diagrams illustrating another example of the color space corresponding to the colors of the sub-pixels included in the first pixel and the color space corresponding to the colors of the sub-pixels included in the second pixel. As illustrated in FIG. 73, in the examples described above, the three colors (cyan (C), magenta (M), and yellow (Y)) among the colors of the sub-pixels included in the second pixel are complementary colors of the three colors (red (R), green (G), and blue (B)) among the colors of the sub-pixels included in the first pixel. However, the colors of the sub-pixels included in the second pixel are not limited thereto. For example, as illustrated in FIG. 74, the colors of the sub-pixels included in the second pixel may be complementary colors an upper limit of saturation of which is outside the range of the color space of red (R), green (G), and blue (B), which are the colors of the sub-pixels included in the first pixel. In the example illustrated in FIG. 74, upper limits of saturation of all the complementary colors of cyan (C), magenta (M), and yellow (Y) exceed the range of the color space of the colors of the sub-pixels included in the first pixel. Alternatively, the upper limit of saturation may be outside the range in only part of the complementary colors. Part or all of the colors of the sub-pixels included in the second pixel may be colors the upper limits of saturation of which are within the range of the color space of the colors of the sub-pixels included in the first pixel. For example, as illustrated in FIG. 75, the colors of the sub-pixels included in the second pixel may include a color such as emerald green (Em), which is not limited to the complementary color. As illustrated in FIGS. 74 and 75, when a combination of the colors of the sub-pixels constituting the color space outside the range of the color space of the colors of the sub-pixels included in the first pixel is employed as the colors of the sub-pixels included in the second pixel, a color in a higher color gamut, which cannot be extended with the combination of red (R), green (G), and blue (B), can be extended. As illustrated in FIG. 76, the colors of the sub-pixels included in the second pixel may be determined so that a color space corresponding to a color with higher frequency of use is constituted in the color space of red (R), green (G), and blue (B). In FIGS. 73 to 76, a color space of the first pixel is denoted by a reference sign Z1, and a color space of the second pixel is denoted by a reference sign Z2. In the examples illustrated in FIGS. 73 to 76, white (W) is present at the center part of the inside of a triangle indicating the color space (a position corresponding to (R,G,B)=(255, 255,255)). Part of the colors (for example, white (W)) of the sub-pixels in the second pixel may be the same as the colors of the sub-pixels in the first pixel. It is sufficient that at least one of the colors of the sub-pixels in the second pixel is different from the colors of the sub-pixels in the first pixel.

The exemplified color gamut of RGB and the like is indicated by a triangular range on an xy chromaticity range of the XYZ color system. However, a predetermined color space in which a defined color gamut is defined is not limited to be determined to be the triangular range, and may be determined to be a range of an arbitrary shape such as a polygon corresponding to the number of colors of the sub-pixels.

Figure 77:
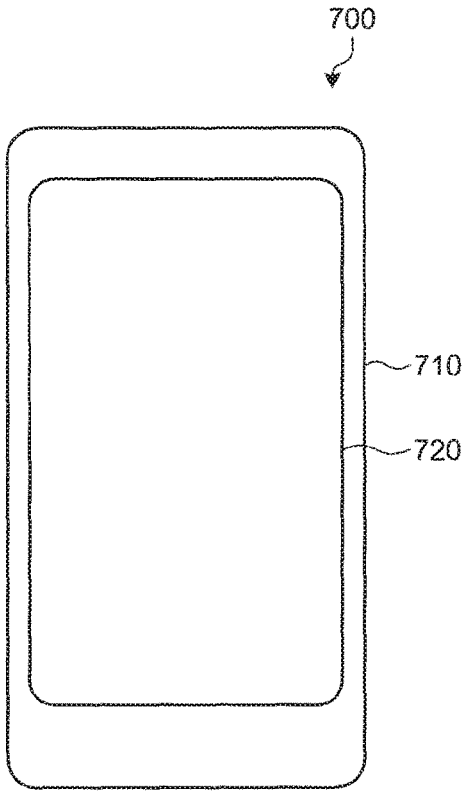
FIG. 77 is a diagram illustrating an example of an external appearance of a smartphone to which the present invention is applied.

Next, the following describes an application example of the image display device described in the above embodiment with reference to FIG. 77. The image display device described in the above embodiment can be applied to electronic apparatuses in various fields such as a smartphone. In other words, such an image display device can be applied to electronic apparatuses in various fields that display, as an image or video, a video signal input from the outside or a video signal generated inside.

FIG. 77 is a diagram illustrating an example of an external appearance of a smartphone 700 to which the present invention is applied. The smartphone 700 includes a display unit 720 arranged on one surface of a housing 710 thereof, for example. The display unit 720 is constituted of the image display device according to the present invention.

As described above, according to the embodiment, the number of colors combining the colors of the sub-pixels included in the first pixel and the colors of the sub-pixels included in the second pixel is the number of colors of the sub-pixels. That is, as compared with a case in which the sub-pixels are common to all the pixels, the number of colors of the sub-pixels can be increased by the number corresponding to the colors of the sub-pixels included in the second pixel. Accordingly, the number of colors of the sub-pixels in the first pixel and the number of colors of the sub-pixels in the second pixel can be used for color extension, which enables more varied and efficient color extension. By using part of the components of the input image signal corresponding to one of the first pixel and the second pixel that are adjacent to each other, to determine the output of the sub-pixels included in the other pixel, when a component of a color that cannot be extended with one of the pixels is generated because the color space of the first pixel is different from that of the second pixel, the component of the color that cannot be extended with the one of the pixels can be extended with the other pixel. According to the embodiment, as compared with a case of simply increasing the colors of the sub-pixels included in one pixel, the number of colors of the sub-pixels can be further increased while suppressing deterioration of resolution according to an increase in the number of sub-pixels included in one pixel, and output according to the input image signal corresponding to each pixel can be performed. That is, according to the embodiment, the number of colors of the sub-pixels can be compatible with the resolution.

When the output of the sub-pixels included in the first pixel is determined based on a combined component of the first component as the components of the input image signal corresponding to the first pixel and the out-of-color gamut component as the component the color of which cannot be extended with the sub-pixels included in the second pixel in the input image signal corresponding to the adjacent second pixel, and the output of the sub-pixels included in the second pixel is determined based on the third component obtained by eliminating the out-of-color gamut component from the second component as the components of the input image signal corresponding to the second pixel, color extension corresponding to the input image signals for two pixels including the out-of-color gamut component in the second pixel can be performed using a combination of the first pixel and the second pixel.

When the output of the sub-pixels included in the first pixel is determined by subtracting, from the combined component, the luminance adjustment component corresponding to the luminance of the first pixel that is increased by the out-of-color gamut component among the combined component, and the output of the sub-pixels included in the second pixel is determined based on the third component and the luminance adjustment component, the luminance of each of the first pixel and the second pixel corresponding to the input image signal can be reflected in each pixel with higher accuracy.

When each of the first pixel and the second pixel includes the white sub-pixel, each pixel can handle the outputs of white and the luminance irrespective of whether the pixel to which the input image signal is input is the first pixel or the second pixel. Accordingly, resolution related to brightness of each pixel in a display output (image) output from the image display unit 30 can be secured with granularity of the pixel 31. That is, the resolution can be secured. When the white sub-pixel is lit in a case in which there is a component that can be converted into white among the components of the input image signal, the luminance of each pixel can be secured with the lit white sub-pixel. That is, in view of securing the luminance, the output of the sub-pixels of other colors can be further suppressed, so that a power-saving property at a higher level can be obtained.

When the component that can be converted into white in the input image signal is reflected in the output of the white sub-pixel more preferentially than the sub-pixels of other colors, the number of sub-pixels to be lit can be reduced and the power-saving property can be enhanced.

Among the white sub-pixels included in the first pixel and the second pixel, corresponding to the output of one of the white sub-pixels having smaller output, the output of the other white sub-pixel is determined to balance the outputs between the white pixel included in the first pixel and the white pixel included in the second pixel. Accordingly, a display output having a better appearance can be obtained.

When a component that can be converted into a color other than white among the components of the input image signal is reflected in the output of the sub-pixels more preferentially than the white sub-pixel, the number of sub-pixels to be lit can be increased as compared with a case in which white is given precedence, and the granularity can be further reduced.

When the arrangement of the white sub-pixel in the first pixel is the same as the arrangement of the white sub-pixel in the second pixel, the resolution of the image to be obtained with the white sub-pixel can be obtained from a more regular arrangement of the white sub-pixel. Accordingly, a display output having a better appearance can be obtained.

When there are a plurality of combinations of the output of the sub-pixels of the first pixel based on the input image signal corresponding to the two pixels of the first pixel and the second pixel that are adjacent each other, and the output of the sub-pixels of the second pixel adjacent to the first pixel, the luminance distribution of each pixel can be balanced by employing the output of the sub-pixels of the first pixel and the output of the sub-pixels of the second pixel in which the luminance distribution of the first pixel and the luminance distribution of the second pixel are more approximate. Accordingly, a display output having a better appearance can be obtained.

When the components of the input image signal correspond to three colors among the sub-pixels included in the first pixel, color extension corresponding to the input image signal can be more securely performed with the sub-pixels included in the first-pixel. Due to this, when the out-of-color gamut component is generated in the second pixel, color extension can be more securely performed with the first pixel. In this way, according to the embodiment, color extension corresponding to the input image signal can be more securely performed.

When the number of the sub-pixels included in the first pixel is the same as the number of the sub-pixels included in the second pixel, and the arrangement of the sub-pixels in the first pixel and the arrangement of the sub-pixels in the second pixel are arrangements in which hue arrangements in the respective pixels further approximate to each other, when the hue of the sub-pixels included in the first pixel is compared with the hue of the sub-pixels included in the second pixel, unevenness of colors in the display area constituted by the respective colors of the sub-pixels can be more flattened.

When the number of the sub-pixels included in the first pixel is the same as the number of the sub-pixels included in the second pixel, and the sub-pixels in the first pixel and the sub-pixels in the second pixel are arranged so that high and low relations of the luminance are the same between the sub-pixels in the respective pixels, unevenness of the luminance in the display area constituted by the respective colors of the sub-pixels can be more flattened.

By providing the image display unit in which the first pixel is adjacent to the second pixel in the display area in which the first pixel constituted of sub-pixels of three or more colors included in the first color gamut and the second pixel constituted of sub-pixels of three or more colors included in the second color gamut different from the first color gamut are arranged in a matrix, the number of colors of the sub-pixels of the first pixel and the number of colors of the sub-pixels of the second pixel can be used for color extension, which enables more varied and efficient color extension. The first pixel and the second pixel each performs output based on the input image signal, so that the number of colors of the sub-pixels and the resolution corresponding to the number of pixels can be secured. In this way, according to the embodiment, the number of colors of the sub-pixels can be compatible with the resolution.

When three colors among the colors of the sub-pixels included in the first pixel correspond to red, green, and blue, color extension according to the input image signal corresponding to the RGB color space can be more securely performed with the sub-pixels included in the first pixel. Due to this, when the out-of-color gamut component is generated in the second pixel, color extension can be more securely performed with the first pixel. In this way, according to the embodiment, color extension corresponding to the input image signal can be more securely performed.

When the display area has linear sides and the pixels adjacent to at least one side are the first pixels, the first pixel that performs color extension cooperating with the second pixel adjacent to the side can be more securely secured.

When the second pixels are arranged in a staggered manner, the number of the first pixels adjacent to the second pixels can be increased. Accordingly, the first pixel that performs color extension cooperating with the second pixel can be more securely secured.

When the colors of the sub-pixels included in one of the first pixel and the second pixel are the complementary colors of the colors of the sub-pixels included in the other one of the pixels, color extension of the complementary colors can be performed with one sub-pixel included in the one of the pixels, although the color extension is performed using two sub-pixels in the other one of the pixels. Accordingly, a power-saving property at a higher level can be obtained.

In a case in which the output of the sub-pixels included in the first pixel is determined based on the first component as the components of the input image signal corresponding to the first pixel, and the output of the sub-pixels included in the second pixel is determined based on the second component as the components of the input image signal corresponding to the second pixel, when the sub-pixels including the same color component are continuously lit in a straight line and there is a certain or more difference between the output from the sub-pixels including the same color component and the output from the sub-pixels adjacent to the sub-pixels including the same color component, continuity of the same color component can be reduced by determining the output of the sub-pixels included in the first pixel based on part or all of the first component from which the adjustment component including the same color component is eliminated, and determining the output of the sub-pixels included in the second pixel based on the second component and the adjustment component. Thus, a line can be prevented from being obvious, the line possibly being generated due to the sub-pixels including the same color component that are continuously lit in a straight line.

When the adjustment component corresponds to a half of the same color component in the first component, prevention of generation of the line and prevention of generation of granularity can be balanced. Accordingly, a display output having a better appearance can be obtained.

In a case in which the input image signal corresponding to the second pixel is the input image signal corresponding to the edge of the image, when the out-of-color gamut component is not reflected in the output of the "sub-pixels of the first pixel" that is not adjacent to the "sub-pixels of the second pixel in which light is output", edge deviation can be prevented.

In a case in which the input image signal corresponding to the second pixel is the input image signal corresponding to the edge of the image, when the out-of-color gamut component is reflected in the output of one of the sub-pixel of a color including the out-of-color gamut component among the sub-pixels included in the second pixel, color extension closer to the input image signal can be performed without causing edge deviation.

When the input image signal corresponding to the second pixel included in the group of pixels is the input image signal corresponding to the edge of the image, color extension can be performed with higher accuracy while minimizing edge deviation by using the out-of-color gamut component corresponding to the second pixel to determine the output of the sub-pixels adjacent to the sub-pixels of the second pixel in which light is output among the sub-pixels in the first pixel included in another group that is adjacent to the second pixel.

When the input image signal corresponding to the second pixel included in the group of pixels is the input image signal corresponding to the edge of the image, higher color reproducibility can be secured by determining the output of the sub-pixels included in the first pixel within a range in which the saturation and the luminance are not reversed between the second pixel and the first pixel in which the out-of-color gamut component of the second pixel is reflected, and rotation of the hue is not caused. The rotation of the hue may be caused when a color for determining the hue to be the strongest in a case in which the out-of-color gamut component is not reflected in the first pixel is different from a color for determining the hue to be the strongest in a case in which the out-of-color gamut component is reflected in the first pixel.

By determining whether the input image signal corresponding to the second pixel is the input image signal corresponding to the edge of the image based on a difference in at least one of the hue, the luminance, and the saturation between the first component and the second component, determination can be performed for detecting the edge of the image in which pixel deviation visually shows up more easily when edge deviation is caused. Due to this, processing can be more securely performed for preventing edge deviation on such an edge of the image.

When the out-of-color gamut component is not reflected in the outputs of the sub-pixels included in the first pixel and the second pixel, edge deviation can be prevented through simpler processing.

An organic EL display device has been disclosed as an example. As other application examples, exemplified are various image display devices of flat-panel type such as other self-luminous display devices, liquid crystal display devices, or electronic paper display devices including an electrophoresis element and the like. Obviously, the size of the device is not specifically limited, and the present invention can be applied to any of small, medium, and large devices.

In the above embodiment, one image processing circuit includes the signal processing unit 21 functioning as a processing unit and the edge determination unit 22 functioning as a determination unit. However, the embodiment is not limited thereto. The processing unit and the determination unit may be separately configured.

Regarding other working effects achieved by the aspects described in the embodiment, the working effects, which are obvious from the description herein or appropriately conceivable by those skilled in the art, are naturally considered to be achieved by the present invention.

What is claimed is:

1. An image display device comprising:

an image display unit including:

a first pixel having sub-pixels including a first sub-pixel having a first color, a second sub-pixel having a second color, and a third sub-pixel having a third color, wherein the first color, the second color, and the third color are included in a first color gamut that includes white; and a second pixel having sub-pixels including a fourth sub-pixel having a fourth color, a fifth sub-pixel having a fifth color, and a sixth sub-pixel having a sixth color, wherein the fourth color, the fifth color, and the sixth color are included in a second color gamut that includes white and that is different from the first color gamut, and a processing unit configured to determine an output of each of the sub-pixels in the first pixel and the second pixel based on an input image signal, wherein the first pixel and the second pixel are adjacent to each other, and the processing unit is configured to:

receive the input image signal corresponding to the first color, the second color, and the third color as an input signal for the first pixel, receive the input image signal corresponding to the first color, the second color, and the third color as an input signal for the second pixel, and determine the output of each of the sub-pixels in the first pixel according to the input image signal for the first pixel and the input image signal for the second pixel, each of the first pixel and the second pixel further includes a white sub-pixel, the processing unit determines outputs of the first pixel and the second pixel so that the white sub-pixel is lit when there is a white convertible component that is convertible into white in components of the input image signal, and the processing unit causes the white convertible component in the input image signal to be reflected in an output of the white sub-pixel of the first pixel and causes a component eliminating the white convertible component from the input image signal to be reflected in an output of the sub-pixels of colors other than white.

2. The image display device according to claim 1, wherein the processing unit is configured to cause a non-white convertible component that is convertible into colors other than white in components of the input image signal for the second pixel to be reflected in an output of the sub-pixels other than the white sub-pixel of the second pixel, and the processing unit is configured to cause a component eliminating the non-white convertible component from the input image signal to be reflected in an output of the white sub-pixel in the first pixel.

3. The image display device according to claim 1, wherein an arrangement of the white sub-pixel in the first pixel is same as an arrangement of the white sub-pixel in the second pixel.

4. An image display device comprising:

an image display unit including:

a first pixel having sub-pixels including a first sub-pixel having a first color, a second sub-pixel having a second color, and a third sub-pixel having a third color, wherein the first color, the second color, and the third color are included in a first color gamut that includes white; and a second pixel having sub-pixels including a fourth sub-pixel having a fourth color, a fifth sub-pixel having a fifth color, and a sixth sub-pixel having a sixth color, wherein the fourth color, the fifth color, and the sixth color are included in a second color gamut that includes white and that is different from the first color gamut, and a processing unit that is configured to determine an output of each of the sub-pixels in the first pixel and the second pixel based on an input image signal, wherein the first pixel and the second pixel are adjacent to each other, and the processing unit is configured to:

receive the input image signal corresponding to the first color, the second color, and the third color as an input signal for the first pixel, receive the input image signal corresponding to the first color, the second color, and the third color as an input signal for the second pixel, and determine the output of each of the sub-pixels in the second pixel according to the input image signal for the first pixel and the input image signal for the second pixel, each of the first pixel and the second pixel further includes a white sub-pixel, the processing unit determines outputs of the first pixel and the second pixel so that the white sub-pixel is lit when there is a white convertible component that is convertible into white in components of the input image signal, and the processing unit causes the white convertible component in the input image signal to be reflected in an output of the white sub-pixel of the first pixel and causes a component eliminating the white convertible component from the input image signal to be reflected in an output of the sub-pixels of colors other than white.

5. The image display device according to claim 4, wherein the first pixel and the second pixel each include a white sub-pixel, the processing unit is configured to cause a non-white convertible component that is convertible into colors other than white in components of the input image signal for the second pixel to be reflected in an output of the sub-pixels other than the white sub-pixel of the second pixel, and the processing unit is configured to cause a component eliminating the non-white convertible component from the input image signal to be reflected in an output of the white sub-pixel in the first pixel.

6. The image display device according to claim 4, wherein an arrangement of the white sub-pixel in the first pixel is same as an arrangement of the white sub-pixel in the second pixel.

* * * * *